US006555299B2

(12) United States Patent
Hosokawa

(10) Patent No.: US 6,555,299 B2
(45) Date of Patent: Apr. 29, 2003

(54) METHOD OF PROCESSING SILVER HALIDE COLOR PHOTOGRAPHIC LIGHT-SENSITIVE MATERIAL

(75) Inventor: Junichiro Hosokawa, Minami-Ashigara (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/876,138

(22) Filed: Jun. 8, 2001

(65) Prior Publication Data

US 2002/0031731 A1 Mar. 14, 2002

(30) Foreign Application Priority Data

Jun. 9, 2000 (JP) ..... 2000-173607

(51) Int. Cl.[7] ..... G03C 7/407; G03C 7/46
(52) U.S. Cl. ..... 430/351
(58) Field of Search ..... 430/351

(56) References Cited

U.S. PATENT DOCUMENTS

| | | | | |
|---|---|---|---|---|
| 4,021,240 A | | 5/1977 | Cerquone et al. | |
| 4,766,058 A | * | 8/1988 | Sampei et al. | 430/486 |
| 5,273,866 A | * | 12/1993 | Fujita et al. | 430/503 |

FOREIGN PATENT DOCUMENTS

| | | |
|---|---|---|
| EP | 0 209 118 A | 1/1987 |
| EP | 0 329 003 A | 8/1989 |
| EP | 0 573 649 A | 12/1993 |
| EP | 0 762 201 A | 3/1997 |
| EP | 0 845 706 A | 6/1998 |
| JP | 05241267 A | 9/1993 |
| JP | 10039468 A | 2/1998 |
| JP | 10115888 A | 5/1998 |

OTHER PUBLICATIONS

Patent Abstracts of Japan Publication No. 62008146, dated Jan. 16, 1987, *Silver Halide Color Photographic Sensitive Material.*

Patent Abstracts of Japan Publication No. 62010649, dated Jan. 19, 1987, *Silver Halide Color Photographic Sensitive Material.*

Patent Abstracts of Japan Publication No. 09146206, dated Jun. 6, 1997, *Silver Halide Color Photographic Sensitive Material and Image Formation.*

Patent Abstracts of Japan Publication No. 04337727, dated Nov. 25, 1992, *Silver Halide Color Photographic Sensitive Material.*

Patent Abstracts of Japan Publication No. 61020943, dated Jan. 29, 1986, *Heat Developable Photosensitive Material.*

* cited by examiner

*Primary Examiner*—Hoa Van Le
(74) *Attorney, Agent, or Firm*—Burns, Doane, Swecker & Mathis, LLP

(57) ABSTRACT

A method for processing a silver halide color photographic light-sensitive material. The material has, on a support, at least one light-sensitive silver halide emulsion layer comprising a light-sensitive silver halide emulsion, a compound that forms a dye by a coupling reaction with a developing agent in an oxidized form, and a binder. The method comprises processing the light-sensitive material such that a silver density of the at least one light-sensitive silver halide emulsion layer during development is $4\times10^5$ g/m$^3$ or more.

15 Claims, No Drawings

METHOD OF PROCESSING SILVER HALIDE COLOR PHOTOGRAPHIC LIGHT-SENSITIVE MATERIAL

CROSS-REFERENCE TO RELATED APPLICATION

This application is based upon and claims the benefit of priority from the prior Japanese Patent Application No. 2000-173607, filed Jun. 9, 2000, the entire contents of which are incorporated herein by reference.

BACKGROUND OF THE INVENTION

The present invention relates to a method of processing a silver halide photographic light-sensitive material and, more particularly, to an image forming method having high sensitivity and superior in development characteristics with a short time development and rapid processing suitability.

Photographic light-sensitive materials using silver halides are more and more developing in recent years, and high-quality color images are readily available at present. For example, in a method usually called color photography, photography is performed using a color negative film, and a color print is obtained by optically printing image information recorded on the developed color negative film onto photographic printing paper. Recently, this process has been developed to a high degree, and color laboratories as large-scale centralized points for efficiently producing large amounts of color prints or so-called mini-labs as small, simple printer processors installed in stores have spread. Therefore, anyone can easily enjoy color photography.

The principle of currently widespread color photography uses color reproduction by the subtraction color process. In a common color negative film, photosensitive layers using silver halide emulsions as photosensitive elements given sensitivity to blue, green, and red regions are formed on a transparent support. So-called color couplers for forming dyes of yellow, magenta, and cyan as hues which are complementary colors to blue, green, and red, respectively, are contained, in combination with these colors, in the photosensitive layers. A color negative film imagewise exposed by photography is developed in a color developer containing an aromatic primary amine developing agent. Consequently, silver halide grains exposed to light are developed, i.e., reduced by the developing agent, and at the same time the dyes are formed by coupling reactions between the oxidized developing agent generated and the color couplers. A dye image is obtained by removing, by bleaching and fixing, metal silver (developed silver) produced by the development and unreacted silver halides. Color photographic printing paper as a color light-sensitive material formed by coating a reflecting support with photosensitive layers having similar combinations of photosensitive wavelength regions and hues is optically exposed through the developed color film and subjected to analogous color development, bleaching, and fixing. In this manner, a dye image color print reproducing the original scene can be obtained.

Although this system is currently widespread, demands for improving the ease of the system have increased more and more.

Jpn. Pat. Appln. KOKAI Publication No. (hereinafter referred to as JP-A-)10-39468 discloses a technique of reducing the color development time by raising the processing temperature of a color developer or the concentration of a color developing agent. JP-A-10-39468 describes a method of achieving rapid processing without deteriorating color reproduction and sharpness.

Unfortunately, the method of performing the color development, bleaching, and fixing described above has many problems. First, the compositions and temperatures of processing baths of the above-mentioned color development, bleaching, and fixing must be precisely controlled. This control requires expert knowledge and skilled operation. Second, these processing solutions contain substances, such as a color developing agent and an iron chelating compound as a bleaching agent, whose discharge must be regulated from the environmental point of view. To this end, it is often necessary to install dedicated equipment in the developing apparatuses. Third, these developing processes require a long time, although the time is reduced by recent technological developments. Hence, this developing method is still unsatisfactory in meeting the demands for rapidly reproducing recorded images.

From the above background, developing methods differing from the above method have been devised. One example is heat development.

As a heat development type color light-sensitive material, a method of forming a dye image by a coupling reaction between a developing agent in an oxidized form and a coupler is described in, e.g., U.S. Pat. Nos. 3,761,270 and 4,021,240. Also, a method of forming a positive color image by a photosensitive silver dye bleach process is described in U.S. Pat. No. 4,235,957.

Furthermore, a method of imagewise releasing or forming a diffusive dye by heat development and transferring this diffusive dye onto a dye fixing element has been proposed. In this method, both negative and positive dye images can be obtained by changing the type of dye-providing compound used or the type of silver halide used. Details of the method are described in, e.g., U.S. Pat. Nos. 4,500,626, 4,483,914, 4,503,137, and 4,559,290, JP-A's-58-149046, 60-133449, 59-218443, and 61-238056, and EP210660A2.

As a system not requiring a processing solution containing a color developing agent, a pictography system has been proposed by Fuji Photo Film Co., Ltd. In this system, a small amount of water is supplied to a light-sensitive member containing a base precursor to adhere this light-sensitive member to an image receiving member, and the resultant structure is heated to cause a development reaction. This system is environmentally advantageous because it does not use any processing bath previously described.

Unfortunately, the above-mentioned rapid processing and heat development pose a new problem. That is, when a light-sensitive material that is designed with the assumption that the material is to be subjected to conventional color development, is subjected to the above mentioned rapid processing, or when a heat development type light-sensitive material designed on a conventional light-sensitive material, is subjected to heat development, the rate of development lowers, so satisfactory sensitivity and gradation cannot be realized. This problem is particularly notable when a large-size silver halide emulsion is used to increase the sensitivity when a material for photography is manufactured.

BRIEF SUMMARY OF THE INVENTION

It is an object of the present invention to provide a method for processing a silver halide photographic light-sensitive material having high sensitivity and superior in rapid processing suitability and heat development suitability.

The present inventors continued investigation to attain these objects and have found the following. That is, it is necessary to efficiently generate a developing agent in an oxidized form during rapid processing, and to design a material so that no load acts on the diffusion length of a developing agent. In addition, in the case of a heat development type light-sensitive material, it is necessary to increase the efficiency of silver ion supply from silver behenate and organic silver to light-sensitive silver halide grains. Accordingly, it is important to so design a light-sensitive material that the silver density in a silver halide emulsion during development is high.

The present inventors made extensive studies, and the above objects were effectively achieved by the present invention presented below. That is, the present invention provides the following methods:

(I) A method for processing a silver halide color photographic light-sensitive material, having, on a support, at least one light-sensitive silver halide emulsion layer comprising a light-sensitive silver halide emulsion, a compound capable of forming a dye by a coupling reaction with a developing agent in an oxidized form, and a binder, wherein the method comprises processing the light-sensitive material such that a silver density of the at least one light-sensitive silver halide emulsion layer during development is $4\times10^5$ g/m$^3$ or more.

(II) The method described in item (I) above, wherein the silver density is $6\times10^5$ g/m$^3$ or more.

(III) The method described in item (I) or (II) above, wherein the light-sensitive material has a blue-sensitive silver halide emulsion layer containing a yellow coupler, a green-sensitive silver halide emulsion layer containing a magenta coupler, and a red-sensitive silver halide emulsion layer containing a cyan coupler, and each of the blue-, green-, and red-sensitive layers comprises two or more photosensitive layers different in speed.

(IV) The method described in any one of items (I) to (III) above, wherein the method comprises heat development processing without using a processing member.

(V) The method described in any one of items (I) to (IV) above, wherein at least one light-sensitive silver halide emulsion layer of the light-sensitive material contains a light-sensitive silver halide emulsion having an average aspect ratio of 2 or more.

(VI) The method described in item (V) above, wherein the average aspect ratio is 8 or more.

(VII) The method described in any one of items (I) to (VI) above, wherein at least one light-sensitive silver halide emulsion layer of the light-sensitive material contains a tabular silver halide emulsion having an average grain thickness of 0.01 to 0.07 $\mu$m.

(VIII) The method described in any one of items (I) to (VII) above, wherein at least one light-sensitive layer of the light-sensitive material contains a developing agent or its precursor.

(IX) The method described in item (VIII) above, wherein the developing agent is selected from compounds represented by formulas (1) to (5) below:

(1)

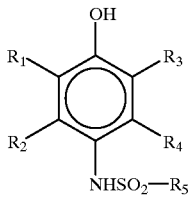

(2)

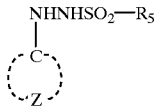

(3)

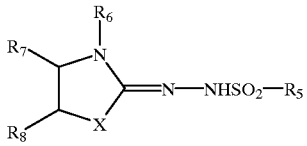

(4)

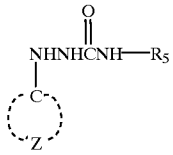

(5)

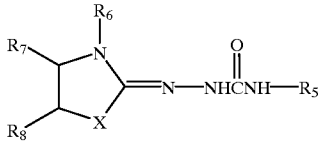

wherein each of $R_1$ to $R_4$ independently represents a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents a substituted or unsubstituted alkyl group, aryl group or heterocyclic group; Z represents an atom group capable of forming an aromatic ring (including a heteroaromatic ring) together with the carbon atom, which aromatic ring may have a substituent other than —NHNHSO$_2$—R$_5$, provided that when the aromatic ring formed with Z is a benzene ring, the total of Hammett's constants (a) of the substituents is 1 or more; $R_6$ represents a substituted or unsubstituted alkyl group; X represents an oxygen atom, a sulfur atom, a selenium atom or a tertiary nitrogen atom substituted with an alkyl group or aryl group; and $R_7$ and $R_8$ each represent a hydrogen atom or a substituent, provided that $R_7$ and $R_8$ may be bonded to each other to thereby form a double bond or a ring.

(X) The method described in item (VIII) above, wherein the developing agent is a para-phenylenediamine-based color developing agent.

(XI) The method described in item (VIII) above, wherein the precursor of the developing agent is represented by formula (6) below:

(6)

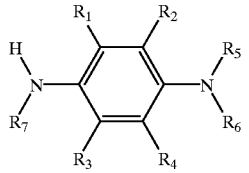

wherein each of $R_1$, $R_2$, $R_3$ and $R_4$ independently represents a hydrogen atom or a substituent; each of $R_5$ and $R_6$ independently represents an alkyl group, an aryl group, a heterocyclic group, an acyl group or a sulfonyl group; $R_1$ and $R_2$, $R_3$ and $R_4$, $R_5$ and $R_6$, $R_2$ and $R_5$, and/or $R_4$ and $R_6$ may be bonded to each other to thereby form a 5-membered, 6-membered or 7-membered ring; and $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)— or $(M)_{1/n}OSO_2$—, wherein each of $R_{11}$, $R_{12}$, $R_{13}$ and $R_{14}$ independently represents an alkyl group, an aryl group or a heterocyclic group, $R_{15}$ represents a hydrogen atom or a block group, W represents an oxygen atom, a sulfur atom or >N—$R_{18}$, each of $R_{16}$, $R_{17}$ and $R_{18}$ independently represents a hydrogen atom or an alkyl group, M represents a n-valence cation, and n is an integer of 1 to 5.

(XII) The method described in any one of items (I) to (XI) above, wherein at least one light-sensitive silver halide emulsion contained in the light-sensitive material is a tellurium-sensitized emulsion.

(XIII) The method described in any one of items (I) to (XII) above, wherein at least one light-sensitive silver halide emulsion layer of the light-sensitive material contains one or more types of fine inorganic grains having a refractive index of 1.62 to 3.30 with respect to light having a wavelength of 500 nm in a dispersing medium phase of the emulsion layer, the total weight % of the fine inorganic grains contained in a unit volume of the dispersing medium phase is 1.0 to inorganic 95, and the dispersing medium phase containing the fine inorganic grains is substantially transparent to light having a wavelength at which the sensitivity of the emulsion layer is maximum.

(XIV) The method described in any one of items (I) to (XIII) above, wherein the light-sensitive silver halide emulsion layer contains a light-sensitive silver halide emulsion containing tabular silver halide grains to which sensitizing dyes are adsorbed such that the maximum spectral absorption wavelength is less than 500 nm and the light absorption intensity is 60 or more, or the maximum spectral absorption wavelength is 500 nm or more and the light absorption intensity is 100 or more.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

In the present invention, it is basically possible to use color reproduction by the subtraction color process to form a light-sensitive material used to record an original scene and reproduce the scene as a color image. That is, at least three types of photosensitive layers sensitive to blue, green, and red regions are formed, and color couplers capable of forming dyes of yellow, magenta, and cyan as complementary colors to the sensitive wavelength regions of these photosensitive layers are contained in the photosensitive layers. Color information of an original scene can be recorded by using this light-sensitive material. An image to be appreciated can be reproduced by exposing, through the dye image thus obtained, color photographic printing paper having similar relationships between sensitive wavelengths and hues. It is also possible to read information of a dye image obtained by photographing an original scene and reproduce an image to be appreciated on the basis of this information. Reading image information after color development and immediately before desilvering is preferred for rapid processing.

The sensitive wavelength regions and hues can also be given a relationship other than the above complementary color relationship. When this is the case, original color information can be reproduced by loading image information as described above and performing image processing such as hue conversion for this image information.

As a light-sensitive material used in the method of the present invention (to be also referred to as a "light-sensitive material of the present invention" hereinafter), light-sensitive layers sensitive to three or more wavelength regions can also be formed.

In the present invention, "during development" means a step in which development is started on silver halide grains and developed silver is formed.

The silver density during development of the present invention indicates the density of light-sensitive silver halide grains during development, and indicates the weight of silver halide existing in a unit volume during development, in terms of silver.

If the volume of a light-sensitive material varies in a developing bath used in a solution development system, the silver density indicates the density immediately before the development is completed. More specifically, in a solution development system the silver density can be calculated from the coated silver amount of a light-sensitive silver halide contained a light-sensitive material and the swelled film thickness in a processing bath. In a heat development system, the silver density can be calculated from the coated silver amount and the dry film thickness.

The silver density of each layer in a multilayered film in a solution development system can be calculated from the coated silver amount and swelled film thickness of the layer. The swelled film thickness of each layer can be calculated by a method described in U.S. Pat. No. 5,928,847, the disclosure of which is incorporated herein by reference, which uses an enzyme decomposition method and a scanning electron microscope.

In the present invention, the silver density during development must be $4\times10^5$ g/m$^3$ or more. This silver density is preferably $6\times10^5$ g/m$^3$ or more, more preferably $8\times10^5$ g/m$^3$ or more, the upper limit of the silver density is not particularly limitted, but preferably $30\times10^5$ g/m$^3$ or less.

When the method of the present invention is applied to heat development, the temperature during development is preferably 50° C. or more, and more preferably 60° C. or more. The development time is preferably 5 to 60 sec and more preferably 5 to 45 sec.

In the present invention, a tabular grain has one twin plane or two or more parallel twin planes.

A twin plane is a (111) face on the two sides of which ions at all lattice points have a mirror image relationship.

In a tabular grain used in the present invention, the twin plane spacing can be 0.012 μm or less as described in U.S. Pat. No. 5,219,720. Also, the (111) major face distance/twin plane spacing can be 15 or more as described in JP-A-5-249585.

The tabular grain has two parallel main planes and side planes connecting the main planes. When this tabular grain is viewed from a direction perpendicular to the main plain thereof, the main plane has a triangular shape, a hexagonal shape, or a rounded triangular or hexagonal shape. When a tabular grain has a hexagonal main planes, opposing edges thereof are parallel to each other.

In an emulsion of the present invention, the sum of projected area of tabular grains accounts for preferably 100 to 50%, more preferably 100 to 80%, and most preferably 100 to 90% of the total projected area of all grains.

A ratio smaller than 50% is not preferable because the merits (improvements of the sensitivity/graininess ratio and sharpness) of tabular grains cannot be well utilized.

An average grain thickness of the tabular grain of the invention is preferably 0.01 to 0.3 μm, more preferably 0.01 to 0.2 μm, much more preferably 0.01 to 0.1 μm, particularly preferably 0.01 to 0.07 μm.

The average grain thickness herein is an arithmetic mean of grain thinknesses of all the tabular grains. Grains having the average grain thickness of less than 0.01 μm are difficult to prepare. On the other hand, when the average grain thickness exceeds 0.3 μm, it is difficult to obtain the advantages of the invention, which is not preferable.

An average equivalent circle diameter of the tabular grains of the invention is preferably 0.3 to 5 μm, more preferably 0.4 to 4 μm, and much more preferably 0.5 to 3 μm.

The average equivalent circle diameter herein is an arithmetic mean of equivalent circle diameters of all the tabular grains contained in the emulsion.

When the average equivalent circle diameter is less than 0.3 μm, it is not easy to attain the advantages of the invention, which is not preferable. On the other hand, when the average equivalent circle diameter exceeds 5 μm, pressure property deteriorates, which is not preferable.

The ratio of equivalent circle diameter to thickness with respect to silver halide grain is referred to as aspect ratio. That is, the aspect ratio is the quotient of the equivalent circle diameter of the projected area of each individual silver halide grain divided by the grain thickness.

One method of determining the aspect ratio comprises obtaining a transmission electron micrograph by the replica technique and measuring the diameter of a circle with the same area as the projected area of each individual grain (equivalent circle diameter) and the grain thickness.

This grain thickness is calculated from the length of replica shadow.

The emulsion of the invention has an average aspect ratio of preferably 2 to 100, more preferably 5 to 80, much more preferably 8 to 50, and especially preferably 12 to 50.

The average aspect ratio herein is an arithmetic mean of aspect ratios of all the tabular grains in the emulsion.

When the average aspect ratio is less than 2, the merit of the tabular grains cannot be fully utilized, which is not preferable. On the other hand, when the aspect ratio exceeds 100, pressure property deteriorates, which is not preferable.

In the present invention, the grain thickness and the aspect ratio can choose arbitrarily within the scopes mentioned above, but tabular grains having thin thickness and high aspect ratio are preferably used.

Various methods can be employed for the formation of tabular grains. For example, the grain forming methods described in U.S. Pat. No. 5,494,789 can be employed.

In the production of tabular grains of high aspect ratio, it is important to form twinned crystal nuclei of small size. Thus, it is desirable to perform nucleation within a short period of time under low temperature, high pBr, low pH and small gelatin amount conditions. With respect to the type of gelatin, a gelatin of low molecular weight, a gelatin whose methionine content is low, a gelatin that undergone phthalation and so on are preferable.

After the nucleation, physical ripening is performed to thereby eliminate nuclei of regular crystals, single twinned crystals and nonparallel multiple twinned crystals while selectively causing nuclei of tabular grain nuclei (parallel multiple twinned nuclei) to remain.

Thereafter, a water-soluble silver salt and a water-soluble halide salt are added to perform grain growth to prepare emulsion containing tabular grains.

Further, the grain growth can preferably be performed by adding silver halide fine grains separately prepared in advance or simultaneously prepared in a separate reaction vessel to thereby feed silver and halide.

In an emulsion of the present invention, hexagonal tabular grains in which the ratio of the length of an edge having a maximum length to the length of an edge having a minimum length is 1 to 2 account for preferably 100 to 50%, more preferably 100 to 70%, and most preferably 100 to 90% of the projected area of all grains in the emulsion. Mixing of tabular grains other than these hexagonal grains is unpreferable in respect of the homogeneity between grains.

An emulsion of the present invention is preferably monodisperse.

In the present invention, the variation coefficient of the grain size distribution of the projected area of all silver halide grains is preferably 35% or less, more preferably 25 to 3%, and most preferably 20 to 3%. A variation coefficient exceeding 35% is unfavorable in respect of the homogeneity between grains.

The variation coefficient of the grain size distribution is the value obtained by dividing the variation (standard deviation) of the equivalent-sphere diameters of individual silver halide grains by the average equivalent-sphere diameter.

As tabular grains of the present invention, it is possible to use silver bromide, silver bromochloride, silver iodobromide, silver chloroiodide, silver chloride, and silver bromochloroiodide. However, the use of silver bromide, silver iodobromide, and silver bromochloroiodide is preferred.

When a grain has phases each containing an iodide or chloride, these phases can be uniformly distributed or localized in the grain.

A silver halide grain can also contain another silver salt, e.g., silver rhodanate, silver sulfide, silver selenide, silver carbonate, silver phosphate, or organic acid silver, as another grain or in a portion of the silver halide grain.

In the present invention, the silver iodide content of a tabular grain is preferably 0.1 to 20 mol %, more preferably 0.1 to 15 mol %, and most preferably 0.2 to 10 mol %.

A silver iodide content less than 0.1 mol % is unfavorable because the effects of enhancing dye adsorption and raising the intrinsic sensitivity become difficult to obtain. A silver iodide content exceeding 20 mol % is undesirable because the developing speed generally lowers.

In the present invention, the variation coefficient of the inter-grain silver iodide content distribution of tabular grains is preferably 30% or less, more preferably 25 to 3%, and most preferably 20 to 3%. A variation coefficient exceeding 30% is not preferable in respect of the homogeneity between grains.

The silver iodide content of each individual tabular grain can be measured by analyzing the composition of the grain using an X-ray microanalyzer.

The variation coefficient of the silver iodide content distribution is the value obtained by dividing the standard deviation of the silver iodide contents of individual grains by the average silver iodide content of the grains.

The tabular grains used in the invention may have a dislocation line.

The dislocation line is a linear lattice defect at the boundary between a region already slipped and a region not slipped yet on a slip plane of crystal.

Dislocation lines in a silver halide crystal are described in, e.g., 1) C. R. Berry. J. Appl. Phys., 27, 636 (1956); 2) C. R. Berry, D. C. Skilman, J. Appl. Phys., 35, 2165 (1964); 3) J. F. Hamilton, Phot. Sci. Eng., 11, 57 (1967); 4) T. Shiozawa, J. Soc. Photo. Sci. Jap., 34, 16 (1971); and 5) T. Shiozawa, J. Soc. Phot. Sci. Jap., 35, 213 (1972). Dislocation lines can be analyzed by an X-ray diffraction method or a direct observation method using a low-temperature transmission electron microscope.

In direct observation of dislocation lines using a transmission electron microscope, silver halide grains, extracted carefully from an emulsion so as not to apply a pressure by which dislocation lines are produced in the grains, are placed on a mesh for electron microscopic observation. While the sample is cooled in order to prevent damage (e.g., print out) due to electron rays, the observation is performed by a transmission method.

In this case, as the thickness of a grain increases, it becomes more difficult to transmit electron rays through it. Therefore, grains can be observed more clearly by using an electron microscope of high voltage type (200 kV or more for a thickness of 0.25 $\mu$m).

JP-A-63-220238 describes a technique of introducing, under control, dislocation lines into silver halide grains.

It is mentioned that the tabular grains into which dislocation lines have been introduced are superior to the tabular grains having no dislocation lines in photographic characteristics such as sensitivity and reciprocity law.

With respect to the tabular grains, the position and number of dislocation lines in each grain, as viewed from a direction perpendicular to the main planes thereof, can be determined from a photograph of grains taken using an electron microscope in the above manner.

When the tabular grains of the present invention have dislocation lines, the position thereof is optional and can be selected from among, for example, localizing dislocation lines at apex and fringe portions of grains and introducing dislocation lines throughout the main planes. It is especially preferred that dislocation lines be localized at fringe portions.

The fringe portion mentioned in the present invention refers to the periphery of tabular grains. Specifically, the fringe portion refers to an outer region from a point where, in a distribution of silver iodide from the sides to center of tabular grains, the silver iodide content exceeds or becomes less than the average silver iodide content over the entire grain, as viewed from the grain sides.

When the tabular grains used in the invention have dislocation lines, the density of the dislocation lines may be arbitral. The tabular grains may have, for example, 10 dislocation lines, 30 dislocation lines, or 50 dislocation lines per grain, depending on cases.

The tabular grains of the present invention may be epitaxial silver halide grains comprising host tabular grains and, superimposed on surfaces thereof, at least one sort of silver salt epitaxy.

In the present invention, the silver salt epitaxy may be formed on selected sites of host tabular grain surfaces, or may be localized on corners or edges (when tabular grains are viewed from a direction perpendicular to the main plane, grain side faces and site on each side) of host tabular grains.

When it is intended to form the silver salt epitaxy, it is preferred that the formation be effected on selected sites of host tabular grain surfaces with intra-granular and inter-granular homogeneity.

As the specific silver salt epitaxy site-directing method, there can be mentioned, for example, the method of loading host grains with silver iodide, and the method of causing host grains to adsorb a spectral sensitizing dye (for example, a cyanine dye) or an aminoazaindene (for example, adenine) before the formation of silver salt epitaxy as described in U.S. Pat. No. 4,435,501. These methods may be employed.

Further, before the formation of silver salt epitaxy, iodide ions may be added and deposited on host grains.

Of these site-directing methods, an appropriate one may be selected according to given occasion, or a plurality thereof may be used in combination.

When the silver salt epitaxy is formed, the ratio of silver salt epitaxy occupancy to the surface area of host tabular grains is preferably in the range of 1 to 50%, more preferably 2 to 40%, and most preferably 3 to 30%.

When the silver salt epitaxy is formed, the ratio of the silver quantity of silver salt epitaxy to the total silver quantity of silver halide tabular grains is preferably in the range of 0.3 to 50 mol %, more preferably 0.3 to 25 mol %, and most preferably 0.5 to 15 mol %.

The composition of silver salt epitaxy can be selected so as to conform to given occasion. Although use can be made of a silver halide containing any of chloride ion, bromide ion and iodide ion, it is preferred that the silver salt epitaxy be constituted of a silver halide containing at least chloride ion.

When the silver salt epitaxy is formed, a preferable silver halide epitaxy is an epitaxy containing silver chloride. An epitaxy formation from silver chloride is easy because silver chloride forms the same face-centered cubic lattice structure as constituted by silver bromide or silver iodobromide as a constituent of host tabular grains. However, there is a difference between lattice spacings formed by two types of silver halides, which difference leads to such an epitaxy joining as will contribute to an enhancement of photographic sensitivity.

The silver chloride content of silver halide epitaxy is preferably at least 10 mol %, more preferably at least 15 mol %, and most preferably at least 20 mol %, higher than that of host tabular grains.

When the difference between these silver chloride contents is less than 10 mol %, it is unfavorably difficult to attain the effect of the present invention.

Introducing iodide ions in the silver halide epitaxy is preferred for sensitivity enhancement.

When the silver halide epitaxy is formed, the ratio of the quantity of silver contained in the form of silver iodide in silver halide epitaxy to the total silver quantity of silver halide epitaxy is preferably at least 1 mol %, more preferably 1.5 mol % or more.

In the introduction of halide ions in the silver halide epitaxy, it is preferred that, for increasing the introduction amount thereof, halide ions be introduced in sequence conforming to the composition of epitaxy.

For example, when it is intended to form an epitaxy wherein silver chloride is much contained in an inner part, silver bromide in an intermediate part and silver iodide in an outer part, chloride ions, bromide ions and iodide ions are sequentially added in the form of halides, so that the solubility of silver halide containing added halide ions is rendered lower than that of other silver halides to thereby deposit that silver halide with the result that a layer enriched in that silver halide is formed.

Silver salts other than silver halides, such as silver rhodanate, silver sulfide, silver selenide, silver carbonate, silver phosphate and organic acid silver salts, may be contained in the silver salt epitaxy.

The formation of silver salt epitaxy can be accomplished by various methods, for example, the method of adding halide ions, the method of adding an aqueous solution of silver nitrate and an aqueous solution of halide according to the double jet technique and the method of adding silver halide fine grains. Of these methods, an appropriate one may be selected according to given occasion, or a plurality thereof may be used in combination.

In the formation of silver salt epitaxy, the temperature, pH and pAg of system, the type and concentration of protective colloid agent such as gelatin, the presence or absence, type and concentration of silver halide solvent, etc. can widely be varied.

Silver halide tabular grain emulsions having a silver salt epitaxy formed on host tabular grain surfaces are recently disclosed in, for example, EP Nos. 0699944A, 0701165A, 0701164A, 0699945A, 0699948A, 0699946A, 0699949A, 0699951A, 0699950A and 0699947A, U.S. Pat. Nos. 5,503,971, 5,503,970 and 5,494,789 and JP-A's 8-101476, 8-101475, 8-101473, 8-101472, 8-101474 and 8-69069. Grain forming methods described in these references can be employed in the present invention.

With respect to epitaxial silver halide grains, for the retention of the configuration of host tabular grains or for the site directing of silver salt epitaxy onto grain edge/corner portions, it is preferred that the silver iodide content of outer regions (portions where final deposition occurs, forming grain edge/corner portions) of host tabular grains be at least 1 mol % higher than that of central regions thereof.

In that instance, the silver iodide content of outer regions is preferably in the range of 1 to 20 mol %, more preferably 5 to 15 mol %. When the silver iodide content is less than 1 mol %, it is difficult to attain the above effect. On the other hand, when the silver iodide content exceeds 20 mol %, the development velocity is unfavorably retarded.

Further, in that instance, the ratio of the total silver quantity contained in outer regions containing silver iodide to the total silver quantity contained in host tabular grains is preferably in the range of 10 to 30%, more preferably 10 to 25%. When the ratio is less than 10% or exceeds 30%, it is unfavorably difficult to attain the above effect.

Still further, in that instance, the silver iodide content of central regions is preferably in the range of 0 to 10 mol %, more preferably 1 to 8 mol %, and most preferably 1 to 6 mol %. When the silver iodide content exceeds 10 mol %, the development velocity is unfavorably retarded.

As tellurium sensitizers for use in the present invention, it is preferable to use compounds described in, e.g., U.S. Pat. Nos. 1,623,499, 3,320,069, and 3,772,031, British Patents 235,211, 1,121,496, 1,295,462, and 1,396,696, Canadian Patent 800,958, J. Chem. Soc. Chem. Commun. 635 (1980), ibid 1102 (1979), ibid 645 (1979), and J. Chem. Soc. Perkin Trans. 1, 2191 (1980).

As a specific tellurium sensitization method, a method described in JP-A-5-241267 can be used.

Examples of tellurium sensitizers are colloidal tellurium, telluroureas (e.g., allyltellurourea, N,N-dimethyltellurourea, tetramethyltellurourea, N-carboxyethyl-N',N'-dimethyltellurourea, N,N'-dimethylethylenetellurourea, and N,N'-diphenylethylenetellurourea), isotellurocyanates (e.g., allylisotellurocyanate), telluroketones (e.g., telluroacetone and telluroacetophenone), telluroamides (e.g., telluroacetamide and N,N-dimethyltellurobenzamide), tellurohydrazide (e.g., N,N',N'-trimethyltellurobenzhydrazide), telluroester (e.g., t-butyl-t-hexyltelluroester), phosphinetellurides (e.g., tributylphosphinetelluride, tricyclohexylphosphinetelluride, triisopropylphosphinetelluride, butyldiisopropylphosphinetelluride, and dibutylphenylphosphinetelluride), and other tellurium compounds (e.g., negative-charge, telluride ion containing gelatin described in British Patent 1,295,462, potassium telluride, potassium tellurocyanate, telluropentathionate sodium salt, and allyltellurocyanate).

Specific examples of conventionally known tellurium sensitizers are colloidal tellurium and potassium telluride described in Canadian Patent 800,958. These tellurium sensitizers have a higher ultimate sensitivity than in sulfur sensitization widely performed in this field of the art. However, colloidal tellurium is prepared using a strong reducing agent such as stannous chloride, and this reducing agent remains or slightly changes preparation conditions. This makes it difficult to form a sensitizer having good reproduction. Potassium telluride is unstable and difficult to handle and has poor reproduction. Accordingly, it is undesirable to use these tellurium sensitizers in the present invention. Of the aforementioned tellurium sensitizers, compounds represented by formulas (I) and (II) described in JP-A-5-241267 can be preferably used.

To achieve high sensitivity and high sharpness in rapid processing or heat development, it is effective to have the silver density during development increased. For this purpose, the combined use of the technique of adjusting the refractive index of a binder is found to be very effective.

A practical method of using fine inorganic grains having a refractive index of 1.62 to 3.30 with respect to light having a wavelength of 500 nm is described in detail in JP-A-2000-34733. This method can be favorably used in the present invention.

(I) Method of Raising the Refractive Index of a Dispersing Medium Layer

A method of raising the refractive index of a dispersing medium layer to suppress light reflectance, thereby further improving sensitivity and image quality, will be explained below.

(I-1) Mixing of Fine High-refractive-index Inorganic Grains

In a color light-sensitive material, one or more AgX emulsion layers of blue-, green-, and red-sensitive emulsion layers contain one or more types, preferably one to twenty types, and more preferably two to ten types of the fine, high-refractive-index inorganic grains. The optical density ($cm^{-1}$) to visible light (1) of the dispersing medium layer containing the fine grains, in an embodiment of a light-sensitive material used in the invention, from which only the photosensitive AgX emulsion grains are eliminated, is preferably 0 to $10^3$, more preferably 0 to 100, further preferably 0 to 10, and most preferably 0 to 1.0. Visible light (1) is blue, green, or red light for a blue-sensitivity layer, green or red light for a green-sensitive layer, and red light for a red-sensitive layer. Blue light means light having a wavelength of 430 to 500 nm, preferably 400 to 500 nm; green light means light having a wavelength of 501 to 590 nm; and red light means light having a wavelength of 591 to 670 nm, preferably 591 to 730 nm. The optical density is the value of $b_4$ in equation (a-3):

$$I=I_o exp(-b_4 x_1) \quad \text{(a-3)}$$

wherein, $I_o$ is the optical intensity of incident light, I is the optical intensity of transmitted light from a substance to be measured, and $x_1$ is the thickness (cm) of the substance.

The optical density is based upon intrinsic light absorption and light scattering of the fine grains. The light scattering density is preferably small. The optical density by light scattering alone is preferably 0 to $10^3$, more preferably 0 to $10^2$, further preferably 0 to 10, and most preferably 0 to 1.0. To decrease the scattering density, the equivalent-sphere diameter (the diameter of a sphere having the same volume as a grain) of a fine grain need only be set in a region where no Mie scattering occurs. Letting $\lambda_1$ be the wavelength of light, the equivalent-sphere diameter of $10^{-3}\lambda_1$ to $0.5\lambda_1$ is preferred, $10^{-3}\lambda_1$ to $0.2\lambda_1$ is more preferred, and $10^{-3}\lambda_1$ to $0.05\lambda_1$ is most preferred. Commonly, $10^{-3}$ to 0.20 $\mu$m is preferred, $10^{-3}$ to 0.10 $\mu$m is more preferred, and $10^{-3}$ to 0.05 $\mu$m is much more preferred.

In the present invention, "substantially transparent" means that the optical density is 0.1 or less with respect to the light at which the sensitivity is maximum.

The fine grains are favorably present in the dispersing medium layer as they are not substantially in a coagglomerated state. That is, (the total number of primary fine grains in seven or more, preferably four or more, and more preferably two or more coagglomerated grains/the total number of all primary fine grains)=$A_7$ is 0 to 0.20, preferably 0 to 0.05, more preferably 0.0 to 0.01, and most preferably 0.0 to 0.001. Coagglomerated grains (secondary grains) are formed by contact coagglomeration and have a constricted portion in a coagglomerated portion. The junction sectional area of this constricted portion is 1 to 85%, preferably 3 to 70%, and more preferably 6 to 50% of the section of a central portion of a primary fine grain parallel to the junction section.

If the fine grains dissolve in a processing solution like fine AgX grains during development (including bleaching, fixing, and washing) and are thereby removed from a light-sensitive material, they need only have the above characteristics during exposure to light. However, if the fine grains are not removed during development, these fine grains remain in an image of a light-sensitive material. When the image is observed by irradiation with visible light, the quality of the color image lowers if the fine grains have optical density to visible light. If this is the case, therefore, the optical density to visible light (2) of the fine grains in any of blue-, green-, and red-sensitive layers is preferably 0 to $10^3$, more preferably 0 to $10^2$, further preferably 0 to 10, and most preferably 0 to 1.0. Visible light (2) is light having a wavelength of 480 to 600 nm, preferably 420 to 700 nm, and more preferably 390 to 750 nm.

The fine grains are necessary during exposure to light and unnecessary after development. Hence, the former mode in which the fine grains are removed from an image during development is more favored. In image transfer photographic system, an image is transferred onto an image-receiving layer during development, so no fine grains transfers into the image thus received. This method is more preferred because the fine grains are removed from images even if they do not dissolve in a processing solution.

The fine grain can be crystalline, amorphous, or a mixture of both. The fine grain can also be a mixture of a crystal phase and amorphous phase. A conductive solid generally has high conduction electron density and hence absorbs visible light, so the absorbance to visible light is large. A nonconductive solid has low conduction electron density, so its absorbance to visible light is small. Accordingly, the latter material, particularly an insulator is preferably used. The specific resistance ($\Omega$·cm) is preferably $10^{-2}$ or more, more preferably 1.0 to $10^{23}$, further preferably $10^3$ to $10^{23}$, and most preferably $10^6$ to $10^{23}$, at 25° C. In its energy band structure, light absorption of an insulator is principally based on band-to-band transition from the filled band to the conduction band. In order for the fine grain to be transparent to visible light, (its forbidden band width>visible light energy) is necessary. Therefore, the fine grain preferably satisfies the above mentioned relationships for visible light (1) and visible light (2) in the individual forms.

The forbidden band width of a fine grain transparent to visible light (2) is preferably 2.8 to 30 eV, and more preferably 3.0 to 20 eV.

Examples of the structure of the fine grain are as follows. 1) An entire grain has a uniform composition. 2) A (core/shell) grain composed of a core portion and shell portion having different element compositions. In this structure, letting $n_1$ be the refractive index of the core portion and $n_2$ be that of the shell portion, ($n_1-n_2$) of favorably 0.01 to 1.0 and more favorably 0.10 to 0.70 is preferred to ($n_1<n_2$), as the refractive indices to the same visible-wavelength light. This structure is favorable because it has the effect of decreasing a large difference in the refractive index, produced by direct contact of the core portion having a high refractive index and the dispersing medium having a low refractive index, by the intervention of the shell portion having a medium refractive index, thereby preventing easy occurrence of light scattering. 3) A grain in which the shell portion has a multilayered structure including two to ten layers differing in element composition. In this structure, the refractive index of each layer can be freely chosen. However, the refractive index preferably gradually decreases in a direction from the core portion to the outermost layer. This further eliminates the abrupt difference between the refractive indices.

When a grain contains $TiO_2$ as its main component, the surface of this grain is preferably covered with one or more types of metal oxide whose $TiO_2$ content (mol %) is lower by 10 to 100, preferably 50 to 100. Examples of the oxides are those to be described in (II-1) below, and one or more types of oxides of Al, Si, Zr, Sb, Sn, Zn, and Pb are more favored. Practical examples are $SnO_2$, $Al_2O_3$, $SiO_2$, and ($TiO_2$ and their co-precipitates).

The fine grain may or may not adsorb a sensitizing dye or a dye. When the fine grain adsorbs a sensitizing dye or a dye, this fine grain absorbs scattered light and suppresses image blur caused by scattered light. For example, in a portion irradiated with intense light, (scattered light amount $I_1$=incident light amount $I_o$×scattering coefficient $b_5$), and $I_1$ increases even though $b_5$ is small. This suppresses image blur. In a case like this, the adsorption amount of the sensitizing dye or the dye is preferably 20 to 100 mol %, and more preferably 40 to 90 mol % of the saturated adsorption amount. When the fine grain is an AgX grain, this fine grain may be sensitive to light to help increase the image density, or may not be sensitive to light to make no contribution. In the former case, this AgX grain is desirably chemically sensitized.

When the fine grain does not adsorb a sensitizing dye or a dye, the adsorption amount of the sensitizing dye or the dye is 0 to 19.9 mol %, preferably 0 to 3.0 mol %. To increase the sensitivity, the form in which the fine grain does not absorb sensitive wavelength light is favored, and the form in which the fine grain does not adsorb a sensitizing dye or a dye is more favored.

When the grain diameter is 20 nm or less, preferably 10 nm or less, the intrinsic absorption edge of the fine inorganic grain shifts to shorter wavelengths as the diameter decreases. This improves the transparency to blue sensitive light of particularly rutile titanium oxide. Also, when intrinsic light absorption occurs, the probability of recombination between the generated electrons and holes increases. This characteristic is favorable to the present invention. Hence, adjusting the diameter to be equal to or smaller than this size is particularly preferable in this respect.

The fine grains can be mixed in each AgX emulsion layer by the following methods. A spectral sensitizing dye for a corresponding photosensitive layer is added to an AgX emulsion solution. After 50 to 100%, preferably 80 to 100%, and more preferably 90 to 100% of the sensitizing dye are adsorbed on the AgX grains, the fine grains are added. A chemical sensitizer is added to an AgX emulsion solution, and the fine grains are mixed after 50 to 100%, preferably 90 to 100% of the chemical sensitizer complete the reaction.

A photographic additive is dissolved in an organic oil, and the resultant oil is dispersed by emulsification as oil droplets in an aqueous gelatin solution. Before or after this emulsion is mixed in an AgX emulsion, the fine grains can be added to the AgX emulsion.

The total addition amount of the fine inorganic grains contained in a unit volume of the dispersiny medium phase of the light-sensitive material is 1.0 to 95 wt %, preferably 2 to 60 wt %, and more preferably 5 to 50 wt %.

To prevent the fine grains from dissolving and changing with time, a modification preventing adsorbent is preferably adsorbed.

(I-2) Mixing of High-Refractive-Index Organic Compound

The refractive index of a dispersing medium layer can be slightly raised by mixing in this dispersing medium layer an organic compound having a refractive index of 1.62 or more with respect to light having a wavelength of 500 nm. This organic compound is an iodide or bromide, and examples are diiodomethane, 1-iodonaphthalene, 1-bromonaphthalene, 1,1,2,2-tetrabromoethane, and 1-chloronaphthalene. Other examples are isoquinoline and quinoline. However, almost no organic compound has a refractive index exceeding 1.80, so it is difficult to completely suppress light scattering by this organic compound alone.

The total addition amount of the high-refractive-index organic compound contained in a unit volume of the dispersing medium of the light-sensitive material is preferably 2 to 60 wt %, more preferably 5 to 50 wt %.

(I-3) Relationship Between Mixing Amount of Fine Grains and Refractive Index

The concept of increasing the refractive index of a dispersing medium layer by mixing the fine high-refractive-index grains in the dispersing medium layer is as follows. Commonly, the following law (molecular refractivity=sum of atomic refractivities of constituent atoms of a molecule) holds for a saturated hydrocarbon-based compound. Since, however, molecular refractivity changes in accordance with the form of connection of atoms, (molecular refractivity =sum of refractivities of constituent atomic groups or electron groups of a molecule) holds more precisely for a larger number of compounds. That is, molecules can be regarded as saturated aggregates of various atomic groups. When this idea is extensively applied to mixed aggregates of a diverse variety of fine grains, "the unit refractivity per unit volume of a substance is the total sum of (fine grain refractivities× fine grain volumes) of individual fine grains constructing the unit volume" holds. "Fine grain refractivity" means the refractive index of a substance whose unit volume is occupied only by one type of fine grains. "Fine grain volume" means (volume occupied by one fine grain/unit volume). A continuous medium layer such as a dispersing medium layer can be regarded as being densely filled with cubic fine grains with no void. A spherical grain filled body can be considered to be a substance in which grains having refractive index= 1.0 exist in void.

When a substance is a multicomponent system including many components, the following equation approximately holds in many cases:

$$100r=c_1r_1+c_2r_2+\ldots+c_nr_n \quad \text{(a-4)}$$

wherein r is the specific refractivity of the substance, each of $c_1$, $c_2$, . . . , and $c_n$ (%) is the weight % of the individual components, and each of $r_1$, $r_2$, . . . , and $r_n$ is the specific refractivities of the individual components. When, however, the interaction between the components changes the state of outermost electrons of the component atoms, the relationship shifts in accordance with the change by the additive property law.

The relationship between the mixing amount and refractive index of the fine grains can be estimated by equation (a-4). Note that specific refractivity=$R_o$/M, (wherein $R_o$ is molar refractivity, and M is molecular weight) and the following relationship holds:

$$(n_3^2-1)/(n_3^2+2)=R_o\cdot n_o/M \quad \text{(a-5)}$$

wherein $n_3$ is the refractive index of the substance, and $n_o$ is the specific gravity of the substance.

(II-1) Oxides

Oxides of group Ia to VIb elements, preferably group IIIa-IVb elements of the second to seventh periods of long periods in the periodic table of elements. Oxides can be an oxide of a single element, an oxide of two or more elements, and a mixture of two or more oxides. Oxides are particularly preferably oxides containing Ti, Sn, Zn, Al, Pb, Ba, In, Si, Sb, As, Ge, Te, La, Zr, W, Ta, Th, and Nb as main components, and more preferably oxides containing Ti, Sn, Zn, Al, and Si as main components. A main component is a component whose (total number of atoms of main component element/total number of atoms of elements except for oxygen and hydrogen atoms)=$A_{33}$ is a maximum in the substance. $A_{33}$ is preferably 0.60 to 1.0 and more preferably 0.80 to 1.0.

Practical examples of the oxides will be explained below.

(II-1-1)

Oxides Containing Ti as Main Component

Oxides containing Ti as a main component in the definition of $A_{33}$. The composition of an oxide having $A_{33}$=0.95 to 1.0, preferably 0.98 to 1.0 is represented by [$TiO_2.mH_2O$] for convenience. In this representation, m=0 to 3.0, preferably 0.05 to 2.0.

Examples of the grain structure are an amorphous structure, a crystalline structure, and a mixed structure of the two. Examples of the crystalline structure are rutile, anatase, and brookite crystals. An optimum one or an optimum mixture can be selected in accordance with the intended use. In the anatase crystal, the dependence of the refractive index on the crystallographic axis is small, so the refractive index is uniform in all directions of the crystal. Accordingly, the anatase crystal is preferred in that the refractive index of the dispersing medium layer can be controlled more uniformly.

The rutile crystal has higher refractive indices to the visible lights (1) and (2) than the anatase crystal. Therefore, the rutile crystal is favored in that the refractive index of the dispersing medium can be increased with the same fine grain addition amount. However, the dependence of the refractive index on the crystallographic axis is large. Therefore, the rutile crystal has the drawback that it has intrinsic absorption up to near 410 nm and hence absorbs a portion of blue light.

In the amorphous body, the crystal lattice is already disturbed. Therefore, the amorphous body can be readily pulverized into fine grains. With respect to light having a wavelength of 550 nm, the refractive indices are approximately [rutile crystal (2.65, 2.95)>anatase crystal (2.59, 2.51)>amorphous body (≈2.1)]; the refractive index of the amorphous body is smallest. (2.65, 2.95) indicates that the refractive index to light perpendicular to the crystallographic axis is 2.65, and the refractive index to light parallel to the crystallographic axis is 2.95.

Artificial synthetic products of titanium oxide (rutile and anatase type) grains are industrially principally manufactured by a sulfuric acid method or a chlorine method. Titamiumoxide hydrate is in many cases synthesized by hydrolysis of a titanium sulfate solution, titanium chloride solution, and titanium alkoxide solution.

(II-1-2) Double Oxides

Oxides containing two or more types of metals are usually generically called double oxides.

Examples of the double oxide are a spinel-type oxide [e.g., $MgAl_2O_4$], a ilmenite-type structure, a perovskite-type structure, and a structure in which metals of the same kind coexist with two or more different oxidation numbers [e.g., $Fe^{II}Fe^{III}{}_2O_4$ and $Pb^{IV}Pb^{II}{}_2O_4$], [$MTiO_3$, wherein M=Mn, Fe, Co, Ni, Cd, Mg, Ca, Sr, Ba, or Pb], [$MNbO_3$, wherein M=Li, Na, or K], and [$MZrO_3$, wherein M=Ca, Sr, Ba, Cd, or Pb]. Preferred examples are titanate and zirconates (e.g., those having $Pb^{II}$ as a counter ion), specifically, strontium titanate, lead titanate, and barium titanate.

(II-1-3) Glass

Generally, a melted liquid solidifies into a crystal at a predetermined temperature when cooled. However, a certain type of a substance does not solidify into a crystal but gradually increases its viscosity and finally turns into a solid matter. A non-crystalline solid like this is generally called a glass state, and an inorganic matter in this state is called glass. Inorganic matters which can take this glass state are chalcogen element substances such as selenium and sulfur; oxides and oxide salts of silicon, boron, phosphorus, and germanium; and chalcogenide glass such as sulfide and selenide. In the present invention, glass having a high refractive index is used.

1) Silicate glass containing oxidized silicon as a main component. A substance in the glass state only with $SiO_2$ is called quartz glass. When an oxide of boron (e.g., $B_2O_3$) is added to this glass, the glass is called borosilicate glass. Oxides of other metals described in item (II-1) above are added to this glass to modify the characteristics of the glass. Additive property presumably holds between many properties (e.g., refractive index, specific gravity, and expansion coefficient) of glass and its components. In many instances, alkaline metals, alkaline earth metals, and group IIIB elements in the periodic table are used as these metals.

Generally, as the molecular refractivity of a constituent molecule of a substance increases, or as the molecular volume of the molecule decreases, the refractive index of the substance increases, as in equation (a-4). The molecular refractivity increases as the polarizability of constituent atoms or atomic groups of the molecule increases. This polarizability increases as the ion radius or valence of a cation atom increases. Accordingly, when oxides of metal elements having atomic numbers 20 to 90, preferably 45 to 85 are added, the refractive index of the glass produced increases. Practical examples are oxides of Ba, Pb, and lanthanoide elements. A large valence of $Ti^{4+}$ of oxides of Ti makes a contribution.

A fine silicon oxide can be prepared on the basis of the manufacturing method of colloidal silica. That is, a fine-grain suspension containing $SiO_2$ as a main component can be obtained by thermally ripening an aqueous solution containing sodium silicate as a main component. This suspension has a hydroxyl group on the surface, and the composition of the suspension is represented by ($SiO_2.mH_2O$).

2) Others. Lead glass (silicate glass containing 3.0 to 60 mol %, preferably 10 to 60 mol % of PbO), aluminosilicate glass (silicate glass or aminoborosilicate glass containing 3.0 to 30 mol % of $Al_2O_3$), phosphate glass (containing preferably 30 to 100 mol % of $P_2O_5$ as a main component), borate glass (glass containing $B_2O_3$ as a main component), germanate glass, tungstate glass, and molybdate glass. Optical material glass having a refractive index of 1.45 to 2.0 with respect to the D line of Na is obtained. Details of the glass including this one are described in Cyclopedia of Glass, Asakura Shoten (1985).

(II-1-4) Other Oxides

Examples are zinc oxide and white lead.

(I-4) Method of Measuring Refractive Index of Dispersing Medium Layer

Examples of the method are as follows.

1) A dispersing medium, water, high-refractive-index substance, coloring agent emulsion, and the like are used to prepare a dispersing medium solution having the same composition as above except that no AgX tabular grains exist. This dispersing medium solution is concentrated and dried, and the refractive index of the dried product is measured.

2) When the element composition of a dispersing medium layer of a light-sensitive material is obtained, the refractive index can be approximately calculated by using the law described in item (I-3).

3) A light-sensitive material is cut perpendicularly to its main plane, and the micro-reflectance of a sectional portion where only the dispersing medium layer exists is measured. The refractive index is calculated from the measured value.

The refractive index of the fine grains can also be calculated by using this measurement result and the relationship described in item (I-3).

Examples of the refractive index measurement method are a method based on the law of refraction and a method using an interference phenomenon.

A lightsensitive silver halide emulsion comprising tabular silver halide grains having a sensitizing dye adsorbed thereon so that the spectral absorption maximum wavelength is less than 500 nm while the light absorption intensity is 60 or more or so that the spectral absorption maximum wavelength is 500 nm or more while the light absorption intensity is 100 or more, preferably employed in the present invention, will now be described.

In the present invention, the light absorption intensity refers to a light absorption area intensity per grain surface area realized by a sensitizing dye. It is defined as an integral value, over wave number ($cm^{-1}$), of optical density Log(Io/(Io−I)), wherein Io represents the quantity of light incident on each unit surface area of grains and I represents the quantity of light absorbed by the sensitizing dye on the surface. The range of integration is from 5000 $cm^{-1}$ to 35,000 $cm^{-1}$.

With respect to the silver halide photographic emulsion of the present invention, it is preferred that tabular silver halide grains of 60 or more light absorption intensity in the use of grains of less than 500 nm spectral absorption maximum wavelength, or tabular silver halide grains of 100 or more light absorption intensity in the use of grains of 500 nm or more spectral absorption maximum wavelength, occupy 50% or more of the total projected area of silver halide grains. With respect to the grains of 500 nm or more spectral absorption maximum wavelength, the light absorption intensity is preferably 150 or more, more preferably 170 or more, and most preferably 200 or more. With respect to the grains of less than 500 nm spectral absorption maximum wavelength, the light absorption intensity is preferably 90 or more, more preferably 100 or more, and most preferably 120 or more. In both instances, although there is no particular upper limit, the light absorption intensity is preferably up to 2000, more preferably up to 1000, and most preferably up to 500. With respect to the grains of less than 500 nm spectral absorption maximum wavelength, the spectral absorption maximum wavelength is preferably 350 nm or more.

As one method of measuring the light absorption intensity, there can be mentioned the method of using a microscopic spectrophotometer. The microscopic spectrophotometer is a device capable of measuring an absorption spectrum of minute area, whereby a transmission spectrum of each grain can be measured. With respect to the measurement of an absorption spectrum of each grain by the microscopic spectrophotometry, reference can be made to the report of Yamashita et al. (page 15 of Abstracts of Papers presented before the 1996 Annual Meeting of the Society of Photographic Science and Technology of Japan). The absorption intensity per grain can be determined from the absorption spectrum. Because the light transmitted through grains is absorbed by two surfaces, i.e., upper surface and lower surface, however, the absorption intensity per grain surface area can be determined as ½ of the absorption intensity per grain obtained in the above manner. At that time, although the interval for absorption spectrum integration is from 5000 $cm^{-1}$ to 35,000 $cm^{-1}$ in view of the definition of light absorption intensity, experimentally, it is satisfactory to integrate over an interval including about 500 $cm^{-1}$ after and before the interval of absorption by sensitizing dye.

Apart from the microscopic spectrophotometry, the method of arranging grains in such a manner that the grains are not piled one upon another and measuring a transmission spectrum is also practical.

The light absorption intensity is a value unequivocally determined from the oscillator strength and number of adsorbed molecules per area with respect to the sensitizing dye. If, with respect to the sensitizing dye, the oscillator strength, dye adsorption amount and grain surface area are measured, these can be converted into the light absorption intensity.

The oscillator strength of sensitizing dye can be experimentally determined as a value proportional to the absorption area intensity (optical density×$cm^{-1}$) of sensitizing dye solution, so that the light absorption intensity can be calculated within an error of about 10% by the formula:

$$\text{light absorption intensity} \approx 0.156 \times A \times B/C$$

wherein A represents the absorption area intensity per M of dye (optical density×$cm^{-1}$), B represents the adsorption amount of sensitizing dye (mol/molAg) and C represents the grain surface area C ($m^2$/molAg).

Calculation of the light absorption intensity through this formula gives substantially the same value as the integral value, over wave number ($cm^{-1}$), of light absorption intensity (Log(Io/(Io−I))) measured in accordance with the aforementioned definition.

For increasing the light absorption intensity, there can be employed any of the method of adsorbing more than one layer of dye chromophore on grain surfaces, the method of increasing the molecular absorption coefficient of dye and the method of decreasing a dye-occupied area. Of these, the method of adsorbing more than one layer of dye chromophore on grain surfaces (multi-layer adsorption of sensitizing dye) is preferred.

The expression "adsorption of more than one layer of dye chromophore on grain surfaces" used herein means the presence of more than one layer of dye bound in the vicinity of silver halide grains. Thus, it is meant that dye present in a dispersion medium is not contained. Even if a dye chromophore is connected with a substance adsorbed on grain surfaces through a covalent bond, when the connecting group is so long that the dye chromophore is present in the dispersion medium, the effect of increasing the light absorption intensity is slight and hence it is not regarded as the more than one layer adsorption. Further, in the so-called multi-layer adsorption wherein more than one layer of dye chromophore is adsorbed on grain surfaces, it is required that a spectral sensitization be brought about by a dye not directly adsorbed on grain surfaces. For meeting this requirement, the transfer of excitation energy from the dye not directly adsorbed on silver halide to the dye directly adsorbed on grains is inevitable. Therefore, when the transfer of excitation energy must occur in more than 10 stages, the final transfer efficiency of excitation energy will unfavorably be low. As an example thereof, there can be mentioned such a case that, as experienced in the use of polymer dyes of, for example, JP-A-2-113239, most of dye chromophore is present in a dispersion medium, so that more than 10 stages are needed for the transfer of excitation energy. In the present invention, it is preferred that the number of excitation energy transfer stages per molecule range from 1 to 3.

The terminology "chromophore" used herein means an atomic group which is the main cause of molecular absorption bands as described on pages 985 and 986 of Physicochemical Dictionary (4th edition, published by Iwanami Shoten, Publishers in 1987), for example, any atomic group selected from among C═C, N═N and other atomic groups having unsaturated bonds.

Examples thereof include a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye, an azamethine dye, a coumarin dye, an allylidene dye, an anthraquinone dye, a triphenylmethane dye, an azo dye, an azomethine dye, a spiro compound, a metallocene dye, a fluorenone dye, a fulgide dye, a perillene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperillene dye, a porphyrin dye, a chlorophyll dye, a phthalocyanine dye and a metal complex dye. Of these, there can preferably be employed polymethine chromophores such as a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye and an azamethine dye. More preferred are a cyanine dye, a merocyanine dye, a trinuclear merocyanine dye, a tetranuclear merocyanine dye and a rhodacyanine dye. Most preferred are a cyanine dye, a merocyanine dye and a rhodacyanine dye. A cyanine dye is optimally employed.

Details of these dyes are described in, for example, F. M. Harmer, "Heterocyclic Compounds-Cyanine Dyes and Related Compounds", John Wiley & Sons, New York, London, 1964 and D. M. Sturmer, "Heterocyclic Compounds-Special topics in heterocyclic chemistry", chapter 18, section 14, pages 482 to 515, John Wiley & Sons, New York, London, 1977. With respect to the general formulae for the cyanine dye, merocyanine dye and rhodacyanine dye, those shown in U.S. Pat. No. 5,340,694, columns 21 to 22, (XI), (XII) and (XIII), are preferred. In the formulae, the numbers n12, n15, n17 and n18 are not limited as long as each of these is an integer of 0 or greater (preferably, 4 or less).

The adsorption of a dye chromophore on silver halide grains is preferably carried out in at least 1.5 layers, more preferably at least 1.7 layers, and most preferably at least 2 layers. Although there is no particular upper limit, the number of layers is preferably 10 or less, more preferably 5 or less.

The expression "adsorption of more than one layer of chromophore on silver halide grain surfaces" used herein means that the adsorption amount of dye chromophore per area is greater than a one-layer saturated coating amount, this one-layer saturated coating amount defined as the saturated adsorption amount per area attained by a dye which exhibits the smallest dye-occupied area on silver halide grain surfaces among the sensitizing dyes added to the emulsion. The number of adsorption layers means the adsorption amount evaluated on the basis of one-layer saturated coating amount. With respect to dyes having dye chromophores connected to each other by covalent bonds, the dye-occupied area of unconnected individual dyes can be employed as the basis.

The dye-occupied area can be determined from an adsorption isothermal line showing the relationship between free dye concentration and adsorbed dye amount, and a grain surface area. The adsorption isothermal line can be determined with reference to, for example, A. Herz et al. "Adsorption from Aqueous Solution", Advances in Chemistry Series, No. 17, page 173 (1968).

The adsorption amount of a sensitizing dye onto emulsion grains can be determined by two methods. The one method comprises centrifuging an emulsion having undergone a dye adsorption to thereby separate the emulsion into emulsion grains and a supernatant aqueous solution of gelatin, determining an unadsorbed dye concentration from the measurement of spectral absorption of the supernatant, and subtracting the same from the added dye amount to thereby determine the adsorbed dye amount. The other method comprises depositing emulsion grains, drying the same, dissolving a given weight of the deposit in a 1:1 mixture of an aqueous solution of sodium thiosulfate and methanol, and effecting a spectral absorption measurement thereof to thereby determine the adsorbed dye amount. When a plurality of sensitizing dyes are employed, the absorption amount of each dye can be determined by high-performance liquid chromatography or other techniques. With respect to the method of determining the dye absorption amount by measuring the dye amount in a supernatant, reference can be made to, for example, W. West et al., Journal of Physical Chemistry, vol. 56, page 1054 (1952). However, even unadsorbed dye may be deposited when the addition amount of dye is large, so that an accurate absorption amount may not always be obtained by the method of measuring the dye concentration of the supernatant. On the other hand, in the method in which the absorption amount of dye is determined by dissolving deposited silver halide grains, the deposition velocity of emulsion grains is overwhelmingly faster, so that grains and deposited dye can easily be separated from each other. Thus, only the amount of dye adsorbed on grains can accurately be determined. Therefore, this method is most reliable as a means for determining the dye absorption amount.

As one method of measuring the surface area of silver halide grains, there can be employed the method wherein a transmission electron micrograph is taken according to the replica method and wherein the configuration and size of each individual grain are measured and calculated. In this method, the thickness of tabular grains is calculated from the length of shadow of the replica. With respect to the method of taking a transmission electron micrograph, reference can be made to, for example, Denshi Kenbikyo Shiryo Gijutsu Shu (Electron Microscope Specimen Technique Collection) edited by the Kanto Branch of the Society of Electron Microscope of Japan and published by Seibundo Shinkosha in 1970 and P. B. Hirsch, "Electron Microscopy of Thin Crystals", Buttwrworths, London (1965).

When a multi-layer of dye chromophore is adsorbed on silver halide grains in the present invention, although the reduction potentials and oxidation potentials of the dye chromophore of the first layer, namely the layer directly adsorbed on silver halide grains, vs. the dye chromophore of the second et seq. layers are not particularly limited, it is preferred that the reduction potential of the dye chromophore of the first layer be noble to the remainder of the reduction potential of the dye chromophore of the second et seq. layers minus 0.2V.

Although the reduction potential and oxidation potential can be measured by various methods, the measurement is preferably carried out by the use of phase discrimination second harmonic a.c. polarography, whereby accurate values can be obtained. The method of measuring potentials by the use of phase discrimination second harmonic a.c. polarography is described in Journal of Imaging Science, vol. 30, page 27 (1986).

The dye chromophore of the second et seq. layers preferably consists of a luminescent dye. With respect to the type of luminescent dye, those having the skeletal structure of dye for use in dye laser are preferred. These are edited in, for example, Mitsuo Maeda, Laser Kenkyu (Laser Research), vol. 8, pp. 694, 803 and 958 (1980) and ditto, vol. 9, page 85 (1981), and F. Sehaefer, "Dye Lasers", Springer (1973).

Moreover, the absorption maximum wavelength of dye chromophore of the first layer in the silver halide photographic lightsensitive material is preferably greater than that of dye chromophore of the second et seq. layers. Further, preferably, the light emission of dye chromophore of the second et seq. layers and the absorption of dye chromophore of the first layer overlap each other. Also, it is preferred that the dye chromophore of the first layer form a J-association product. Still further, for exhibiting absorption and spectral sensitivity within a desired wavelength range, it is preferred that the dye chromophore of the second et seq. layers also form a J-association product.

The meanings of terminologies employed in the present invention are set forth below.

Dye-occupied area: Area occupied by each molecule of dye, which can experimentally be determined from adsorption isothermal lines. With respect to dyes having dye chromophores connected to each other by covalent bonds, the dye-occupied area of unconnected individual dyes can be employed as the basis.

One-layer saturated coating amount: Dye adsorption amount per grain surface area at one-layer saturated coating, which is the inverse number of the smallest dye-occupied area exhibited by added dyes.

Multi-layer adsorption: In such a state that the adsorption amount of dye chromophore per grain surface area is greater than the one-layer saturated coating amount.

Number of adsorption layers: Adsorption amount of dye chromophore per grain surface area on the basis of one-layer saturated coating amount.

The first preferable method for realizing silver halide grains of less than 500 nm spectral absorption maximum wavelength and 60 or more light absorption intensity, or 500 nm or more spectral absorption maximum wavelength and 100 or more light absorption intensity, is any of those using the following specified dyes.

For example, there can preferably be employed the method of using a dye having an aromatic group, or using a cationic dye having an aromatic group and an anionic dye having an aromatic group in combination as described in JP-A's 10-239789, 8-269009, 10-123650 and 8-328189, the method of using a dye of polyvalent charge as described in JP-A-10-171058, the method of using a dye having a pyridinium group as described in JP-A-10-104774, the method of using a dye having a hydrophobic group as described in JP-A-10-186559, and the method of using a dye having a coordination bond group as described in JP-A-10-197980.

The method of using a dye having at least one aromatic group is most preferred. In particular, the method wherein a positively charged dye, or a dye having intra-molecularly offset charges, or a dye having no charges is used alone, and the method wherein positively and negatively charged dyes are used in combination, at least one thereof having at least one aromatic group as a substituent, are preferred.

The aromatic group will now be described in detail. The aromatic group may be a hydrocarbon aromatic group or a heteroaromatic group. Further, the aromatic group may be a group having the structure of a polycyclic condensed ring resulting from mutual condensation of hydrocarbon aromatic rings or mutual condensation of heteroaromatic rings, or a polycyclic condensed ring consisting of a combination of an aromatic hydrocarbon ring and an aromatic heterocycle. The aromatic group may have a substituent. Examples of preferred aromatic rings contained in the aromatic group include benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, quinoline, carbazole, phenanthridine, acridine, phenanthroline, thianthrene, chromene, xanthene, phenoxathiin, phenothiazine and phenazine. The above hydrocarbon aromatic rings are more preferred. Benzene and naphthalene are most preferred. Benzene is optimal.

For example, any of those aforementioned as examples of dye chromophores can be used as the dye. The dyes aforementioned as examples of polymethine dye chromophores can preferably be employed.

More preferred are a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye and an azamethine dye. Still more preferred are a cyanine dye, a merocyanine dye, a trinuclear merocyanine dye, a tetranuclear merocyanine dye and a rhodacyanine dye. Most preferred are a cyanine dye, a merocyanine dye and a rhodacyanine dye. A cyanine dye is optimal.

The following methods of using a dye (a) and (b) are preferred. Of them, the method (b) is more preferred.

(a) The method comprises using at least one of cationic, betaine and nonionic methine dyes.

(b) The method comprises using at least one cationic methine dye and at least one anionic methine dye in combination.

Although the cationic dye for use in the present invention is not particularly limited as long as the charges of dye exclusive of counter ions are cationic, it is preferred that the cationic dye be a dye having no anionic substituents. Further, although the anionic dye for use in the present invention is not particularly limited as long as the charges of dye exclusive of counter ions are anionic, it is preferred that the anionic dye be a dye having at least one anionic substituent. The betaine dye for use in the present invention is a dye which, although having charges in its molecule, forms such an intra-molecular salt that the molecule as a whole has no charges. The nonionic dye for use in the present invention is a dye having no charges at all in its molecule.

The anionic substituent refers to a substituent having a negative charge, and can be, for example, a proton-dissociable acid group, at least 90% of which is dissociated at a pH of 5 to 8. Examples of suitable anionic substituents include a sulfo group, a carboxyl group, a sulfato group, a phosphoric acid group, a boric acid group, an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl) and an alkylsulfonylsulfamoylalkyl group (e.g., methanesulfonylsulfamoylmethyl). A sulfo group and a carboxyl group are preferably employed, and a sulfo group is more preferably employed. As the cationic substituent, there can be mentioned, for example, a substituted or unsubstituted ammonium group and pyridinium group.

Although silver halide grains of less than 500 nm spectral absorption maximum wavelength and 60 or more light absorption intensity, or 500 nm or more spectral absorption maximum wavelength and 100 or more light absorption intensity, can be realized by the above preferred method, the dye of the second layer is generally adsorbed in the form of a monomer, so that most often the absorption width and spectral sensitivity width are larger than those desired. Therefore, for realizing a high sensitivity within a desired wavelength region, it is requisite that the dye adsorbed into the second layer form a J-association product. Further, the J-association product is preferred from the viewpoint of transmitting light energy absorbed by the dye of the second layer to the dye of the first layer with a proximate light absorption wavelength by the energy transfer of the Föster type, because of the high fluorescent yield and slight Stokes shift exhibited thereby.

For forming the J-association product of the dye of the second layer from a cationic dye, a betaine dye, a nonionic dye or an anionic dye, it is preferred that the addition of dye adsorbed as the first layer be separated from the addition of dye adsorbed in the formation of the second et seq. layers, and it is more preferred that the structure of the dye of the first layer be different from that of the dye of the second et seq. layers. With respect to the dye of the second et seq. layers, it is preferred that a cationic dye, a betaine dye and a nonionic dye be added individually, or a cationic dye and an anionic dye be added in combination.

The dye of the first layer, although not particularly limited, preferably consists of a cationic dye, a betaine dye, a nonionic dye or an anionic dye, more preferably a cationic dye, a betaine dye or a nonionic dye. In the second layer, it is preferred that a cationic dye, a betaine dye or a nonionic dye be used alone. When a cationic dye and an anionic dye are used in combination, which is also a preferred use in the second layer, the ratio of cationic dye to anionic dye in the dye of the second layer is preferably in the range of 0.5 to 2, more preferably 0.75 to 1.33, and most preferably 0.9 to 1.11. It is preferred that the structure of the sensitizing dye of the second layer be different from that of the sensitizing dye of the first layer, and that the sensitizing dye of the second layer contain both a cationic dye and an anionic dye.

The second preferable method for realizing silver halide grains of less than 500 nm spectral absorption maximum wavelength and 60 or more light absorption intensity, or 500 nm or more spectral absorption maximum wavelength and 100 or more light absorption intensity, comprises utilizing a dye compound (linked dye) having two or more dye chromophore portions linked to each other by a covalent bond through a linking group.

The usable dye chromophore is not particularly limited, and, for example, the aforementioned dye chromophores can be employed. The aforementioned polymethine dye chromophores are preferred. More preferred are a cyanine dye, a merocyanine dye, a rhodacyanine dye and an oxonol dye. Most preferred are a cyanine dye, a rhodacyanine dye and a merocyanine dye. A cyanine dye is optimal.

The linking group refers to a single bond or, preferably, a divalent substituent. This linking group preferably consists of an atom or atomic group including at least one member selected from among a carbon atom, a nitrogen atom, a sulfur atom and an oxygen atom. Also, the linking group preferably includes a divalent substituent having 0 to 100 carbon atoms, more preferably 1 to 20 carbon atoms, constituted of one member or a combination of at least two members selected from among an alkylene group (e.g., methylene, ethylene, propylene, butylene or pentylene), an arylene group (e.g., phenylene or naphthylene), an alkenylene group (e.g., ethenylene or propenylene), an alkynylene group (e.g., ethynylene or propynylene), an amido group, an ester group, a sulfoamido group, a sulfonic ester group, a ureido group, a sulfonyl group, a sulfinyl group, a thioether group, an ether group, a carbonyl group, —N(Va)- (Va represents a hydrogen atom or a monovalent substituent) and a heterocyclic divalent group (e.g., 6-chloro-1,3,5-triazine-2,4-diyl group, pyrimidine-2,4-diyl group or quinoxarine-2,3-diyl group). The linking group may further have a substituent, and may contain an aromatic ring or a nonaromatic hydrocarbon ring or heterocycle. As especially preferred linking groups, there can be mentioned alkylene groups each having 1 to 10 carbon atoms (e.g., methylene, ethylene, propylene and butylene), arylene groups each having 6 to 10 carbon atoms (e.g., phenylene and naphthylene), alkenylene groups each having 2 to 10 carbon atoms (e.g., ethenylene and propenylene), alkynylene groups each having 2 to 10 carbon atoms (e.g., ethynylene and propynylene), and divalent substituents each comprising one member or a combination of two or more members selected from among an ether group, an amido group, an ester group, a sulfoamido group and a sulfonic ester group and having 1 to 10 carbon atoms.

The linking group is preferably one capable of energy transfering or electron moving by through-bond interaction. The through-bond interaction includes, for example, tunnel interaction and super-exchange interaction. Especially, the through-bond interaction based on super-exchange interaction is preferred. The through-bond interaction and super-exchange interaction are as defined in Shammai Speiser, Chem. Rev., vol. 96, pp. 1960-1963, 1996. As the linking group capable of inducing an energy transfer or electron moving by such an interaction, there can preferably be employed those described in Shammai Speiser, Chem. Rev., vol. 96, pp. 1967–1969, 1996.

Preferred examples thereof include the method of using dyes linked to each other by methine chains as described in JP-A-9-265144, the method of using a dye comprising oxonol dyes linked to each other as described in JP-A-10-226758, the method of using linked dyes of specified structure as described in JP-A's 10-110107, 10-307358, 10-307359, 10-310715 and 10-204306, the method of using linked dyes of specified structure as described in JP-A's 2000-231174, 2000-231172 and 2000-231173, and the method of using a dye having a reactive group to thereby form a linked dye in the emulsion as described in JP-A-2000-81678.

Examples of especially preferably employed dyes will be listed below, to which, however, the present invention is in no way limited.

(I) Examples of Cationic Dyes and Betaine Dyes:

(I) Examples of cationic dyes and betaine dyes:
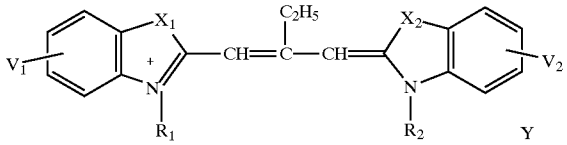
| | $X_1$ | $X_2$ | $V_1$ | $V_2$ | $R_1$ | $R_2$ | Y |
|---|---|---|---|---|---|---|---|
| D-1 | O | O | 5-Ph | 5'-Ph | 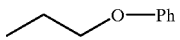 | 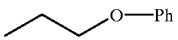 | 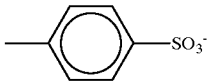 |
| D-2 | O | O | 5-Ph | 5'-Ph | 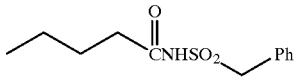 | 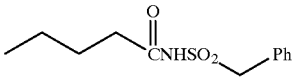 | $Br^-$ |
| D-3 | O | S | 5-Ph | 5'-Ph | 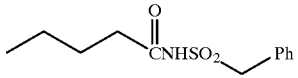 | 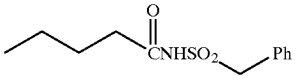 | 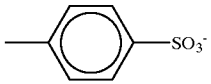 |
| D-4 | O | S | 5-Ph | 5'-Ph | 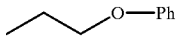 | 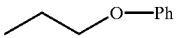 | $Br^-$ |
| D-5 | O | O | 4,5-Benzo | 4',5'-Benzo | 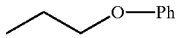 | 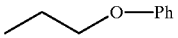 | 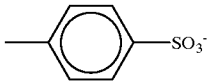 |
| D-6 | O | O | 5,6-Benzo | 5'-,6'-Benzo | 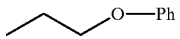 | 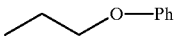 | 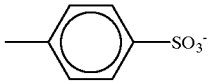 |
| D-7 | O | O | 5,6-Benzo | 5',6'-Benzo | 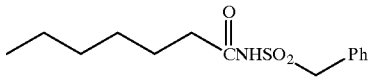 | 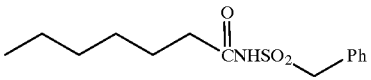 | 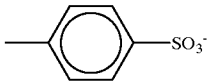 |

-continued
| | $X_1$ | $X_2$ | $V_1$ | $V_2$ | $R_1$ | $R_2$ | Y |
|---|---|---|---|---|---|---|---|
| D-8 | O | O | 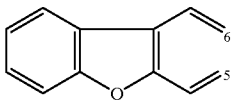 | 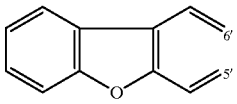 | 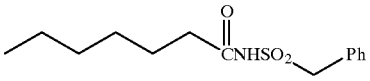 | 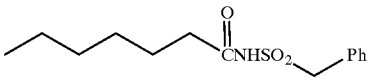 | 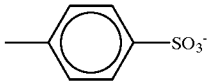 |
| D-9 | O | O | 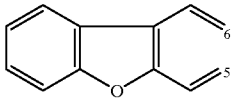 | 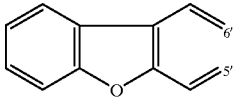 | 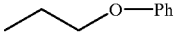 | 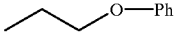 | 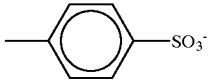 |
| D-10 | O | O | 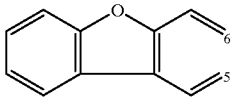 | 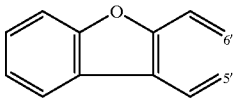 | 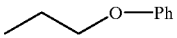 | 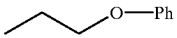 | 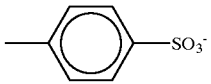 |
| D-11 | S | S | 5-Ph | 5'-Ph | 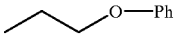 | 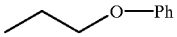 | 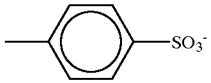 |
| D-12 | S | S | 5-Cl | 5'-Cl | 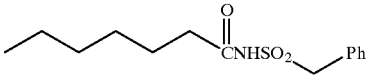 | 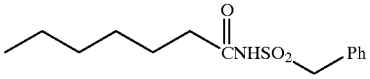 | 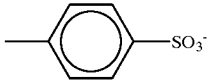 |
| D-13 | S | S | 5,6-Benzo | 5',6'-Benzo | 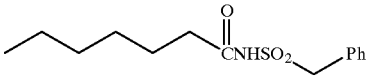 | 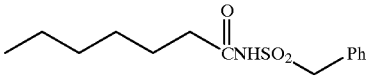 | 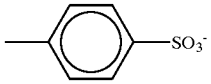 |
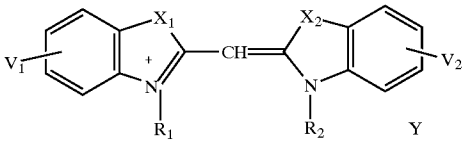
| | | | | | | | |
|---|---|---|---|---|---|---|---|
| D-14 | S | S | 5-Ph | 5'-Ph | 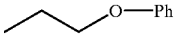 | 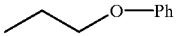 | 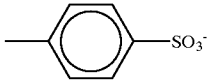 |

-continued
| | $X_1$ | $X_2$ | $V_1$ | $V_2$ | $R_1$ | $R_2$ | Y |
|---|---|---|---|---|---|---|---|
| D-15 | S | S | 5-Ph | 5'-Ph | 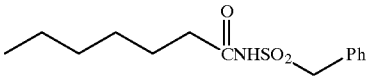 | 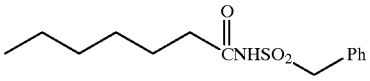 | 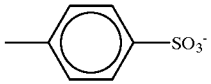 |
| D-16 | S | S | 5,6-Benzo | 5',6'-Benzo | 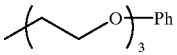 | 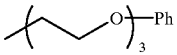 | 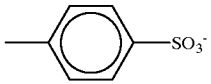 |
| D-17 | S | O | 5,6-Benzo | 5',6'-Benzo | 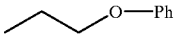 | 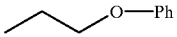 | 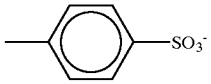 |
| D-18 | O | O | 5,6-Benzo | 5',6'-Benzo | 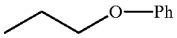 | 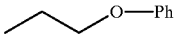 | 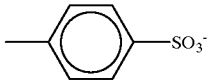 |
| D-19 | S | S | 5,6-Benzo | 5',6'-Benzo | 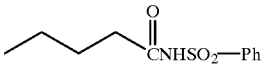 | 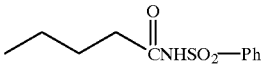 | 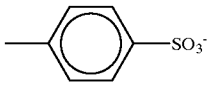 |
| D-20 | S | S | 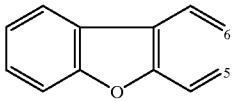 | 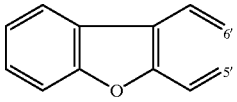 | 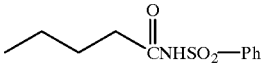 | 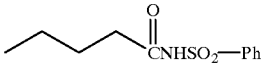 | 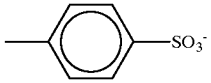 |

-continued
| | $X_1$ | $X_2$ | $V_1$ | $V_2$ | $R_1$ | $R_2$ | Y |
|---|---|---|---|---|---|---|---|
| | | | | | (II) Examples of anionic dyes: | | |
| | | | | | 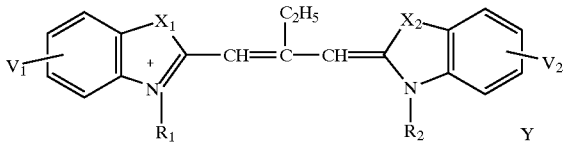 | | |
| D-21 | O | O | 5-Ph | 5'-Ph | 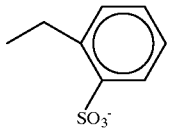 | 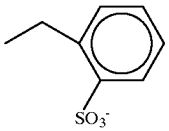 | $Na^+$ |
| D-22 | O | O | 5-Ph | 5'-Ph | 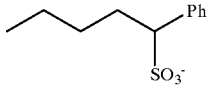 | 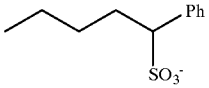 | $Na^+$ |
| D-23 | O | S | 5-Ph | 5'-Ph | 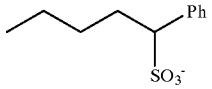 | 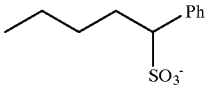 | $\overset{+}{H}N(C_2H_5)_3$ |
| D-24 | S | S | 5-Ph | 5'-Ph | 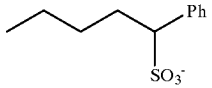 | 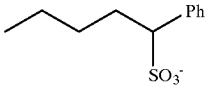 | $\overset{+}{H}N(C_2H_5)_3$ |
| D-25 | S | S | 5-Ph | 5'-Ph | 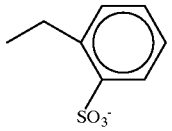 | 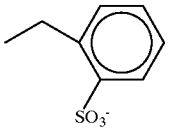 | $\overset{+}{H}N(C_2H_5)_3$ |

-continued
| | $X_1$ | $X_2$ | $V_1$ | $V_2$ | $R_1$ | $R_2$ | Y |
|---|---|---|---|---|---|---|---|
| D-26 | O | O | 5,6-Benzo | 5',6'-Benzo | 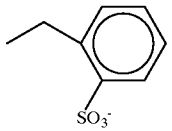 | 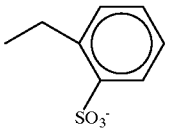 | $\overset{+}{H}N(C_2H_5)_3$ |
| D-27 | O | O | 4,5-Benzo | 5',6'-Benzo | 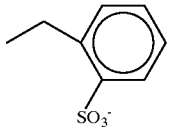 | 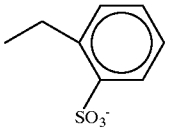 | $\overset{+}{H}N(C_2H_5)_3$ |
| D-28 | O | O | 5,6-Benzo | 5',6'-Benzo | 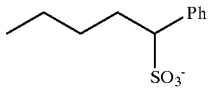 | 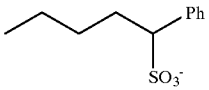 | $\overset{+}{H}N(C_2H_5)_3$ |
| D-29 | O | O | 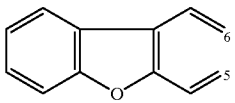 | 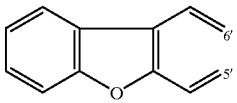 | 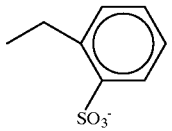 | 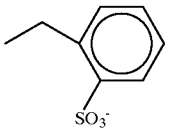 | $\overset{+}{H}N(C_2H_5)_3$ |
| D-30 | S | S | 5-Cl | 5'-Cl | 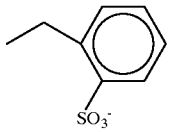 | 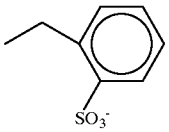 | $\overset{+}{H}N(C_2H_5)_3$ |

-continued
| | $X_1$ | $X_2$ | $V_1$ | $V_2$ | $R_1$ | $R_2$ | Y |
|---|---|---|---|---|---|---|---|
| | | | | | 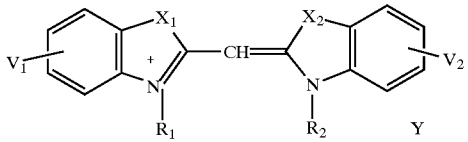 | | |
| D-31 | S | S | 5-Ph | 5'-Ph | 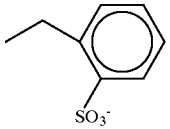 | 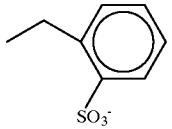 | $Na^+$ |
| D-32 | S | S | 5,6-Benzo | 5',6'-Benzo | 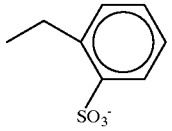 | 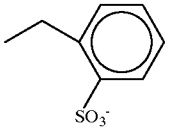 | $Na^+$ |
| D-33 | S | O | 5,6-Benzo | 5',6'-Benzo | 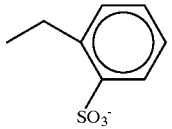 | 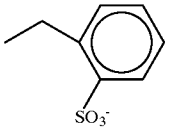 | $Na^+$ |
| D-34 | O | O | 5,6-Benzo | 5',6'-Benzo | 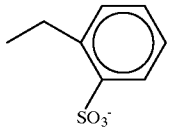 | 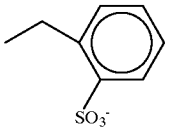 | $Na^+$ |
| D-35 | S | O | 5,6-Benzo | 5'-Ph | 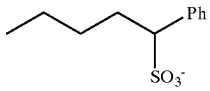 | 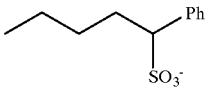 | $Na^+$ |

-continued
| $X_1$ | $X_2$ | $V_1$ | $V_2$ | $R_1$ | $R_2$ | Y |
|---|---|---|---|---|---|---|
| | | | | (III) Examples of linked dyes: | | |
| D-36 | | | | 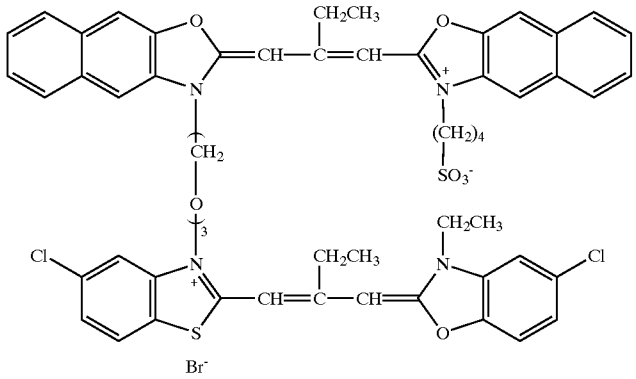 | | |

The dyes for use in the present invention can be synthesized by the methods described in, for example, F. M. Harmer, "Heterocyclic Compounds-Cyanine Dyes and Related Compounds", John Wiley & Sons, New York, London, 1964, D. M. Sturmer, "Heterocyclic Compounds-Special topics in heterocyclic chemistry", chapter 18, section 14, pages 482 to 515, John Wiley & Sons, New York, London, 1977, and Rodd's Chemistry of Carbon Compounds, 2nd. Ed. vol. IV, part B, 1977, chapter 15, pages 369 to 422, Elsevier Science Publishing Company Inc., New York.

The emulsion of the present invention and other photographic emulsions for use in combination therewith will be described below.

These can be selected from among silver halide emulsions prepared by the methods described in, e.g., U.S. Pat. No. 4,500,626, column 50; U.S. Pat. No. 4,628,021; Research Disclosure (to be abbreviated as RD hereafter) No. 17,029 (1978); RD No, 17,643 (December, 1978), pp. 22 and 23; RD No. 18,716 (November, 1979), page 648; RD No. 307,105 (November, 1989), pp. 863 to 865; JP-A's 62-253159, 64-13546, 2-236546 and 3-110555; P. Glafkides, "Chemie et Phisque Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

In the process of preparing the lightsensitive silver halide emulsion according to the present invention, it is preferred to effect removing of excess salts, known as desalting. As means therefor, use can be made of the noodle washing method to be performed after gelation of gelatin, or the precipitation method using an inorganic salt comprising a polyvalent anion (e.g., sodium sulfate), an anionic surfactant, an anionic polymer (e.g., sodium polystyrenesulfonate) or a gelatin derivative (e.g., aliphatic acylated gelatin, aromatic acylated gelatin or aromatic carbamoylated gelatin). The precipitation method is preferred.

The lightsensitive silver halide emulsion for use in the present invention may be doped with any of heavy metals such as iridium, rhodium, platinum, cadmium, zinc, thallium, lead, iron and osmium for various purposes. These may be used individually or in combination. The loading amount, although depending on the intended use, is generally in the range of about $10^{-9}$ to $10^{-3}$ mol per mol of silver halide. In the loading, the grains may be uniformly loaded with such metals, or the metals may be localized at internal regions or surfaces of the grains. For example, the emulsions described in JP-A's 2-236542, 1-116637 and 5-181246 can preferably be employed.

In the stage of grain formation with respect to the lightsensitive silver halide emulsion of the present invention, for example, a rhodanate, ammonia, a tetra-substituted thiourea compound, an organic thioether derivative described in Jpn. Pat. Appln. KOKOKU Publication No. (hereinafter referred to as JP-B-) 47-11386 or a sulfur-containing compound described in JP-A-53-144319 can be used as a silver halide solvent.

With respect to other conditions, reference can be made to descriptions of, for example, the aforementioned P. Glafkides, "Chemie et Phisque Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964. Specifically, use can be made of any of the acid method, the neutral method and the ammonia method. The reaction of a soluble silver salt with a soluble halide can be accomplished by any of the one-side mixing method, the simultaneous mixing method and a combination thereof. The simultaneous mixing method is preferably employed for obtaining a monodisperse emulsion.

The reverse mixing method wherein grains are formed in excess silver ions can also be employed. The method wherein the pAg of liquid phase in which a silver halide is formed is held constant, known as the controlled double jet method, can be employed as one mode of simultaneous mixing method.

In order to accelerate the grain growth, the addition concentration, addition amount and addition rate of a silver salt and a halide to be added may be increased (see, for example, JP-A's 55-142329 and 55-158124 and U.S. Pat. No. 3,650,757).

Any of known agitation methods can be employed in the agitation of the reaction mixture. Although the temperature and pH of reaction mixture during the formation of silver halide grains may be freely selected in conformity with the purpose, the pH is preferably in the range of 2.2 to 7.0, more preferably 2.5 to 6.0.

The lightsensitive silver halide emulsion generally consists of a chemically sensitized silver halide emulsion. In the chemical sensitization of lightsensitive silver halide emulsion according to the present invention, use can be made of the chalcogen sensitization methods such as sulfur sensitization, selenium sensitization and tellurium sensitization methods, which are common for conventional lightsensitive material emulsions, the noble metal sensitization method using gold, platinum, palladium or the like and the reduction sensitization method individually or in combination (see, for example, JP-A's 3-110555 and 5-241267). These chemical sensitizations can be performed in the presence of a nitrogen-containg heterocyclic compound (see JP-A-62-253159). Further, antifoggants listed later can be added after the completion of chemical sensitization. For example, use can be made of the methods of JP-A's 5-45833 and 62-40446.

During the chemical sensitization, the pH is preferably in the range of 5.3 to 10.5, more preferably 5.5 to 8.5. The pAg is preferably in the range of 6.0 to 10.5, more preferably 6.8 to 9.0.

The coating amount of lightsensitive silver halide for use in the present invention is in the range of 1 $mg/m^2$ to 10 $g/m^2$ in terms of silver.

In order to provide the lightsensitive silver halide for use in the present invention with color sensitivity, such as green sensitivity or red sensitivity, spectral sensitization of the lightsensitive silver halide emulsion is effected by a methine dye or the like. According to necessity, spectral sensitization in the blue region may be effected for a blue-sensitive emulsion.

Useful dyes include a cyanine dye, a merocyanine dye, a complex cyanine dye, a complex merocyanine dye, a holopolar cyanine dye, a hemicyanine dye, a styryl dye and a hemioxonol dye.

Specifically, use can be made of sensitizing dyes described, for example, in U.S. Pat. No. 4,617,257 and JP-A's 59-180550, 64-13546, 5-45828 and 5-45834.

These sensitizing dyes may be used individually or in combination. The use of sensitizing dyes in combination is often employed for the purpose of attaining supersensitization or wavelength regulation of spectral sensitization.

The emulsion of the present invention may be loaded with a dye which itself exerts no spectral sensitizing effect or a compound which absorbs substantially none of visible radiation and exhibits supersensitization, together with the above sensitizing dye (for example, those described in U.S. Pat. No. 3,615,641 and JP-A-63-23145).

With respect to the timing of loading the emulsion with the above sensitizing dye, the loading may be effected during chemical ripening, or before or after the same. Also, the loading may be performed before or after nucleation of silver halide grains as described in U.S. Pat. Nos. 4,183,756 and 4,225,666. The sensitizing dye and supersensitizing agent can be added in the form of a solution in an organic solvent such as methanol, a dispersion in gelatin or the like, or a solution containing a surfactant. The loading amount thereof is generally in the range of about $10^{-8}$ to $10^{-2}$ mol per mol of silver halide.

The additives useful in the above process and known photographic additives for use in the present invention are described in the aforementioned RD Nos. 17643, 18716 and 307105. The locations where they are described will be listed below.

| Types of additives | RD17643 | RD18716 | RD307105 |
|---|---|---|---|
| 1. Chemical sensitizers | page 23 | page 648 right column | page 866 |
| 2. Sensitivity increasing agents | | page 648 right column | |
| 3. Spectral sensitizers, super-sensitizers | pages 23–24 | page 648, right column to page 649, right column | pages 866–868 |
| 4. Brighteners | page 24 | page 648, right column | page 868 |
| 5. Antifoggants, stabilizers | pages 24–25 | page 649 right column | pages 868–870 |
| 6. Light absorbents, filter dyes, ultraviolet absorbents | pages 25–26 | page 649, right column to page 650, left column | page 873 |
| 7. Dye image stabilizers | page 25 | page 650, left column | page 872 |
| 8. Film hardeners | page 26 | page 651, left column | pages 874–875 |
| 9. Binders | page 26 | page 651, left column | pages 873–874 |
| 10. Plasticizers, lubricants | page 27 | page 650, right column | page 876 |
| 11. Coating aids, surfactants | pages 26–27 | page 650, right column | pages 875–876 |
| 12. Antistatic agents | page 27 | page 650, right column | pages 876–877 |
| 13. Matting agents | | | pages 878–879 |

In the present invention, it is preferred that an organometallic salt be used as an oxidizer in combination with the lightsensitive silver halide emulsion. Among organometallic salts, an organosilver salt is especially preferably employed.

As the organic compound which can be used for preparing the above organosilver salt oxidizer, there can be mentioned such benzotriazoles, fatty acids and other compounds as described in, for example, U.S. Pat. No. 4,500,626, columns 52 to 53. Further, silver acetylide described in U.S. Pat. No. 4,775,613. Two or more organosilver salts may be used in combination.

The above-mentioned organic silver salts can be added in an amount of 0.01 to 10 mol, preferably 0.01 to 1 mol per mol of light-sensitive silver halide. The total coating amount of light-sensitive silver halides and the organic silver salts is 0.05 to 10 g/m$^2$, preferably 0.1 to 4 g/m$^2$, in terms of silver.

Hydrophilic binders are preferably employed in the light-sensitive material and constituent layers thereof. Examples of such hydrophilic binders include those described in the aforementioned RDs and JP-A-64-13546, pages 71 to 75. In particular, transparent or translucent hydrophilic binders are preferred, which can be constituted of, for example, natural compounds including a protein, such as gelatin or a gelatin derivative, and a polysaccharide, such as a cellulose derivative, starch, gum arabic, dextran or pulluran, or synthetic polymer compounds, such as polyvinyl alcohol, modified polyvinyl alcohol (e.g., terminal-alkylated Poval MP 103 and MP 203 produced by Kuraray Co., Ltd.), polyvinylpyrrolidone and an acrylamide polymer. Also, use can be made of highly water absorbent polymers described in, for example, U.S. Pat. No. 4,960,681 and JP-A-62-245260, namely, a homopolymer of any of vinyl monomers having —COOM or —$SO_3$M (M is a hydrogen atom or an alkali metal), a copolymer of such vinyl monomers and a copolymer of any of such vinyl monomers and another vinyl monomer (e.g., sodium methacrylate or ammonium methacrylate, Sumikagel L-5H produced by Sumitomo Chemical Co., Ltd.). These binders can be used individually or in combination. A combination of gelatin and other binder mentioned above is preferred. The gelatin can be selected from among lime-processed gelatin, acid-processed gelatin and delimed gelatin which is one having a content of calcium and the like reduced in conformity with variable purposes. These can be used in combination.

In the present invention, it is appropriate for the coating amount of binder to be in the range of 1 to 20 g/m$^2$, preferably 2 to 15 g/m$^2$, and more preferably 3 to 12 g/m$^2$. In the binder, the gelatin content is in the range of 50 to 100%, preferably 70 to 100%.

As the color developing agent, although p-phenylenediamines or p-aminophenols can be used, it is preferred to employ the compounds of the aforementioned general formulae (1) to (5).

The compounds of the general formula (1) are those generally termed "sulfonamidophenols".

In the general formula (1), each of $R_1$ to $R_4$ independently represents a hydrogen atom, a halogen atom (e.g., chloro or bromo), an alkyl group (e.g., methyl, ethyl, isopropyl, n-butyl or t-butyl), an aryl group (e.g., phenyl, tolyl or xylyl), an alkylcarbonamido group (e.g., acetylamino, propionylamino or butyroylamino), an arylcarbonamido group (e.g., benzoylamino), an alkylsulfonamido group (e.g., methanesulfonylamino or ethanesulfonylamino), an arylsulfonamido group (e.g., benzenesulfonylamino or toluenesulfonylamino), an alkoxy group (e.g., methoxy, ethoxy or butoxy), an aryloxy group (e.g., phenoxy), an alkylthio group (e.g., methylthio, ethylthio or butylthio), an arylthio group (e.g., phenylthio or tolylthio), an alkylcarbamoyl group (e.g., methylcarbamoyl, dimethylcarbamoyl, ethylcarbamoyl, diethylcarbamoyl, dibutylcarbamoyl, piperidylcarbamoyl or morpholinocarbamoyl), an arylcarbamoyl group (e.g., phenylcarbamoyl, methylphenylcarbamoyl, ethylphenylcarbamoyl or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl or morpholynosulfamoyl), an arylsulfamoyl group (e.g., phenylsulfamoyl, methylphenylsulfamoyl, ethylphenylsulfamoyl or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl or p-toluenesulfonyl), an alkoxycarbonyl group (e.g., methoxycarbonyl, ethoxycarbonyl or butoxycarbonyl), an aryloxycarbonyl group (e.g., phenoxycarbonyl), an alkylcarbonyl group (e.g., acetyl, propionyl or butyroyl), an arylcarbonyl group (e.g., benzoyl or alkylbenzoyl), or an acyloxy group (e.g., acetyloxy, propionyloxy or butyroyloxy). Among $R_1$ to $R_4$, each of $R_2$ and $R_4$ preferably represents a hydrogen atom, a halogen atom, an alkyl group, an aryl group, an alkylcarbonamido group, an arylcarbonamido group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group or an acyl group. $R_1$ to $R_4$ are preferably such electron attractive substituents that the total of Hammett's constant σp values thereof is 0 or greater. The upper limit of the Hammett's constant σp values thereof is not particularly limited, but 1 or less is preferable.

$R_5$ represents an alkyl group (e.g., methyl, ethyl, butyl, octyl, lauryl, cetyl or stearyl), an aryl group (e.g., phenyl, tolyl, xylyl, 4-methoxyphenyl, dodecylphenyl, chlorophenyl, trichlorophenyl, nitrochlorophenyl, triisopropylphenyl, 4-dodecyloxyphenyl or 3,5-di-(methoxycarbonyl)phenyl) or a heterocyclic group (e.g., pyridyl). $R_5$ has preferably 6 or more carbon atoms, more preferably 15 or more carbon atoms. The upper limit of the number of carbon atoms of $R_5$ is preferably 40.

The compounds of the general formula (2) are those generally termed "sulfonylhydrazines". The compounds of the general formula (4) are those generally termed "carbamoylhydrazines".

In the general formulae (2) and (4), $R_5$ represents an alkyl group (e.g., methyl, ethyl, butyl, octyl, lauryl, cetyl or stearyl), an aryl group (e.g., phenyl, tolyl, xylyl, 4-methoxyphenyl, dodecylphenyl, chlorophenyl, dichlorophenyl, trichlorophenyl, nitrochlorophenyl, triisopropylphenyl, 4-dodecyloxyphenyl or 3,5-di-(methoxycarbonyl)phenyl) or a heterocyclic group (e.g., pyridyl). Z represents an atomic group forming an aromatic ring, preferably a 5- to 6-membered aromatic ring. When the aromatic ring is a heterocyclic aromatic ring, a heterocycle or a benzen ring may be condenced thereto. The aromatic ring formed by Z must have satisfactory electron withdrawing properties for providing the above compounds with a silver development activity. Accordingly, a nitrogen-containing aromatic ring, or an aromatic ring such as one comprising a benzene ring having electron attractive groups introduced therein, is preferred. As such an aromatic ring, there can be preferably employed, for example, a pyridine ring, a pyrazine ring, a pyrimidine ring, a quinoline ring or a quinoxaline ring.

When Z is a benzene ring, as substituents thereof, there can be mentioned, for example, an alkylsulfonyl group (e.g., methanesulfonyl or ethanesulfonyl), a halogen atom (e.g., chloro or bromo), an alkylcarbamoyl group (e.g., methylcarbamoyl, dimethylcarbamoyl, ethylcarbamoyl, diethylcarbamoyl, dibutylcarbamoyl, piperidylcarbamoyl or morpholynocarbamoyl), an arylcarbamoyl group (e.g., phenylcarbamoyl, methylphenylcarbamoyl, ethylphenylcarbamoyl or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl or morpholynosulfamoyl), an arylsulfamoyl group (e.g., phenylsulfamoyl, methylphenylsulfamoyl, ethylphenylsulfamoyl or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl or p-toluenesulfonyl), an alkoxycarbonyl group (e.g., methoxycarbonyl, ethoxycarbonyl or butoxycarbonyl), an aryloxycarbonyl group (e.g., phenoxycarbonyl), an alkylcarbonyl group (e.g., acetyl, propionyl or butyroyl), and an arylcarbonyl group (e.g., benzoyl or alkylbenzoyl). These substituents are preferably such electron attractive substituents that the total of Hammett's constant σp values thereof is 0 or greater. The upper limit of the Hammett's constant σp values is not particularly limited, but is preferably 3.8.

The compounds of the general formula (3) are those generally termed "sulfonylhydrazones". The compounds of the general formula (5) are those generally termed "carbamoylhydrazones".

In the general formulae (3) and (5), $R_5$ represents an alkyl group (e.g., methyl, ethyl, butyl, octyl, lauryl, cetyl or stearyl), an aryl group (e.g., phenyl, tolyl, xylyl, 4-methoxyphenyl, dodecylphenyl, chlorophenyl, dichlorophenyl, trichlorophenyl, nitrochlorophenyl, triisopropylphenyl, 4-dodecyloxyphenyl or 3,5-di-(methoxycarbonyl)phenyl) or a heterocyclic group (e.g., pyridyl). $R_6$ represents a substituted or unsubstituted alkyl group (e.g., methyl or ethyl). x represents any of an oxygen atom, a sulfur atom, a selenium atom and an alkyl-substituted or aryl-substituted tertiary nitrogen atom. Of these, an alkyl-substituted tertiary nitrogen atom is preferred. $R_7$ and $R_8$ each represent a hydrogen atom or a substituent, provided that $R_7$ and $R_8$ may be bonded to each other to thereby form a double bond or a ring. The substituent represented by $R_7$ and $R_8$ are the same as mentioned above for $R_1$ to $R_4$.

Particular examples of the compounds represented by the general formulae (1) to (5) will be set forth below, to which, however, the compounds of the present invention are not limited.

D-1

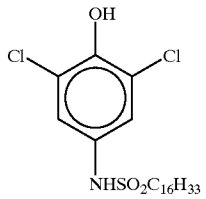

D-2

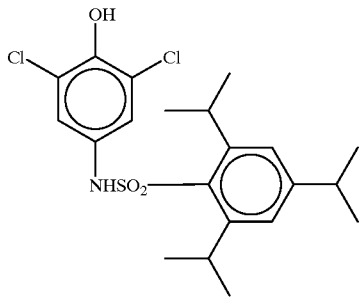

D-3

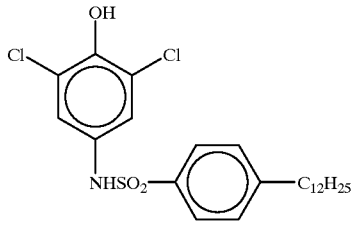

-continued
D-4
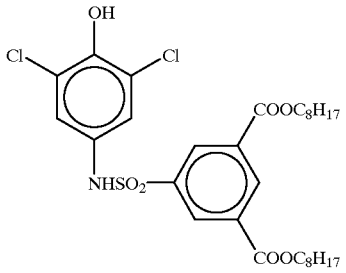
D-5
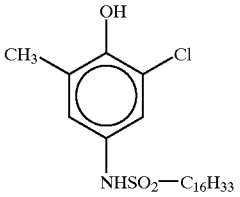
D-6
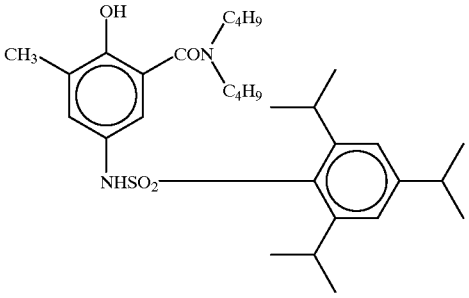
D-7
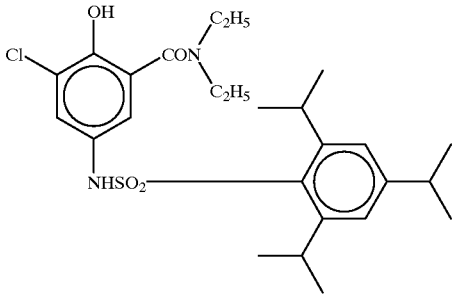
D-8
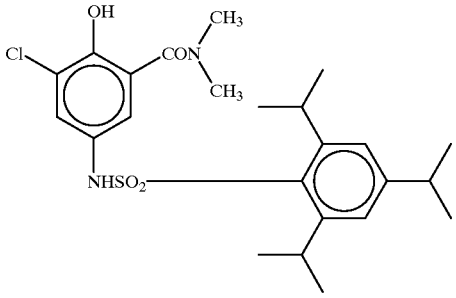
-continued
D-9
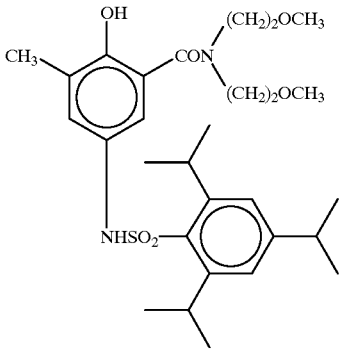
D-10
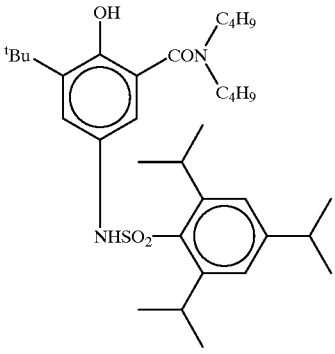
D-11
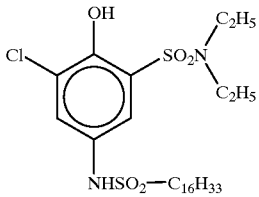
D-12
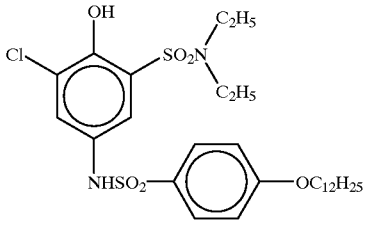
D-13
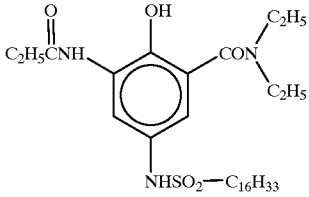
D-14
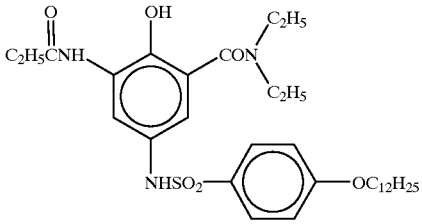

-continued
D-15
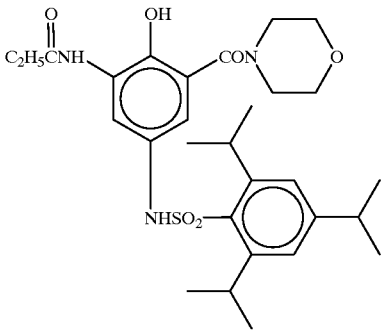
D-16
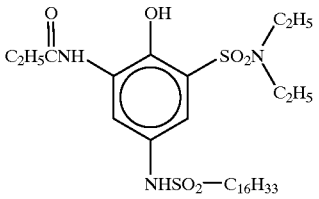
D-17
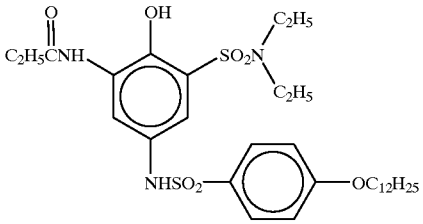
D-18
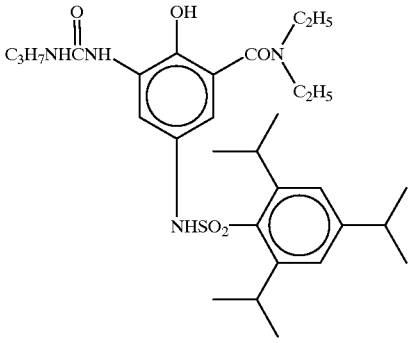
D-19
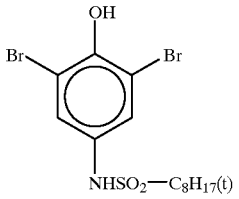
-continued
D-20
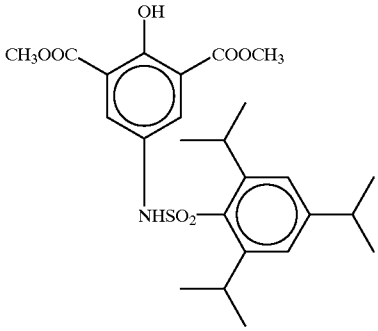
D-21
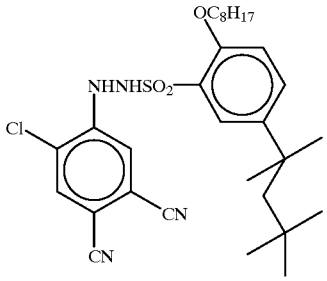
D-22
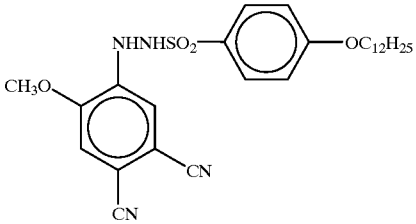
D-23
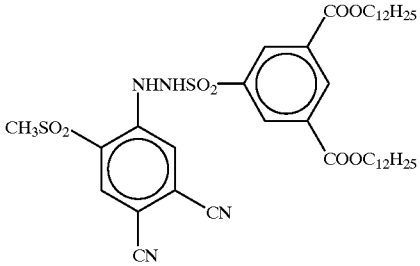
D-24
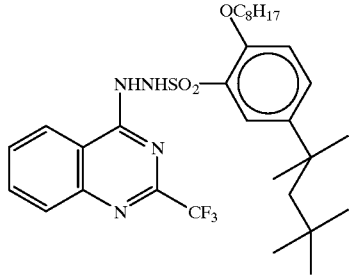

-continued
D-25
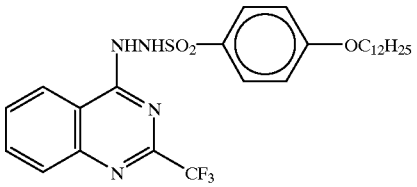
D-26
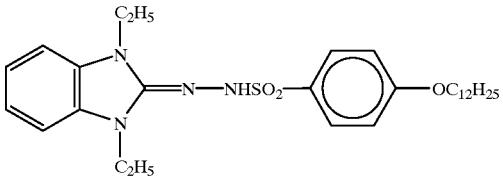
D-27
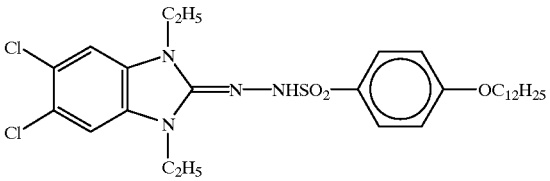
D-28
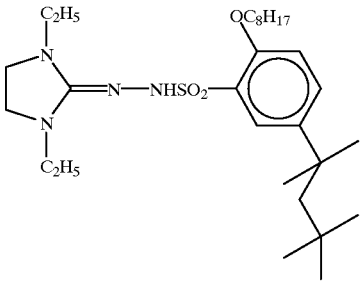
D-29
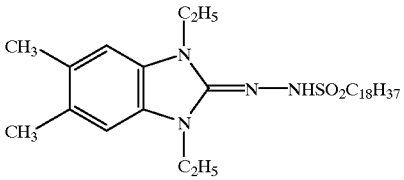
D-30
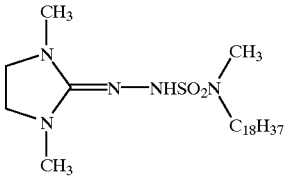
D-31
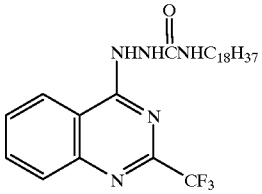
-continued
D-32
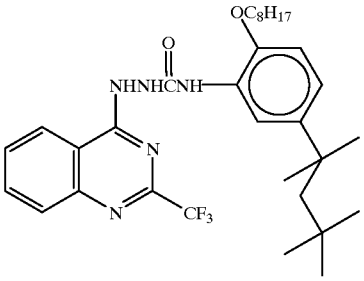
D-33
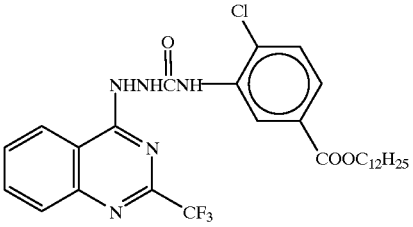
D-34
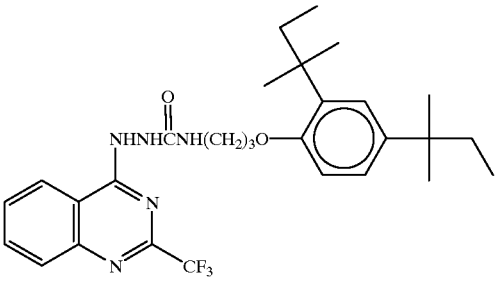
D-35
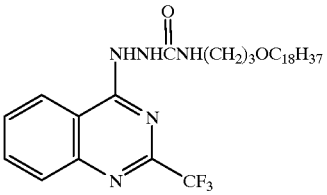
D-36
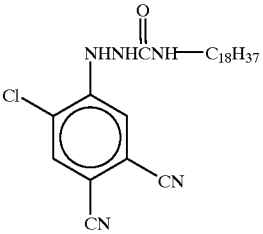
D-37
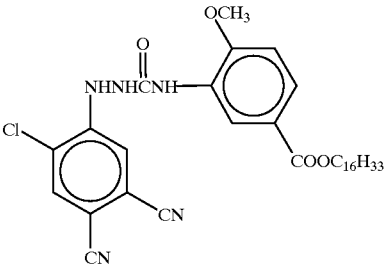

-continued
D-38
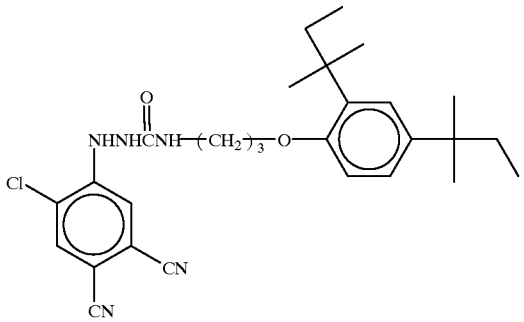
D-39
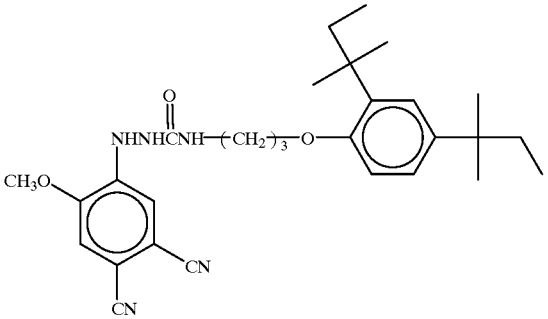
D-40
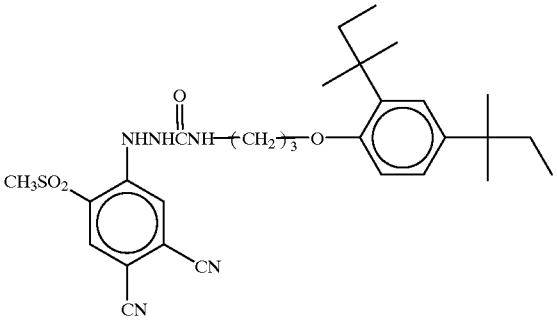
D-41
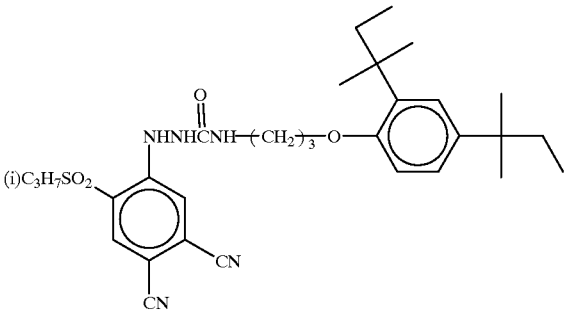
-continued
D-42
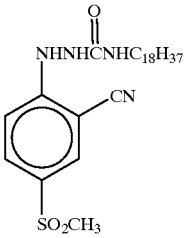
D-43
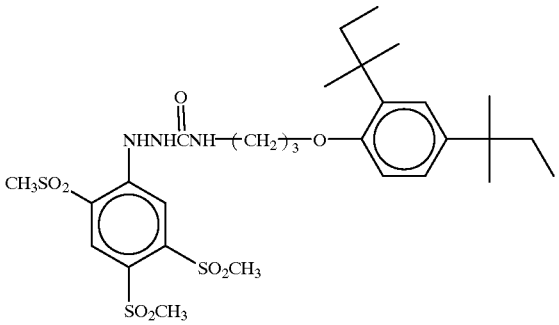
D-44
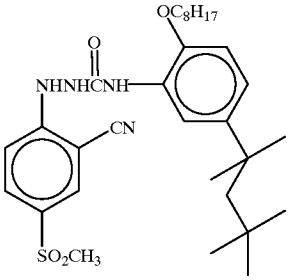
D-45
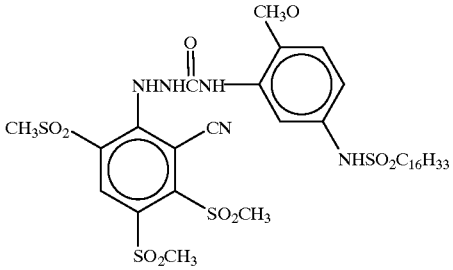
D-46
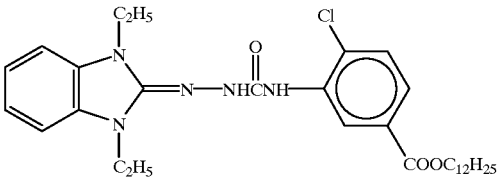
D-47
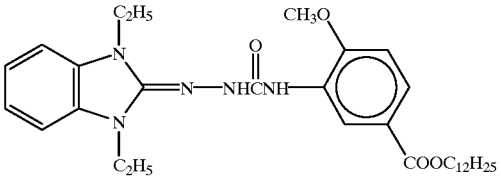

-continued

D-48

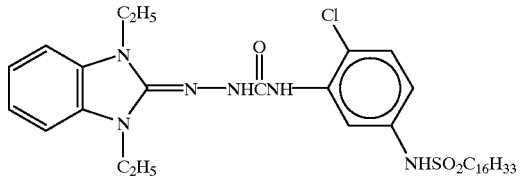

D-49

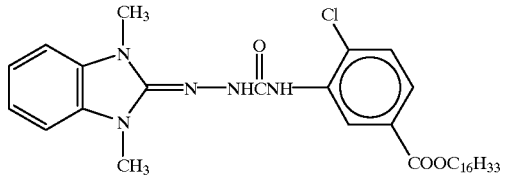

D-50

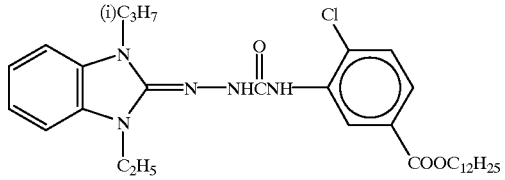

D-51

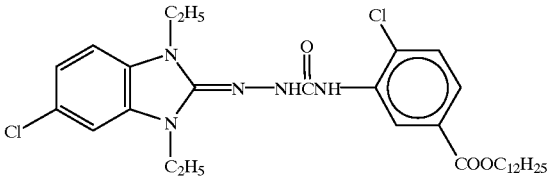

D-52

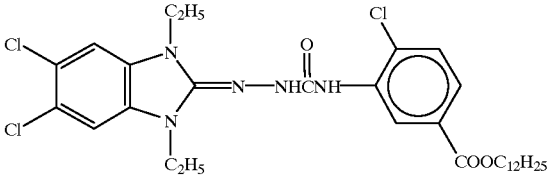

D-53

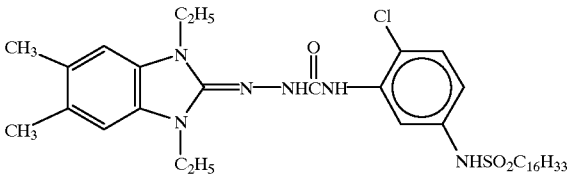

D-54

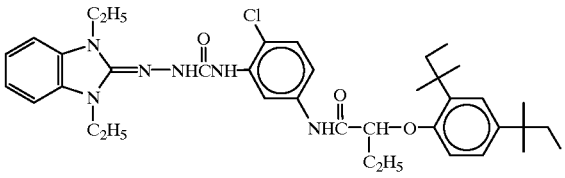

-continued

D-55

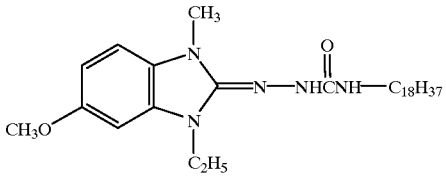

D-56

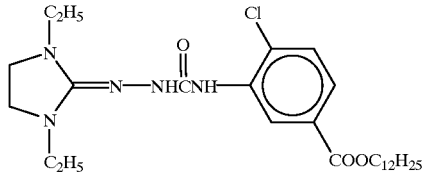

D-57

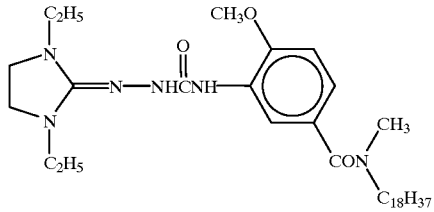

D-58

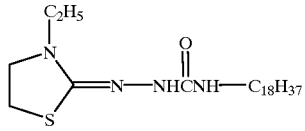

D-59

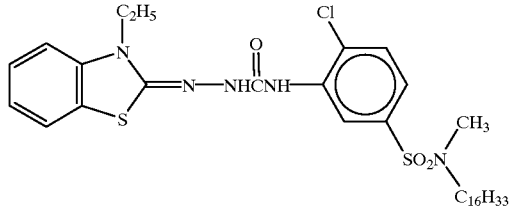

D-60

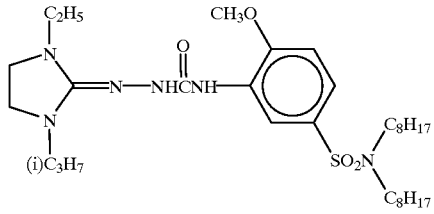

Now, the compounds represented by the general formula (6) of the present invention will be described in detail.

Each of $R_1$, $R_2$, $R_3$ and $R_4$ independently represents a hydrogen atom or a substituent. The substituent represented by $R_1$, $R_2$, $R_3$ or $R_4$ can be a halogen atom, an alkyl group (including a cycloalkyl and a bicycloalkyl), an alkenyl group (including a cycloalkenyl and a bicycloalkenyl), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including anilino), an acylamino group, an aminocarbonylamino group, an alkoxycarbonylamino group, an aryloxycarbonylamino group, a sulfamoylamino group, an alkyl- or arylsulfonylamino group, a mercapto group, an alkylthio group, an arylthio group, a heterocyclic thio group, a sulfamoyl group, a sulfo group, an alkyl- or arylsulfinyl group, an alkyl- or arylsulfonyl group, an acyl group, an aryloxycarbonyl group, an alkoxycarbonyl group, a carbamoyl group, an aryl- or heterocyclic azo group, an imido group, a phosphino group, a phosphinyl group, a phosphinyloxy group, a phosphinylamino group, or a silyl group.

More specifically, the substituent represented by $R_1$, $R_2$, $R_3$ or $R_4$ can be a halogen atom (e.g., a chlorine atom, a bromine atom or an iodine atom); an alkyl group [representing a linear, branched or cyclic substituted or unsubstituted alkyl group, and including an alkyl group (preferably an alkyl group having 1 to 30 carbon atoms, such as methyl, ethyl, n-propyl, isopropyl, t-butyl, n-octyl, eicosyl, 2-chloroethyl, 2-cyanoethyl or 2-ethylhexyl), a cycloalkyl group (preferably a substituted or unsubstituted cycloalkyl group having 3 to 30 carbon atoms, such as cyclohexyl, cyclopentyl or 4-n-dodecylcyclohexyl), a bicycloalkyl group (preferably a substituted or unsubstituted bicycloalkyl group having 5 to 30 carbon atoms, which is a monovalent group corresponding to a bicycloalkane having 5 to 30 carbon atoms from which one hydrogen atom is removed, such as bicyclo[1,2,2]heptan-2-yl or bicyclo[2,2,2]octan-3-yl), and a tricyclo or more cycle structure; the alkyl contained in the following substituents (for example, the alkyl of alkylthio group) also means the alkyl group of this concept]; an alkenyl group [representing a linear, branched or cyclic substituted or unsubstituted alkenyl group, and including an alkenyl group (preferably a substituted or unsubstituted alkenyl group having 2 to 30 carbon atoms, such as vinyl, allyl, pulenyl, geranyl or oleyl), a cycloalkenyl group (preferably a substituted or unsubstituted cycloalkenyl group having 3 to 30 carbon atoms, which is a monovalent group corresponding to a cycloalkene having 3 to 30 carbon atoms from which one hydrogen atom is removed, such as 2-cyclopenten-1-yl or 2-cyclohexen-1-yl), and a bicycloalkenyl group (substituted or unsubstituted bicycloalkenyl group, preferably a substituted or unsubstituted bicycloalkenyl group having 5 to 30 carbon atoms, which is a monovalent group corresponding to a bicycloalkene having one double bond from which one hydrogen atom is removed, such as bicyclo[2,2,1]hept-2-en-1-yl or bicyclo[2,2,2]oct-2-en-4-yl)]; an alkynyl group (preferably a substituted or unsubstituted alkynyl group having 2 to 30 carbon atoms, such as ethynyl, propargyl or trimethylsilylethynyl); an aryl group (preferably a substituted or unsubstituted aryl group having 6 to 30 carbon atoms, such as phenyl, p-tolyl, naphthyl, m-chlorophenyl or o-hexadecanoylaminophenyl); a heterocyclic group (preferably a monovalent group corresponding to a 5- or 6-membered substituted or unsubstituted aromatic or nonaromatic heterocyclic compound from which one hydrogen atom is removed, and to which an aromatic hydrocarbon ring such as benzen ring may be condences, more preferably a 5- or 6-membered aromatic heterocyclic group having 3 to 30 carbon atoms, such as 2-furyl, 2-thienyl, 2-pyrimidinyl or 2-benzothiazolyl); a cyano group; a hydroxyl group; a nitro group; a carboxyl group; an alkoxy group (preferably a substituted or unsubstituted alkoxy group having 1 to 30 carbon atoms, such as methoxy, ethoxy, isopropoxy, t-butoxy, n-octyloxy or 2-methoxyethoxy); an aryloxy group (preferably a substituted or unsubstituted aryloxy group having 6 to 30 carbon atoms, such as phenoxy, 2-methylphenoxy, 4-t-butylphenoxy, 3-nitrophenoxy or 2-tetradecanoylaminophenoxy); a silyloxy group (preferably a silyloxy group having 3 to 20 carbon atoms, such as trimethylsilyloxy or t-butyldimethylsilyloxy); a heterocyclic oxy group (preferably a substituted or unsubstituted heterocyclic oxy group having 2 to 30 carbon atoms, such as 1-phenyltetrazol-5-oxy or 2-tetrahydropyranyloxy); an acyloxy group (preferably a formyloxy group, a substituted or unsubstituted alkylcarbonyloxy group having 2 to 30 carbon atoms or a substituted or unsubstituted arylcarbonyloxy group having 6 to 30 carbon atoms, such as formyloxy, acetyloxy, pivaloyloxy, stearoyloxy, benzoyloxy or p-methoxyphenylcarbonyloxy); a carbamoyloxy group (preferably a substituted or unsubstituted carbamoyloxy group having 1 to 30 carbon atoms, such as N,N-dimethylcarbamoyloxy, N,N-diethylcarbamoyloxy, morpholinocarbonyloxy, N,N-di-n-octylaminocarbonyloxy or N-n-octylcarbamoyloxy); an alkoxycarbonyloxy group (preferably a substituted or unsubstituted alkoxycarbonyloxy group having 2 to 30 carbon atoms, such as methoxycarbonyloxy, ethoxycarbonyloxy, t-butoxycarbonyloxy or n-octylcarbonyloxy); an aryloxycarbonyloxy group (preferably a substituted or unsubstituted aryloxycarbonyloxy group having 7 to 30 carbon atoms, such as phenoxycarbonyloxy, p-methoxyphenoxycarbonyloxy or p-n-hexadecyloxyphenoxycarbonyloxy); an amino group (preferably an amino group, a substituted or unsubstituted alkylamino group having 1 to 30 carbon atoms or a substituted or unsubstituted anilino group having 6 to 30 carbon atoms, such as amino, methylamino, dimethylamino, anilino, N-methylanilino or diphenylamino); an acylamino group (preferably an formylamino group, a substituted or unsubstituted alkylcarbonylamino group having 2 to 30 carbon atoms or a substituted or unsubstituted arylcarbonylamino group having 7 to 30 carbon atoms, such as formylamino, acetylamino, pivaloylamino, lauroylamino, benzoylamino or 3,4,5-tri-n-octyloxyphenylcarbonylamino); an aminocarbonylamino group (preferably a substituted or unsubstituted aminocarbonylamino group having 1 to 30 carbon atoms, such as carbamoylamino, N,N-dimethylaminocarbonylamino, N,N-diethylaminocarbonylamino or morpholinocarbonylamino); an alkoxycarbonylamino group (preferably a substituted or unsubstituted alkoxycarbonylamino group having 2 to 30 carbon atoms, such as methoxycarbonylamino, ethoxycarbonylamino, t-butoxycarbonylamino, n-octadecyloxycarbonylamino or N-methyl-methoxycarbonylamino); an aryloxycarbonylamino group (preferably a substituted or unsubstituted aryloxycarbonylamino group having 7 to 30 carbon atoms, such as phenoxycarbonylamino, p-chlorophenoxycarbonylamino or m-n-octyloxyphenoxycarbonylamino); a sulfamoylamino group (preferably a substituted or unsubstituted sulfamoylamino group having 0 to 30 carbon atoms, such as sulfamoylamino, N,N-dimethylaminosulfonylamino or N-n-octylaminosulfonylamino); an alkyl- or arylsulfonylamino group (preferably a substituted or unsubstituted alkylsulfonylamino group having 1 to 30 carbon atoms or a substituted or unsubstituted arylsulfonylamino group having 6 to 30 carbon atoms, such as methylsulfonylamino, butylsulfonylamino, phenylsulfonylamino, 2,3,5-trichlorophenylsulfonylamino or p-methylphenylsulfonylamino); a mercapto group; an alkylthio group (preferably a substituted or unsubstituted alkylthio group having 1 to 30 carbon atoms, such as methylthio, ethylthio or n-hexadecylthio); an arylthio group (preferably a substituted or unsubstituted arylthio group having 6 to 30 carbon atoms, such as phenylthio, p-chlorophenylthio or m-methoxyphenylthio); a heterocyclic thio group (preferably a substituted or unsubstituted heterocyclic thio group having 2 to 30 carbon atoms, such as 2-benzothiazolylthio or 1-phenyltetrazol-5-ylthio); a sulfamoyl group (preferably a substituted or unsubstituted sulfamoyl group having 0 to 30 carbon atoms, such as N-ethylsulfamoyl, N-(3-dodecyloxypropyl)sulfamoyl, N,N-dimethylsulfamoyl, N-acetylsulfamoyl, N-benzoylsulfamoyl or N-(N'-phenylcarbamoyl)sulfamoyl); a sulfo group; an alkyl- or arylsulfinyl group (preferably a substituted or unsubstituted alkylsulfinyl group having 1 to 30 carbon atoms or a substituted or unsubstituted arylsulfinyl group having 6 to 30 carbon atoms, such as methylsulfinyl, ethylsulfinyl, phenylsulfinyl or p-methylphenylsulfinyl); an alkyl- or arylsulfonyl group (preferably a substituted or unsubstituted alkylsulfonyl group having 1 to 30 carbon atoms or a substituted or unsubstituted arylsulfonyl group having 6 to 30 carbon atoms, such as methylsulfonyl, ethylsulfonyl, phenylsulfonyl or p-methylphenylsulfonyl); an acyl group (preferably a formyl group, a substituted or unsubstituted alkylcarbonyl group having 2 to 30 carbon atoms or a substituted or unsubstituted arylcarbonyl group having 7 to 30 carbon atoms, such as acetyl, pivaloyl, 2-chloroacetyl, stearoyl, benzoyl or p-n-octyloxyphenylcarbonyl); an aryloxycarbonyl group (preferably a substituted or unsubstituted aryloxycarbonyl group having 7 to 30 carbon atoms, such as phenoxycarbonyl, o-chlorophenoxycarbonyl, m-nitrophenoxycarbonyl or p-t-butylphenoxycarbonyl); an alkoxycarbonyl group (preferably a substituted or unsubstituted alkoxycarbonyl group having 2 to 30 carbon atoms, such as methoxycarbonyl, ethoxycarbonyl, t-butoxycarbonyl or n-octadecyloxycarbonyl); a carbamoyl group (preferably a substituted or unsubstituted carbamoyl group having 1 to 30 carbon atoms, such as carbamoyl, N-methylcarbamoyl, N,N-dimethylcarbamoyl, N,N-di-n-octylcarbamoyl or N-(methylsulfonyl)carbamoyl); an aryl- or heterocyclic azo group (preferably a substituted or unsubstituted arylazo group having 6 to 30 carbon atoms or a substituted or unsubstituted heterocyclic azo group having 3 to 30 carbon atoms, such as phenylazo, p-chlorophenylazo or 5-ethylthio-1,3,4-thiadiazol-2-ylazo); an imido group (preferably N-succinimido or N-phthalimido); a phosphino group (preferably a substituted or unsubstituted phosphino group having 2 to 30 carbon atoms, such as dimethylphosphino, diphenylphosphino or methylphenoxyphosphino); a phosphinyl group (preferably a substituted or unsubstituted phosphinyl group having 0 to 30 carbon atoms, such as phosphinyl, dioctyloxyphosphinyl or diethoxyphosphinyl); a phosphinyloxy group (preferably a substituted or unsubstituted phosphinyloxy group having 2 to 30 carbon atoms, such as diphenoxyphosphinyloxy or dioctyloxyphosphinyloxy); a phosphinylamino group (preferably a substituted or unsubstituted phosphinylamino group having 2 to 30 carbon atoms, such as dimethoxyphosphinylamino or dimethylaminophosphinylamino); or a silyl group (preferably a substituted or unsubstituted silyl group having 0 to 30 carbon atoms, such as trimethylsilyl, t-butyldimethylsilyl or phenyldimethylsilyl).

When the groups represented by $R_1$ to $R_4$ are further substitutable groups, the groups represented by $R_1$ to $R_4$ may further have substituents. Preferred substituents are the same as the substituents described with respect to $R_1$ to $R_4$. When the substitution is effected by two or more substituents, the substituents may be identical with or different from each other.

Each of $R_5$ and $R_6$ independently represents an alkyl group, an aryl group, a heterocyclic group, an acyl group, an alkylsulfonyl group or an arylsulfonyl group. With respect to the preferred scope of the alkyl group, aryl group, heterocyclic group, acyl group, alkylsulfonyl group and arylsulfonyl group, these are the same as the alkyl group, aryl group, heterocyclic group, acyl group, alkylsulfonyl group and arylsulfonyl group described above in connection with the substituents represented by $R_1$ to $R_4$. When the groups represented by $R_5$ and $R_6$ are further substitutable groups, the groups represented by $R_5$ and $R_6$ may further have substituents. Preferred substituents are the same as the substituents described with respect to $R_1$ to $R_4$. When the substitution is effected by two or more substituents, the substituents may be identical with or different from each other.

$R_1$ and $R_2$, $R_3$ and $R_4$, $R_5$ and $R_6$, $R_2$ and $R_5$, $R_4$ and $R_6$ may be bonded to each other to thereby form a 5-membered, 6-membered or 7-membered ring.

In the general formula (6), $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)— or $(M)_{1/n}OSO_2$—, wherein each of $R_{11}$, $R_{12}$, $R_{13}$ and $R_{14}$ represents an alkyl group, an aryl group or a heterocyclic group, $R_{15}$ represents a hydrogen atom or a block group, W represents an oxygen atom, a sulfur atom or >N—$R_{18}$, and each of $R_{16}$, $R_{17}$ and $R_{18}$ represents a hydrogen atom, an alkyl group or $(M)_{1/n}OSO_2$—. The alkyl group, aryl group and heterocyclic group represented by $R_{11}$, $R_{12}$, $R_{13}$ and $R_{14}$ are the same as the alkyl group, aryl group and heterocyclic group described above in connection with the substituents represented by $R_1$ to $R_4$. M represents a n-valence cation, such as, for example, $Na^+$ and $K^+$. n represents a natural number, preferably a natural number of 1 to 3. When the groups represented by $R_{11}$, $R_{12}$, $R_{13}$ and $R_{14}$ are further substitutable groups, the groups represented by $R_{11}$, $R_{12}$, $R_{13}$ and $R_{14}$ may further have substituents. Preferred substituents are the same as the substituents described with respect to $R_1$ to $R_4$. When the substitution is effected by two or more substituents, the substituents may be identical with or different from each other. When $R_{16}$, $R_{17}$ and $R_{18}$ represent alkyl groups, these are the same as the alkyl group described above in connection with the substituents represented by $R_1$ to $R_4$. When $R_{15}$ represents a block group, it is the same as the block group represented by BLK described later.

The compounds of the general formula (6) will now be described with respect to the preferred scope thereof.

Each of $R_1$ to $R_4$ preferably represents a hydrogen atom, a halogen atom, an alkyl group, an aryl group, an acylamino group, an alkyl- or arylsulfonylamino group, an alkoxy group, an aryloxy group, an alkylthio group, an arylthio group, an acyl group, an alkoxycarbonyl group, an aryloxycarbonyl group, a carbamoyl group, a cyano group, a hydroxyl group, a carboxyl group, a sulfo group, a nitro group, a sulfamoyl group, an alkylsulfonyl group, an arylsulfonyl group or an acyloxy group. Each of $R_1$ to $R_4$ more preferably represents a hydrogen atom, a halogen atom, an alkyl group, an acylamino group, an alkyl- or arylsulfonylamino group, an alkoxy group, an alkylthio group, an arylthio group, an alkoxycarbonyl group, a carbamoyl group, a cyano group, a hydroxyl group, a carboxyl group, a sulfo group, a nitro group, a sulfamoyl group, an alkylsulfonyl group or an arylsulfonyl group. It is especially preferred that, among $R_1$ to $R_4$, either of $R_1$ and $R_3$ be a hydrogen atom.

Each of $R_5$ and $R_6$ preferably represents an alkyl group, an aryl group or a heterocyclic group, most preferably an alkyl group.

With respect to the compounds of the general formula (6), it is preferred that the formula weight of moiety excluding $R_7$ be 300 or more. Further, it is preferred that the oxidation potential in pH 10 water of p-phenylenediamine derivative, i.e., compound of the general formula (6) wherein $R_7$ is a hydrogen atom do not exceed 5 mV (vs. SCE).

$R_7$ preferably represents $R_{11}$—O—CO—, $R_{14}$—$SO_2$— or $R_{15}$—W—C($R_{16}$)($R_{17}$)—, most preferably $R_{11}$—O—CO—.

$R_{11}$ preferably represents an alkyl group, or a group containing a timing group capable of inducing a cleavage reaction with the use of electron transfer reaction as described in U.S. Pat. Nos. 4,409,323 and 4,421,845, or a group of the following formula (T-1) having a timing group whose terminal capable of inducing an electron transfer reaction is blocked.

BLK—W—(X=Y)$j$—C($R_{21}$)$R_{22}$—** Formula (T-1)

wherein BLK represents a block group; ** represents a position for bonding with —O—CO—; W represents an oxygen atom, a sulfur atom or >N—$R_{23}$; each of X and Y represents a methine or a nitrogen atom; j is 0, 1 or 2; and each of $R_{21}$, $R_{22}$ and $R_{23}$ represents a hydrogen atom or any of the same groups as the substituents described with respect to $R_1$ to $R_4$. When X and Y represent substituted methines, the substituents and any two of the substituents of $R_{21}$, $R_{22}$ and $R_{23}$ may be connected to each other to thereby form a cyclic structure (e.g, a benzene ring or a pyrazole ring). It is also possible to avoid such a cyclic structure formation.

As the block group represented by BLK, there can be employed known block groups, which include block groups such as acyl and sulfonyl groups as described in, for example, JP-B-48-9968, JP-A's 52-8828 and 57-82834, U.S. Pat. No. 3,311,476 and JP-B-47-44805 (U.S. Pat. No. 3,615,617); block groups utilizing the reverse Michael reaction as described in, for example, JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175) and JP-A's 59-105640, 59-105641 and 59-105642; block groups utilizing the formation of a quinone methide or quinone methide homologue through intramolecular electron transfer as described in, for example, JP-B-54-39727, U.S. Pat. Nos. 3,674,478, 3,932,480 and 3,993,661, JP-A-57-135944, JP-A-57-135945 (U.S. Pat. No. 4,420,554), JP-A's 57-136640 and 61-196239, JP-A-61-196240 (U.S. Pat. No. 4,702,999), JP-A-61-185743, JP-A-61-124941 (U.S. Pat. No. 4,639,408) and JP-A-2-280140; block groups utilizing an intramolecular nucleophilic substitution reaction as described in, for example, U.S. Pat. Nos. 4,358,525 and 4,330,617, JP-A-55-53330 (U.S. Pat. No. 4,310,612), JP-A's 59-121328 and 59-218439 and JP-A-63-318555 (EP No. 0295729); block groups utilizing a cleavage reaction of 5- or 6-membered ring as described in, for example, JP-A-57-76541 (U.S. Pat. No. 4,335,200), JP-A-57-135949 (U.S. Pat. No. 4,350,752), JP-A's 57-179842, 59-137945, 59-140445, 59-219741 and 59-202459, JP-A-60-41034 (U.S. Pat. No. 4,618,563), JP-A-62-59945 (U.S. Pat. No. 4,888,268), JP-A-62-65039 (U.S. Pat. No. 4,772,537), and JP-A's 62-80647, 3-236047 and 3-238445; block groups utilizing a reaction of addition of nucleophilic agent to conjugated unsaturated bond as described in, for example, JP-A's 59-201057 (U.S. Pat. No. 4,518,685), 61-43739 (U.S. Pat. No. 4,659,651), 61-95346 (U.S. Pat. No. 4,690,885), 61-95347 (U.S. Pat. No. 4,892,811), 64-7035, 4-42650 (U.S. Pat. No. 5,066,573), 1-245255, 2-207249, 2-235055 (U.S. Pat. No. 5,118,596) and 4-186344; block groups utilizing a β-leaving reaction as described in, for example, JP-A's 59-93442, 61-32839 and 62-163051 and JP-B-5-37299; block groups utilizing a nucleophilic substitution reaction of diarylmethane as described in JP-A-61-188540; block groups utilizing Lossen rearrangement reaction as described in JP-A-62-187850; block groups utilizing a reaction between an N-acyl derivative of thiazolidine-2-thione and an amine as described in, for example, JP-A's 62-80646, 62-144163 and 62-147457; block groups having two electrophilic groups and capable of reacting with a binucleophilic agent as described in, for example, JP-A's 2-296240 (U.S. Pat. No. 5,019,492), 4-177243, 4-177244, 4-177245, 4-177246, 4-177247, 4-177248, 4-177249, 4-179948, 4-184337 and 4-184338, PCT International Publication No. 92/21064, JP-A-4-330438, PCT International Publication No. 93/03419 and JP-A-5-45816; and block groups of JP-A's 3-236047 and 3-238445. Of these block groups, block groups having two electrophilic groups and capable of reacting with a binucleophilic agent as described in, for example, JP-A's 2-296240 (U.S. Pat. No. 5,019,492), 4-177243, 4-177244, 4-177245, 4-177246, 4-177247, 4-177248, 4-177249, 4-179948, 4-184337 and 4-184338, PCT International Publication No. 92/21064, JP-A-4-330438, PCT International Publication No. 93/03419 and JP-A-5-45816 are especially preferred.

Particular examples of the timing group moieties, corresponding to the group of formula (T-1) from which BLK is removed, include the following. In the following, * represents a position for bonding with BLK, and ** represents a position for bonding with —O—CO—.

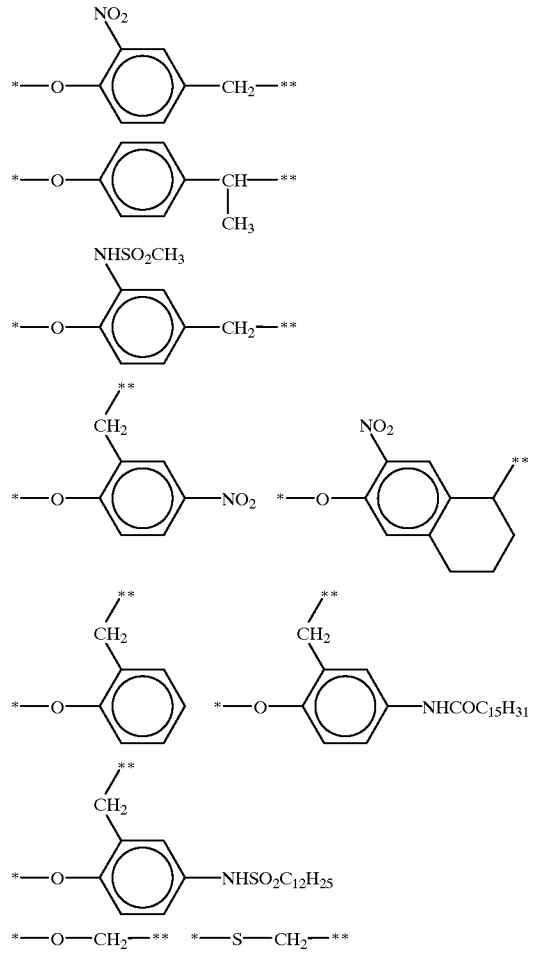

-continued

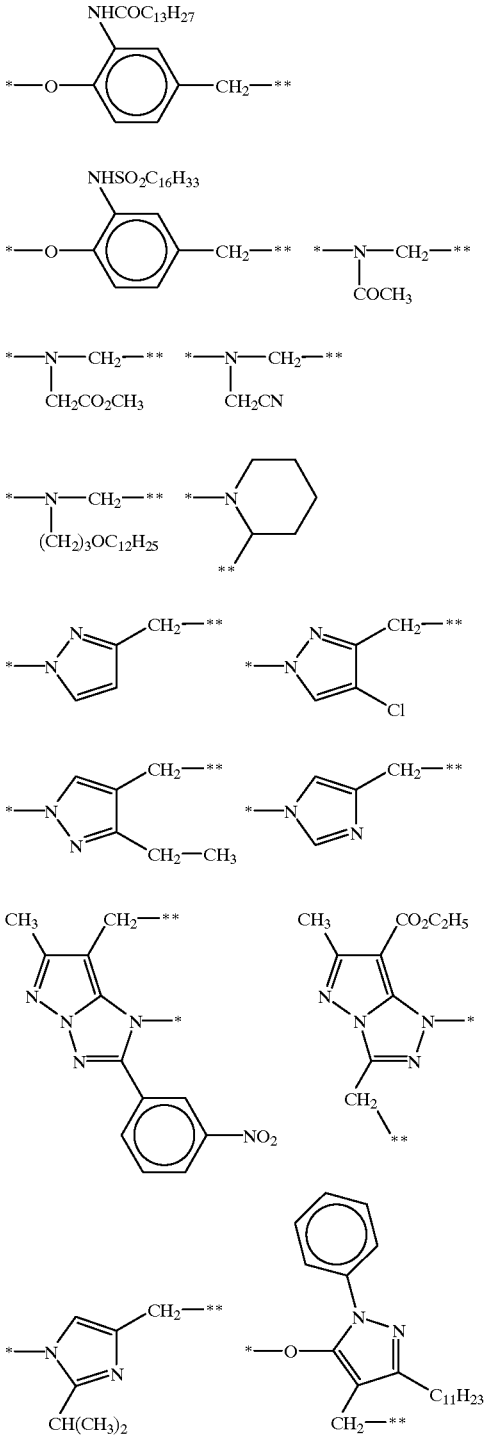

It is preferred that each of $R_{12}$ and $R_{13}$ be an alkyl or aryl group, and that $R_{14}$ be an aryl group. $R_{15}$ is preferably a block group, which is preferably the same as the preferred BLK contained in the group of the formula (T-1). Each of $R_{16}$, $R_{17}$ and $R_{18}$ preferably represents a hydrogen atom.

Particular examples of the compounds represented by the general formula (6) of the present invention will be set forth below, to which, however, the present invention is in no way limited.

DEVP-1

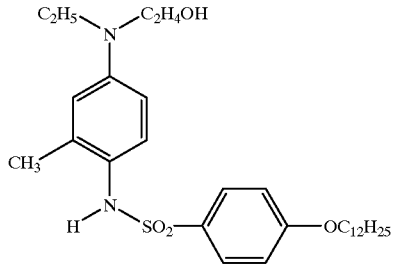

DEVP-2

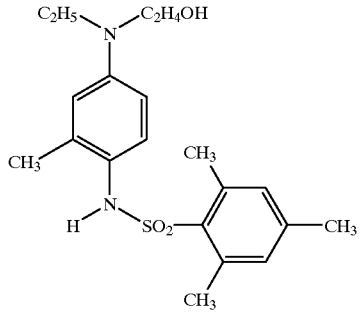

DEVP-3

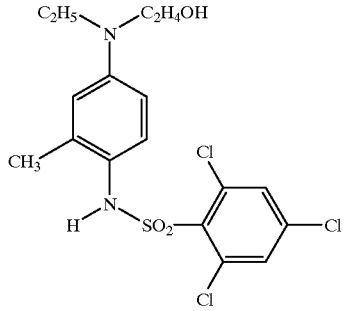

DEVP-4

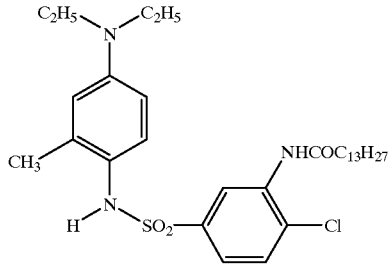

DEVP-5

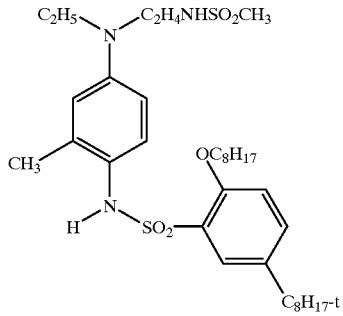

-continued
DEVP-6
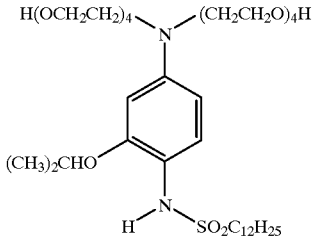
DEVP-7
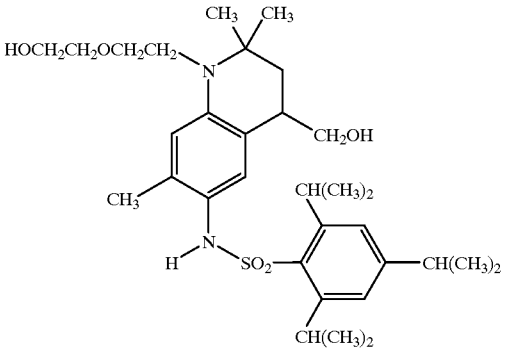
DEVP-8
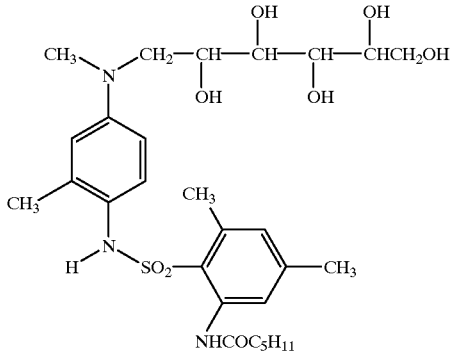
DEVP-9
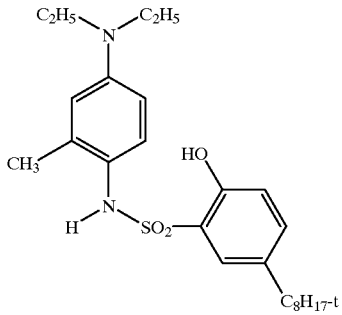
-continued
DEVP-10
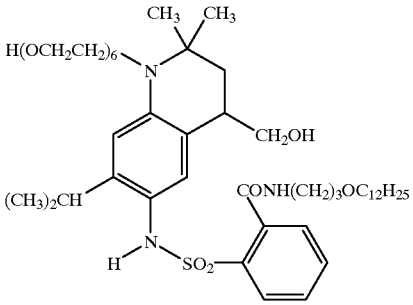
DEVP-11
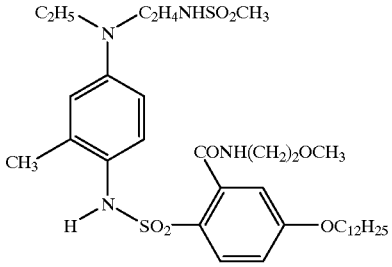
DEVP-12
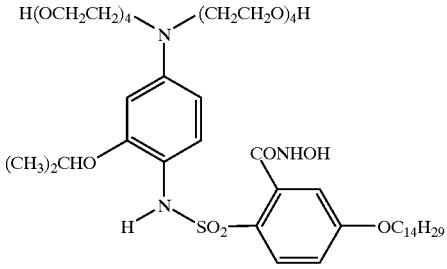
DEVP-13
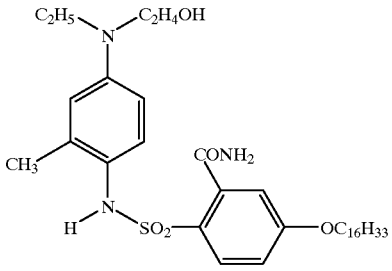
DEVP-14
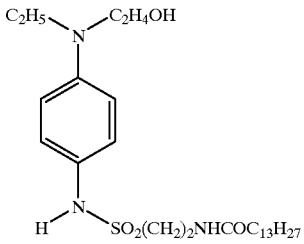

-continued
DEVP-15
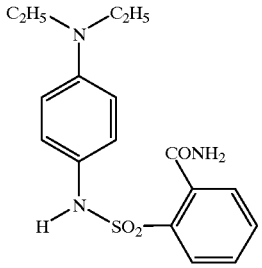
DEVP-16
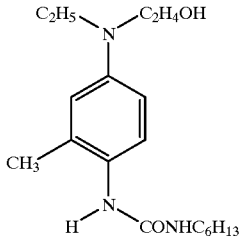
DEVP-17
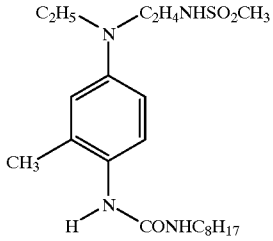
EVP-18
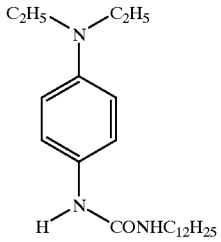
DEVP-19
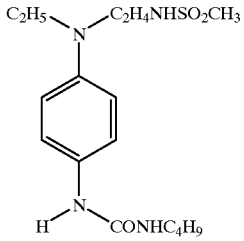
EVP-20
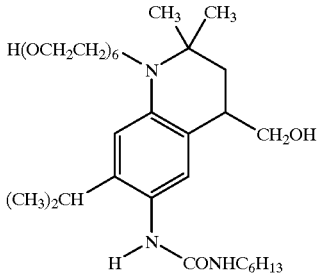
-continued
DEVP-21
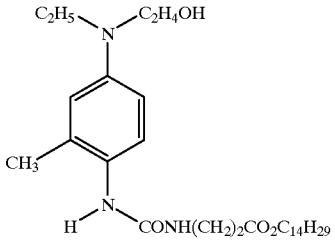
EVP-22
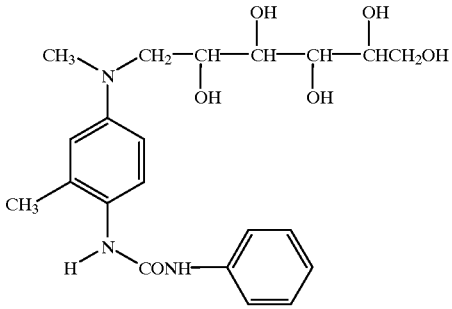
DEVP-23
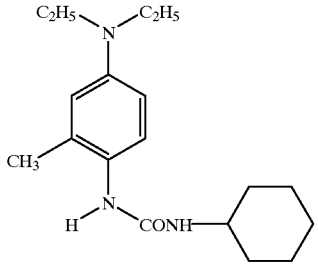
DEVP-24
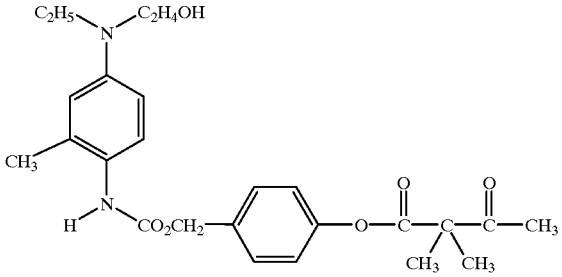
DEVP-25
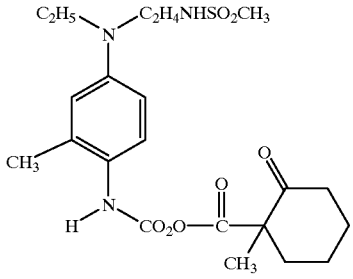

-continued
DEVP-26
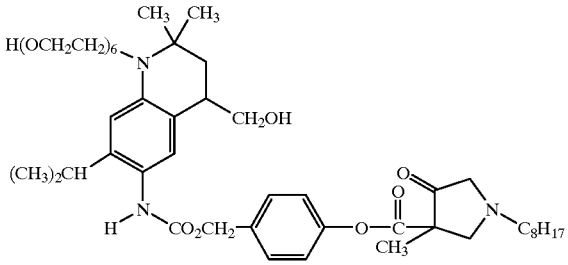
DEVP-27
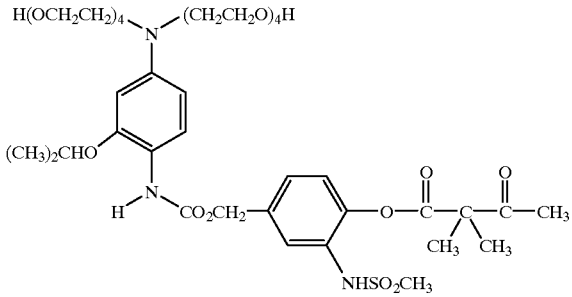
DEVP-28
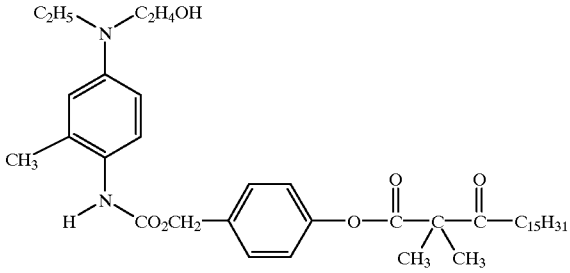
DEVP-29
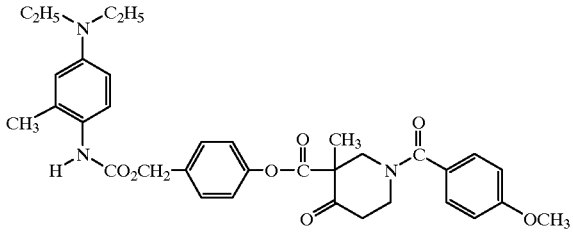
DEVP-30
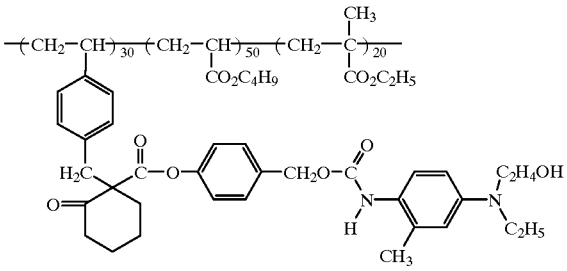
-continued
DEVP-31
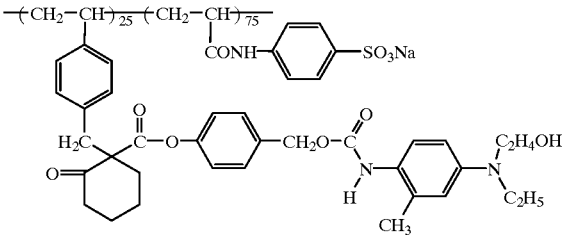
DEVP-32
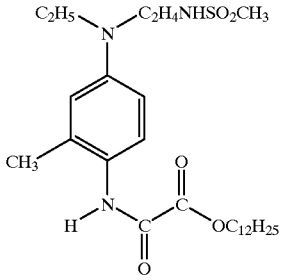
DEVP-33
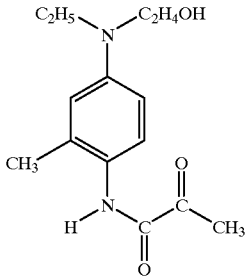
DEVP-34
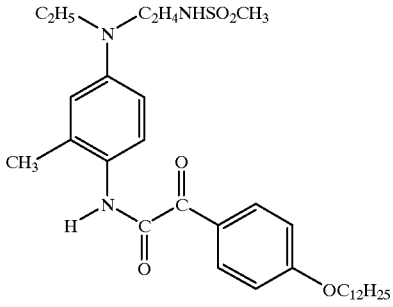
DEVP-35
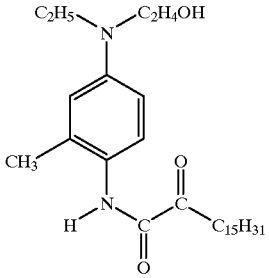

-continued
DEVP-36
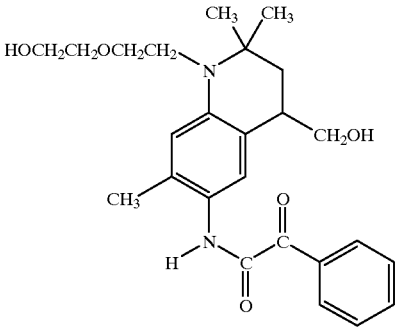
DEVP-37
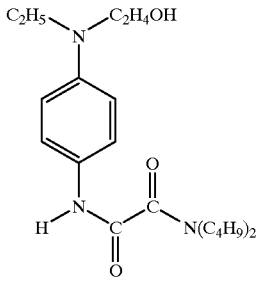
DEVP-38
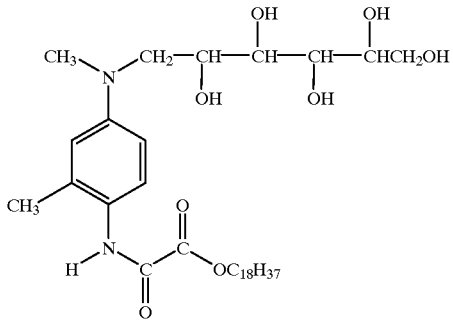
DEVP-39
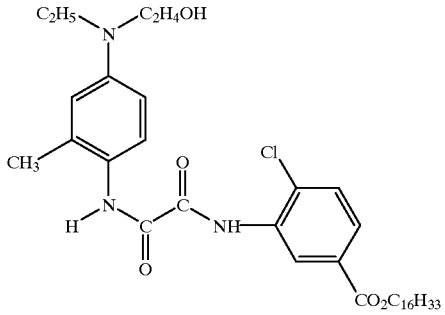
DEVP-40
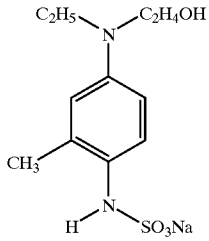
-continued
DEVP-41
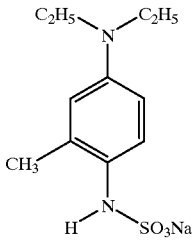
EVP-42
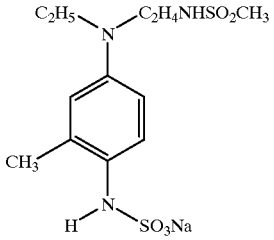
DEVP-43
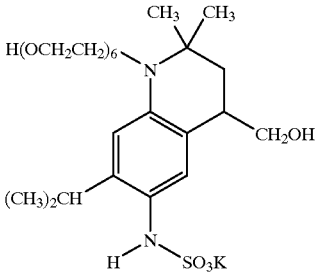
EVP-44
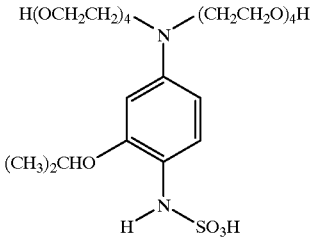
DEVP-45
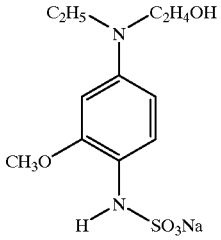
EVP-46
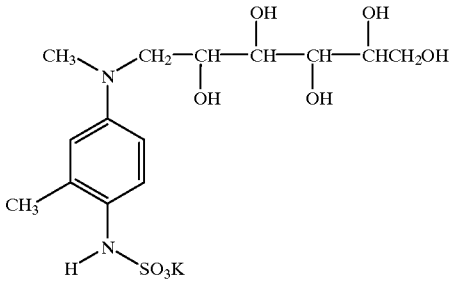

-continued

DEVP-47

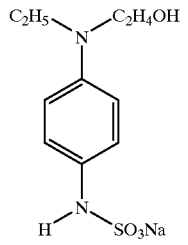

Compounds of U.S. Pat. Nos. 5,242,783 and 4,426,441 and JP-A's 62-227141, 5-257225, 5-249602, 6-43607 and 7-333780, are also preferably employed as the compound of the general formula (6) for use in the present invention.

Any of the compounds of the general formulae (1) to (6), although the addition amount thereof can be varied widely, is preferably used in a molar amount of 0.01 to 100 times, more preferably 0.1 to 10 times, that of a compound capable of performing a coupling reaction with a developing agent in an oxidized form to thereby form a dye (hereinafter referred to as "coupler"), which is used in combination with the compounds represented by formulae (1) to (6).

Of the compounds represented by formulae (1) to (6), compounds represented by formulae (1), (4) and (6) are preferable.

The compounds of the general formulae (1) to (6) can be added to a coating liquid in the form of any of, for example, a solution, powder, a solid fine grain dispersion, an emulsion and an oil protection dispersion. The solid particulate dispersion is obtained by the use of known atomizing means (for example, ball mill, vibration ball mill, sand mill, colloid mill, jet mill or roll mill). In the preparation of the solid particulate dispersion, use may be made of a dispersion auxiliary.

The above compounds are used individually or in combination as the color developing agent or precursor thereof. A different developing agent may be used in each layer. The total use amount of developing agent is in the range of 0.05 to 20 mmol/$m^2$, preferably 0.1 to 10 mmol/$m^2$.

The coupler will now be described. The coupler used in the present invention refers to a compound capable of performing a coupling reaction with an oxidation product of developing agent described above to thereby form a dye.

The couplers preferably used in the present invention are compounds generally termed "active methylenes, 5-pyrazolones, pyrazoloazoles, phenols, naphthols or pyrrolotriazoles". Compounds cited in RD No. 38957 (September 1996), pages 616 to 624, "x. Dye image formers and modifiers", can preferably be used as the above couplers.

The above couplers can be classified into so-termed 2-equivalent couplers and 4-equivalent couplers.

As the group which acts as an anionic split-off group of 2-equivalent couplers, there can be mentioned, for example, a halogen atom (e.g., chloro or bromo), an alkoxy group (e.g., methoxy or ethoxy), an aryloxy group (e.g., phenoxy, 4-cyanophenoxy or 4-alkoxycarbonylphenyloxy), an alkylthio group (e.g., methylthio, ethylthio or butylthio), an arylthio group (e.g., phenylthio or tolylthio), an alkylcarbamoyl group (e.g., methylcarbamoyl, dimethylcarbamoyl, ethylcarbamoyl, diethylcarbamoyl, dibutylcarbamoyl), a heterocyclicarbamoyl (e.g., piperidylcarbamoyl or morpholinocarbamoyl), an arylcarbamoyl group (e.g., phenylcarbamoyl, methylphenylcarbamoyl, ethylphenylcarbamoyl or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl or morpholinosulfamoyl), an arylsulfamoyl group (e.g., phenylsulfamoyl, methylphenylsulfamoyl, ethylphenylsulfamoyl or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl or p-toluenesulfonyl), an alkylcarbonyloxy group (e.g., acetyloxy, propionyloxy or butyroyloxy), an arylcarbonyloxy group (e.g., benzoyloxy, toluyloxy or anisyloxy), and a nitrogen-containing heterocycle (e.g., imidazolyl or benzotriazolyl).

As the group which acts as a cationic split-off group of 4-equivalent couplers, there can be mentioned, for example, a hydrogen atom, a formyl group, a carbamoyl group, a substituted methylene group (the substituent is, for example, an aryl group, a sulfamoyl group, a carbamoyl group, an alkoxy group, an amino group or a hydroxyl group), an acyl group, and a sulfonyl group.

Besides the above compounds described in RD No. 38957, the following couplers can also preferably be employed.

As active methylene couplers, there can be employed couplers represented by the formulae (I) and (II) of EP No. 502,424A; couplers represented by the formulae (1) and (2) of EP No. 513,496A; couplers represented by the formula (I) of claim 1 of EP No. 568,037A; couplers represented by the general formula (I) of column 1, lines 45–55, of U.S. Pat. No. 5,066,576; couplers represented by the general formula (I) of paragraph 0008 of JP-A-4-274425; couplers recited in claim 1 of page 40 of EP No. 498,381A1; couplers represented by the formula (Y) of page 4 of EP No. 447,969A1; and couplers represented by the formulae (II) to (IV) of column 7, lines 36–58, of U.S. Pat. No. 4,476,219.

As 5-pyrazolone magenta couplers, there can preferably be employed compounds described in JP-A's 57-35858 and 51-20826.

As pyrazoloazole couplers, there can preferably be employed imidazo[1,2-b]pyrazoles described in U.S. Pat. No. 4,500,630; pyrazolo[1,5-b][1,2, 4]triazoles described in U.S. Pat. No. 4,540,654; and pyrazolo[5,1-c][1,2,4]triazoles described in U.S. Pat. No. 3,725,067. Of these, pyrazolo[1,5-b][1,2,4]triazoles are most preferred from the viewpoint of light fastness.

Also, there can preferably be employed pyrazoloazole couplers comprising a pyrazolotriazole group having a branched alkyl group directly bonded to 2-, 3- or 6-position thereof as described in JP-A-61-65245; pyrazoloazole couplers having a sulfonamido group in molecules thereof as described in JP-A-61-65245; pyrazoloazole couplers having an alkoxyphenylsulfonamido balast group as described in JP-A-61-147254; pyrazolotriazole couplers having an alkoxy or aryloxy group at 6-position thereof as described in JP-A's 62-209457 and 63-307453; and pyrazolotriazole couplers having a carbonamido group in molecules thereof as described in JP-A-2-201443.

As preferred examples of phenol couplers, there can be mentioned, for example, 2-alkylamino-5-alkylphenol couplers described in U.S. Pat. Nos. 2,369,929, 2,801,171, 2,772,162, 2,895,826 and 3,772,002; 2,5-diacylaminophenol couplers described in U.S. Pat. Nos. 2,772,162, 3,758,308, 4,126,396, 4,334,011 and 4,327,173, DE No. 3,329,729 and JP-A-59-166956; and 2-phenylureido-5-acylaminophenol couplers described in U.S. Pat. Nos. 3,446,622, 4,333,999, 4,451,559 and 4,427,767.

As preferred examples of naphthol couplers, there can be mentioned, for example, 2-carbamoyl-1-naphthol couplers described in U.S. Pat. Nos. 2,474,293, 4,052,212, 4,146,396, 4,228,233 and 4,296,200; and 2-carbamoyl-5-amido-1-naphthol couplers described in U.S. Pat. No. 4,690,889.

As preferred examples of pyrrolotriazole couplers, there can be mentioned those described in EP Nos. 488,248A1, 491,197A1 and 545,300.

Moreover, use can be made of couplers with the condensed ring phenol, imidazole, pyrrole, 3-hydroxypyridine, active methine, 5,5-condensed heterocycle and 5,6-condensed heterocycle structures.

As condensed ring phenol couplers, there can be employed those described in, for example, U.S. Pat. Nos. 4,327,173, 4,564,586 and 4,904,575.

As imidazole couplers, there can be employed those described in, for example, U.S. Pat. Nos. 4,818,672 and 5,051,347.

As pyrrole couplers, there can be employed those described in, for example, JP-A's 4-188137 and 4-190347.

As 3-hydroxypyridine couplers, there can be employed those described in, for example, JP-A-1-315736.

As active methine couplers, there can be employed those described in, for example, U.S. Pat. Nos. 5,104,783 and 5,162,196.

As 5,5-condensed heterocycle couplers, there can be employed, for example, pyrrolopyrazole couplers described in U.S. Pat. No. 5,164,289 and pyrroloimidazole couplers described in JP-A-4-174429.

As 5,6-condensed heterocycle couplers, there can be employed, for example, pyrazolopyrimidine couplers described in U.S. Pat. No. 4,950,585, pyrrolotriazine couplers described in JP-A-4-204730 and couplers described in EP No. 556,700.

In the present invention, besides the above couplers, use can also be made of couplers described in, for example, DE Nos. 3,819,051A and 3,823,049, U.S. Pat. Nos. 4,840,883, 5,024,930, 5,051,347 and 4,481,268, EP Nos. 304,856A2, 329,036, 354,549A2, 374,781A2, 379,110A2 and 386,930A1, JP-A's 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731 and 4-204732.

These couplers are used in an amount of 0.05 to 10 mmol/$m^2$, preferably 0.1 to 5 mmol/$m^2$, for each color.

Furthermore, the following functional couplers may be contained.

As couplers for forming a colored dye with appropriate diffusibility, there can preferably be employed those described in U.S. Pat. No. 4,366,237, GB No. 2,125,570, EP No. 96,873B and DE No. 3,234,533.

As couplers for correcting any unneeded absorption of a colored dye, there can be mentioned yellow colored cyan couplers described in EP No. 456,257A1; yellow colored magenta couplers described in the same EP; magenta colored cyan couplers described in U.S. Pat. No. 4,833,069; colorless masking couplers represented by the formula (2) of U.S. Pat. No. 4,837,136 and represented by the formula (A) of claim 1 of WO 92/11575 (especially, compound examples of pages 36 to 45).

As compounds (including couplers) capable of reacting with a developing agent in an oxidized form to thereby release photographically useful compound residues, there can be mentioned the following:

Development inhibitor-releasing compounds: compounds represented by the formulae (I) to (IV) of page 11 of EP No. 378,236A1, compounds represented by the formula (I) of page 7 of EP No. 436,938A2, compounds represented by the formula (1) of EP No. 568,037A, and compounds represented by the formulae (I), (II) and (III) of pages 5–6 of EP No. 440,195A2;

Bleaching accelerator-releasing compounds: compounds represented by the formulae (I) and (I') of page 5 of EP No. 310,125A2 and compounds represented by the formula (I) of claim 1 of JP-A-6-59411;

Ligand-releasing compounds: compounds represented by LIG-X described in claim 1 of U.S. Pat. No. 4,555,478;

Leuco dye-releasing compounds: compounds 1 to 6 of columns 3 to 8 of U.S. Pat. No. 4,749,641;

Fluorescent dye-releasing compounds: compounds represented by COUP-DYE of claim 1 of U.S. Pat. No. 4,774,181;

Development accelerator or fogging agent-releasing compounds: compounds represented by the formulae (1), (2) and (3) of column 3 of U.S. Pat. No. 4,656,123 and ExZK-2 of page 75, lines 36 to 38, of EP No. 450,637A2; and Compounds which release a group becoming a dye only after splitting off: compounds represented by the formula (I) of claim 1 of U.S. Pat. No. 4,857,447, compounds represented by the formula (1) of JP-A-5-307248, compounds represented by the formulae (I), (II) and (III) of pages 5–6 of EP No. 440,195A2, compounds-ligand-releasing compounds represented by the formula (I) of claim 1 of JP-A-6-59411, and compounds represented by LIG-X described in claim 1 of U.S. Pat. No. 4,555,478.

These functional couplers are preferably used in a molar amount of 0.05 to 10 times, more preferably 0.1 to 5 times, that of the aforementioned couplers which contribute to coloring.

Hydrophobic additives such as couplers and color developing agents can be introduced in layers of lightsensitive materials by known methods such as the method described in U.S. Pat. No. 2,322,027. In the introduction, use can be made of high-boiling organic solvents described in, for example, U.S. Pat. Nos. 4,555,470, 4,536,466, 4,536,467, 4,587,206, 4,555,476 and 4,599,296 and JP-B-3-62256, optionally in combination with low-boiling organic solvents having a boiling point of 50 to 160° C. With respect to dye donating couplers, high-boiling organic solvents, etc., a plurality thereof can be used in combination.

The amount of high-boiling organic solvents is 10 g or less, preferably 5 g or less, and more preferably in the range of 1 to 0.1 g, per g of introduced hydrophobic additive. The amount of high-boiling organic solvents is appropriately 1 milliliter (hereinafter also referred to as "mL") or less, more appropriately 0.5 mL or less, and most appropriately 0.3 mL or less, per g of binder.

Also, use can be made of the method of effecting a dispersion by polymer as described in JP-B-51-39853 and JP-A-51-59943, and the method of adding in the form of a particulate dispersion as described in, for example, JP-A-62-30242.

With respect to compounds which are substantially insoluble in water, besides the above methods, the compounds can be atomized and dispersed in binders.

When hydrophobic compounds are dispersed in hydrophilic colloids, various surfactants can be employed. For example, use can be made of those described as surfactants in JP-A-59-157636, pages 37 and 38, and the above cited RDs. Further, use can be made of phosphoric ester surfactants described in JP-A's 7-56267 and 7-228589 and DE No. 1,932,299A.

In the lightsensitive material of the present invention, it is only required that at least one silver halide emulsion layer be formed on a support. A typical example is a silver halide photographic lightsensitive material having, on its support, at least one lightsensitive layer constituted by a plurality of silver halide emulsion layers which are sensitive to essentially the same color but have different speed. These light-sensitive layers include a unit lightsensitive layer which is sensitive to one of blue light, green light and red light. In a multilayered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color. Various non lightsensitive layers such as an intermediate layer can be formed between the silver halide lightsensitive layers and as the uppermost layer and the lowermost layer. These intermediate layers may contain, e.g., couplers described above, developing agents, DIR compounds, color-mixing inhibitors and dyes. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045. Also, as described in JP-A's-57-112751, 62-200350, 62-206541 and 62-206543, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932 layers can be arranged from the farthest side from a support in the order of blue-sensitive layer/GH/RH/GL/RL. Furthermore, as described in JP-A's-56-25738 and 62-63936 layers can be arranged from the farthest side from a support in the order of blue-sensitive layer/GL/RL/GH/RH.

As described in JP-B-49-15495 three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464.

In addition, the order of high-speed emulsion layer/low-speed emulsion layer/medium-speed emulsion layer or low-speed emulsion layer/medium-speed emulsion layer/high-speed emulsion layer can be adopted.

Furthermore, the arrangement can be changed as described above even when four or more layers are formed.

In order to improve color reproduction, an inter layer effect-donating layer (CL), whose spectral sensitivity distribution is different from those of the main light-sensitive layers of BL, GL and RL, can be arranged adjacent to the main light-sensitive layer or near the main light-sensitive layer, as described in U.S. Pat. Nos. 4,663,271, 4,705,744 and 4,707,436, and JP-A's-62-160448 and 63-89850.

In the present invention, silver halide grains, a coupler capable of donating a dye, and a color developing agent or precursor thereof, although may be contained in a single layer (preferably a lightsensitive silver halide emulsion layer), can be divided and incorporated in separate layers as long as a reaction can be effected therebetween. For example, when the layer containing a color developing agent is separate from the layer containing silver halide, the raw shelf life of lightsensitive material can be prolonged.

Although the relationship between spectral sensitivity and coupler hue of each layer is arbitrary, the use of cyan coupler in a red-sensitive layer, magenta coupler in a green-sensitive layer and yellow coupler in a blue-sensitive layer enables direct projection exposure on conventional color paper or the like.

In the lightsensitive material, various nonlightsensitive layers such as a protective layer, a substratum, an interlayer, a yellow filter layer and an antihalation layer may be provided between aforementioned silver halide emulsion layers, or as an uppermost layer or a lowermost layer. The opposite side of the support can be furnished with various auxiliary layers such as a back layer. For example, the lightsensitive material can be provided with a layer arrangement as described in the above patents; a substratum as described in U.S. Pat. No. 5,051,335; an interlayer containing a solid pigment as described in JP-A's 1-167838 and 61-20943; an interlayer containing a reducing agent and a DIR compound as described in JP-A's 1-120553, 5-34884 and 2-64634; an interlayer containing an electron transfer agent as described in U.S. Pat. Nos. 5,017,454 and 5,139,919 and JP-A-2-235044; a protective layer containing a reducing agent as described in JP-A-4-249245; or a combination of these layers.

The dye which can be used in a yellow filter layer and an antihalation layer is preferably one decolorized or removed at the time of development and hence not contributing to density after processing.

The expression "dye of a yellow filter layer and an antihalation layer is decolorized or removed at the time of development" used herein means that the amount of dye remaining after processing is reduced to ⅓ or less, preferably 1/10 or less, of that just before coating. Dye components may be transferred from the lightsensitive material to the processing material at the time of development. Alternatively, at the time of development, the dye may react so as to convert itself to a colorless compound.

Specifically, there can be mentioned dyes described in EP No. 549,489A and EXF2 to 6 dyes described in JP-A-7-152129. Also, use can be made of solid-dispersed dyes as described in JP-A-8-101487.

The dye can be mordanted in advance with the use of a mordanting agent and a binder. As the mordanting agent and dye, there can be employed those known in the art of photography. For example, use can be made of mordanting agents described in U.S. Pat. No. 4,500,626 columns 58–59, JP-A-61-88256 pages 32–41, and JP-A's 62-244043 and 62-244036.

Further, use can be made of a compound capable of reacting with a reducing agent to thereby release a diffusive dye together with a reducing agent, so that a mobile dye can be released by an alkali at the time of development, transferred to the processing material and removed. Relevant descriptions are found in U.S. Pat. Nos. 4,559,290 and 4,783,396, EP No. 220,746A2, JIII Journal of Technical Disclosure No. 87-6119 and JP-A-8-101487 paragraph nos. 0080 to 0081.

A decolorizable leuco dye or the like can also be employed. For example, JP-A-1-150132 discloses a silver halide lightsensitive material containing a leuco dye which has been colored in advance by the use of a developer of a metal salt of organic acid. The complex of leuco dye and developer is decolorized by heating or reaction with an alkali agent.

Known leuco dyes can be used, which are described in, for example, Moriga and Yoshida, "Senryo to Yakuhin (Dyestuff and Chemical)" 9, page 84 (Kaseihin Kogyo Kyokai (Japan Dyestuff & Chemical Industry Association)); "Shinpan Senryo Binran (New Edition Dyestuff Manual)", page 242 (Maruzen Co., Ltd., 1970); R. Garner "Reports on the Progress of Appl. Chem." 56, page 199 (1971); "Senryo to Yakuhin (Dyestuff and Chemical)" 19, page 230 (Kaseihin Kogyo Kyokai (Japan Dyestuff & Chemical Industry Association), 1974); "Shikizai (Color Material)" 62, 288 (1989); and "Senshoku Kogyo (Dyeing Industry)" 32, 208.

As the developer, there can preferably be employed acid clay developers, phenol formaldehyde resin and metal salts of organic acid. Examples of suitable metal salts of organic acid include metal salts of salicylic acids, metal salts of phenol-salicylic acid-formaldehyde resins, and metal salts of rhodanate and xanthate. zinc is especially preferably used as the metal. With respect to oil-soluble zinc salicylate among the above developers, use can be made of those described in, for example, U.S. Pat. Nos. 3,864,146 and 4,046,941 and JP-B-52-1327.

The coating layers of the lightsensitive material of the present invention are preferably hardened by film hardeners.

Examples of film hardeners include those described in, for example, U.S. Pat. Nos. 4,678,739 column 41 and 4,791,042, and JP-A's 59-116655, 62-245261, 61-18942 and 4-218044. More specifically, use can be made of aldehyde film hardeners (e.g., formaldehyde), aziridine film hardeners, epoxy film hardeners, vinylsulfone film hardeners (e.g., N,N'-ethylene-bis(vinylsulfonylacetamido)ethane), N-methylol film hardeners (e.g., dimethylolurea), and boric acid, metaboric acid or polymer film hardeners (compounds described in, for example, JP-A-62-234157).

These film hardeners are used in an amount of 0.001 to 1 g, preferably 0.005 to 0.5 g, per g of hydrophilic binder.

In the lightsensitive material, use can be made of various antifoggants, photographic stabilizers and precursors thereof. Examples thereof include compounds described in, for example, the aforementioned RDs, U.S. Pat. Nos. 5,089,378, 4,500,627 and 4,614,702, JP-A-64-13564 pages 7–9, 57–71 and 81–97, U.S. Pat. Nos. 4,775,610, 4,626,500 and 4,983,494, JP-A's 62-174747, 62-239148, 1-150135, 2-110557 and 2-178650, and RD No. 17643 (1978) pages 24–25.

These compounds are preferably used in an amount of $5\times10^{-6}$ to $1\times10^{-5}$ mol, more preferably $1\times10^{-5}$ to $1\times10^{-2}$ mol, per mol of silver.

In the lightsensitive material, various surfactants can be used for the purpose of coating aid, frilling amelioration, sliding improvement, static electricity prevention, development acceleration, etc. Examples of surfactants are described in, for example, Public Technology No. 5 (Mar. 22, 1991, issued by Aztek) pages 136–138 and JP-A's 62-173463 and 62-183457.

An organic fluorocompound may be incorporated in the lightsensitive material for the purpose of sliding prevention, static electricity prevention, frilling amelioration, etc. As representative examples of organic fluorocompounds, there can be mentioned fluorinated surfactants described in, for example, JP-B-57-9053 columns 8 to 17 and JP-A's 61-20944 and 62-135826, and hydrophobic fluorocompounds including an oily fluorocompound such as fluoroil and a solid fluorocompound resin such as ethylene tetrafluoride resin. Fluorinated surfactants having a hydrophilic group can also preferably be employed for the purpose of reconciling the wettability and static electricity prevention of lightsensitive material.

It is preferred that the lightsensitive material have sliding properties. A layer containing a sliding agent is preferably provided on both the lightsensitive layer side and the back side. Preferred sliding properties range from 0.25 to 0.01 in terms of kinematic friction coefficient.

By the measurement, there can be obtained the value at 60 cm/min carriage on a stainless steel ball of 5 mm diameter (25° C., 60%RH). Even if the evaluation is made with the opposite material replaced by a lightsensitive layer surface, the value of substantially the same level can be obtained.

Examples of suitable sliding agents include polyorganosiloxanes, higher fatty acid amides, higher fatty acid metal salts and esters of higher fatty acids and higher alcohols. As the polyorganosiloxanes, there can be employed, for example, polydimethylsiloxane, polydiethylsiloxane, polystyrylmethylsiloxane and polymethylphenylsiloxane. The layer to be loaded with the sliding agent is preferably an outermost one of emulsion layers or a back layer. Polydimethylsiloxane and an ester having a long-chain alkyl group are especially preferred. For preventing silver halide pressure marks and desensitization, silicone oil and chlorinated paraffin are preferably used.

In the present invention, further, an antistatic agent is preferably used. As the antistatic agent, there can be mentioned a polymer containing a carboxylic acid and a carboxylic acid salt or sulfonic acid salt, a cationic polymer and an ionic surfactant compound.

Most preferable antistatic agent consists of fine particles of a crystalline metal oxide of $10^7$ Ω·cm or less, preferably $10^5$ Ω·cm or less, volume resistivity with a particle size of 0.001 to 1.0 μm, constituted of at least one member selected from among ZnO, $TiO_2$, $SnO_2$, $Al_2O_{31}$ $In_2O_3$, $SiO_2$, MgO, BaO, $MoO_3$ and $V_2O_5$, or a composite oxide thereof (e.g., Sb, P, B, In, S, Si or C), or fine particles of such a metal oxide or composite oxide thereof in sol form. The content of antistatic agent in the lightsensitive material is preferably in the range of 5 to 500 mg/m$^2$, more preferably 10 to 350 mg/m$^2$. The quantitative ratio of conductive crystalline oxide or composite oxide thereof to binder is preferably in the range of 1/300 to 100/1, more preferably 1/100 to 100/5. The back of the support of the lightsensitive material is preferably coated with a water resistant polymer described in JP-A-8-292514.

The lightsensitive material or later described processing material constitution (including back layer) can be loaded with various polymer latexes for the purpose of film property improvements, such as dimension stabilization, curling prevention, sticking prevention, film cracking prevention and pressure increase desensitization prevention. For example, use can be made of any of polymer latexes described in JP-A's 62-245258, 62-136648 and 62-110066. In particular, when a polymer latex of low glass transition temperature (40° C. or below) is used in a mordant layer, the cracking of the mordant layer can be prevented. Further, when a polymer latex of high glass transition temperature is used in a back layer, a curling preventive effect can be exerted.

In the lightsensitive material of the present invention, a matting agent is preferably contained. The matting agent, although can be contained in the emulsion side or the back side, is most preferably incorporated in an outermost layer of the emulsion side. The matting agent may be soluble, or insoluble, in processing solutions. It is preferred that soluble and insoluble matting agents be used in combination. For example, polymethyl methacrylate, polymethyl methacrylate/methacrylic acid (9/1 or 5/5 in molar ratio) and polystyrene particles are preferred. The particle diameter is preferably in the range of 0.8 to 10 μm, and a narrow particle diameter distribution is preferred. It is preferred that 90% or more of all the particles have diameters which fall within 0.9 to 1.1 times the average particle diameter. For enhancing matting properties, it is also preferred to simultaneously add fine particles of up to 0.8 μm. As such fine particles, there can be mentioned, for example, polymethyl methacrylate (0.2 μm), polymethyl methacrylate/methacrylic acid (9/1 in molar ratio, 0.3 μm), polystyrene particles (0.25 μm) and colloidal silica (0.03 μm).

Specific examples are described in JP-A-61-88256, page 29. In addition, use can be made of compounds described in JP-A's 63-274944 and 63-274952, such as benzoguanamine resin beads, polycarbonate resin beads and AS resin beads. Also, use can be made of compounds described in the aforementioned RDs.

These matting agents, according to necessity, can be dispersed in various binders, as described in the above paragraphs relating to binder, and applied in the form of a dispersion. In particular, the dispersion in various gelatins, for example, acid-processed gelatin, enables easily preparing stable coating liquids. In the preparation, according to necessity, it is preferred to optimize the pH, ionic strength and binder concentration.

Further, the following compounds can be employed:

Dispersion mediums for oil-soluble organic compounds: P-3, 5, 16, 19, 25, 30, 42, 49, 54, 55, 66, 81, 85, 86 and 93 (pages 140–144) of JP-A-62-215272, latexes for impregnation of oil-soluble organic compounds, and latexes described in U.S. Pat. No. 4,199,363;

Scavengers for developing agent in an oxidized form: compounds of the formula (I) of column 2, lines 54–62, of U.S. Pat. No. 4,978,606 (especially, I-(1), (2), (6) and (12) (columns 4–5)), and formula of column 2, lines 5–10, of U.S. Pat. No. 4,923,787 (especially, compound 1 (column 3));

Antistaining agents: formulae (I) to (III) of page 4, lines 30–33, of EP No. 298321A, especially I-47 and 72 and III-1 and 27 (pages 24–48);

Discoloration preventives: A-6, 7, 20, 21, 23, 24, 25, 26, 30, 37, 40, 42, 48, 63, 90, 92, 94 and 164 (pages 69–118) of EP No. 298321A, II-1 to III-23 of columns 25–38 of U.S. Pat. No. 5,122,444, especially III-10, I-1 to III-4 of pages 8–12 of EP No. 471347A, especially II-2, and A-1 to –48 of columns 32 to 40 of U.S. Pat. No. 5,139,931, especially A-39 and -42;

Materials for reducing the use amount of color enhancer and color mixing inhibitor: I-1 to II-15 of pages 5 to 24 of EP No. 411324A, especially I-46;

Formalin scavengers: SCV-1 to –28 of pages 24 to 29 of EP No. 477932A, especially SCV-8;

Film hardeners: H-1, 4, 6, 8 and 14 of page 17 of JP-A-1-214845, compounds (H-1 to –54) of formulae (VII) to (XII) of columns 13 to 23 of U.S. Pat. No. 4,618,573, compounds (H-1 to –76) of the formula (6) of page 8, right lower column, of JP-A-2-214852, especially H-14, and compounds of claim 1 of U.S. Pat. No. 3,325,287;

Development inhibitor precursors: P-24, 37 and 39 (pages 6–7) of JP-A-62-168139, and compounds of claim 1 of U.S. Pat. No. 5,019,492, especially 28 and 29 of column 7;

Antiseptics and mildewproofing agents: I-1 to III-43 of columns 3 to 15 of U.S. Pat. No. 4,923,790, especially II-1, 9, 10 and 18 and III-25;

Stabilizers and antifoggants: I-1 to (14) of columns 6 to 16 of U.S. Pat. No. 4,923,793, especially I-1, 60, (2) and (13), and compounds 1 to 65 of columns 25 to 32 of U.S. Pat. No. 4,952,483, especially 36;

Chemical sensitizers: triphenylphosphine selenides, and compound 50 of JP-A-5-40324;

Dyes: a-1 to b-20, especially a-1, 12, 18, 27, 35, 36 and b-5, of pages 15 to 18, and V-1 to 23, especially V-1, of pages 27 to 29 of JP-A-3-156450, F-I-1 to F-II-43, especially F-I-11 and F-II-8, of pages 33 to 55 of EP No. 445627A, III-1 to 36, especially III-1 and 3, of pages 17 to 28 of EP No. 457153A, microcrystalline dispersions of dye-1 to 124 of pages 8 to 26 of WO 88/04794, compounds 1 to 22, especially compound 1, of pages 6 to 11 of EP No. 319999A, compounds D-1 to 87 (pages 3 to 28) of formulae (1) to (3) of EP No. 519306A, compounds 1 to 22 (columns 3 to 10) of formula (I) of U.S. Pat. No. 4,268,622, and compounds 1 to 31 (columns 2 to 9) of formula (I) of U.S. Pat. No. 4,923,788; and UV absorbents: compounds (18b) to (18r) and 101 to 427 (pages 6 to 9) of formula (1) of JP-A-46-3335, compounds (3) to (66) of formula (I) (pages 10 to 44) and compounds HBT-1 to 10 of formula (III) (page 14) of EP No. 520938A, and compounds (1) to (31) of formula (1) (columns 2 to 9) of EP No. 521823A.

The above various additives such as film hardeners, antifoggants, surfactants, sliding agents, antistatic agents, latexes and matting agents can be incorporated in the processing material, or both the lightsensitive material and the processing material, according to necessity.

In the present invention, as the support of the lightsensitive material, there can be employed a transparent one capable of resisting processing temperatures. Generally, use can be made of photographic supports of paper, synthetic polymers (films), etc. as described in pages 223 to 240 of "Shashinkogaku no Kiso—Gin-en Shashin Hen—(Fundamental of Photographic Technology—Silver Salt Photography—)" edited by The Society of Photographic Science and Technologh of Japan and published by CMC Co., Ltd. (1979). For example, use can be made of supports of polyethylene terephthalate, polyethylene naphthalate, polycarbonate, polyvinyl chloride, polystyrene, polypropylene, polyimide and cellulose (e.g., triacetylcellulose).

Also, use can be made of supports described in, for example, JP-A's 62-253159 pages 29 to 31, 1-161236 pages 14 to 17, 63-316848, 2-22651 and 3-56955 and U.S. Pat. No. 5,001,033. In order to improve optical properties and physical properties, these supports can be subjected to, for example, heat treatment (crystallization degree and orientation control), monoaxial or biaxial drawing (orientation control), blending of various polymers and surface treatment.

When requirements on heat resistance and curling properties are especially strict, supports described in JP-A's 6-41281, 6-43581, 6-51426, 6-51437, 6-51442, 6-82961, 6-82960, 6-123937, 6-82959, 6-67346, 6-118561, 6-266050, 6-202277, 6-175282, 6-118561, 7-219129 and 7-219144 can preferably be employed as the support of the lightsensitive material.

Moreover, a support of a styrene polymer of mainly syndiotactic structure can preferably be employed. The thickness of the supports is preferably in the range of 5 to 200 μm, more preferably 40 to 120 μm.

Surface treatment is preferably performed for adhering the support and the lightsensitive material constituting layers to each other. Examples thereof include chemical, mechanical, corona discharge, flaming, ultraviolet irradiation, high-frequency, glow discharge, active plasma, laser, mixed acid, ozonization and other surface activating treatments. Of these surface treatments, ultraviolet irradiation, flaming, corona discharge and glow discharge treatments are preferred.

Now, the substratum will be described below:

The substratum may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose, gelatin, polyvinyl alcohol and modified polymere of these polymers. Resorcin or p-chlorophenol is used as a support-swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-s-triazine), an epichlorohydrin resin or an active vinyl sulfone compound can be used in the substratum. Also, $SiO_2$, $TiO_2$, inorganic fine grains or polymethyl methacrylate copolymer fine grains (0.01 to 10 μm) may be incorporated therein as a matting agent.

Further, it is preferable to record photographed information and etc. using, as a support, the support having a magnetic recording layer as described in JP-A's 4-124645, 5-40321, 6-35092 and 6-317875.

The magnetic recording layer herein is the one obtained by coating a support with a water-base or organic solvent coating liquid having magnetic material grains dispersed in a binder.

The magnetic material grains for use in the present invention can be composed of any of ferromagnetic iron oxides such as $\gamma Fe_2O_3$, Co coated $\gamma Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of $S_{BET}$. The saturation magnetization (as) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material.

Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million.

For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyhydric alcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 μm, preferably 0.2 to 5 μm, and more preferably from 0.3 to 3 μm. The weight ratio of magnetic material grains to binder is preferably in the range of 0.5:100 to 60:100, more preferably 1:100 to 30:100. The coating amount of magnetic material grains ranges from 0.005 to 3 $g/m^2$, preferably from 0.01 to 2 $g/m^2$, and more preferably from 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The lightsensitive material having the magnetic recording layer is described in U.S. Pat. Nos. 5,336,589, 5,250,404, 5,229,259 and 5,215,874 and EP No. 466,130.

The polyester support preferably used in the present invention will be described below. Particulars thereof together with the below mentioned light-sensitive material, processing, cartridge and working examples are specified in JIII Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol. % are especially preferred. Polyethylene 2,6-naphthalate is most preferred. The average molecular weight thereof ranges from approximately 5,000 to 200,000. The Tg of the polyester for use in the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

The film patrone employed in the present invention will be described below.

The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The weight of the plastic used in each patrone or patrone case preferably ranges from 5 to 15 g.

In addition, a patrone capable of feeding a film out by rotating a spool may be used. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613.

The foregoing lightsensitive material of the present invention can preferably be used in a lens-equipped film unit as described in JP-B-2-32615 and Jpn. Utility Model Appln. KOKOKU Publication No. 3-39784.

The lens-equipped film unit refers to a unit comprising a packaging unit frame fitted in advance with a photographing lens and a shutter and, accommodated therein directly or after being packed in a container, an unexposed color lightsensitive material in sheeted or rolled form, which unit is light-tightly sealed and furnished with an outer packaging.

The packaging case frame is further fitted with a finder, means for lightsensitive material frame feeding, means for holding and ejecting an exposed color lightsensitive material, etc. The finder can be fitted with a parallax compensation support, and the photographing mechanism can be fitted with auxiliary lighting means as described in, for example, Jpn. Utility Model Appln. KOKAI Publication Nos. 1-93723, 1-57738 and 1-57740 and JP-A's 1-93723 and 1-152437.

Because the lightsensitive material used in the invention is accommodated in the packaging unit frame, the humidity within the packaging unit frame is preferably conditioned so that the relative humidity at 25° C. is in the range of 40 to 70%, more preferably 50 to 65%. It is preferred that the outer packaging be constituted of a moisture impermeable material, for example, nonwater-absorbent material of 0.1% or less absorptivity as measured in accordance with ASTM testing method D-570. It is especially preferred to employ an aluminum foil laminated sheet or an aluminum foil.

As the container for accommodating the exposed lightsensitive material, provided in the packaging unit frame, there can be employed cartridges for outer packaging unit, or common patrones, for example, any of containers described in JP-A's 54-111822 and 63-194255, U.S. Pat. Nos. 4,832,275 and 4,834,306, and JP-A's 2-124564, 3-155544 and 2-264248. The employed film of lightsensitive material can be of the 110-size, 135-size, half size thereof, or 126-size.

The plastic material employed for constituting the packaging unit can be produced by various methods, such as addition polymerization of an olefin having a carbon to carbon double bond, ring-opening polymerization of a few-member cyclic compound, polycondensation (condensation polymerization) or polyaddition of a plurality of polyfunctional compounds, and addition condensation of a phenol derivative, a urea derivative or a melamine derivative and an aldehyde compound.

As the silver halide solvent, there can be employed known compounds. For example, there can preferably be employed thiosulfates, sulfites, thiocyanates, thioether compounds described in JP-B-47-11386, compounds having a 5- or 6-membered imide group, such as uracil or hydantoin, described in JP-A-8-179458, compounds having a carbon to sulfur double bond as described in JP-A-53-144319, and mesoionic thiolate compounds such as trimethyltriazolium thiolate as described in Analytica Chimica Acta, vol. 248, pages 604 to 614 (1991). Also, compounds which can fix and stabilize silver halide as described in JP-A-8-69097 can be used as the silver halide solvent.

These silver halide solvents may be used individually. Also, preferably, a plurality thereof can be used in combination.

The silver halide solvents may be added to the coating liquid in the form of a solution in a solvent such as water, methanol, ethanol, acetone, dimethylformamide or methylpropylglycol, or an alkali or acid aqueous solution, or a solid particulate dispersion.

In the present invention, after an image is formed on a light-sensitive material, a color image is formed on another recording material on the basis of the information of the first image. The method can be normal projection exposure using a light-sensitive material such as color paper. However, it is preferable to photoelectrically read image information by density measurement of transmitted light, convert the read information into a digital signal, perform image processing for the signal, and output the image onto another recording material by using the processed signal. The material onto which the image is to be output can be a subliming thermosensible recording material, full-color direct thermosensible recording material, inkjet material, or electrophotographic material, as well as a light-sensitive material using a silver halide.

In the present invention, a light-sensitive material and a processing member can be used together when the light-sensitive material is developed. Although the use of the processing member has the following advantages, it complicates the system and increases the processing variation. Therefore, for the object of the present invention, i.e., to easily provide a high-sensitivity, rapid light-sensitive material processing method, an image forming method using no processing member is preferred.

In the present invention, organic metal salts can also be favorably used as oxidizers together with light-sensitive silver halide emulsions. Of these organic metal salts, organic silver salt is most preferably used.

An organosilver salt which can be employed in the present invention is one that is relatively stable when exposed to light but forms a silver image when heated at 80° C. or higher in the presence of exposed photo-catalyst (for example, latent image of lightsensitive silver halide) and a reducing agent. The organosilver salt may be any organic substance containing a source capable of reducing silver ions. A silver salt of organic acid, especially a silver salt of long-chain aliphatic carboxylic acid (having 10 to 30, preferably 15 to 28, carbon atoms), is preferred. A complex of organic or inorganic silver salt containing a ligand having a complex stability constant of 4.0 to 10.0 is also preferred. A silver supply material can preferably constitute about 5 to 30% by weight of each image forming layer.

Preferred organosilver salts include silver salts of organic compounds having a carboxyl group. Examples thereof include silver salts of aliphatic carboxylic acids and silver salts of aromatic carboxylic acids, to which however the present invention is in no way limited. Preferred examples of aliphatic carboxylic acid silver salts include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Also, use can be made of silver salts of compounds containing a mercapto or thione group or derivatives thereof. Preferred examples of these compounds include silver salt of 3-mercapto-4-phenyl-1,2,4-triazole, silver salt of 2-mercaptobenzimidazole, silver salt of 2-mercapto-5-aminothiadiazole, silver salt of 2-(ethylglycolamido) benzothiazole, thioglycolic acid silver salts such as silver salt of s-alkylthioglycolic acid (wherein the alkyl group has 12 to 22 carbon atoms), dithiocarboxylic acid silver salts such as silver salt of dithioacetic acid, thioamide silver salt, silver salt of 5-carboxyl-1-methyl-2-phenyl-4-thiopyridine, mercaptotriazine silver salt, silver salt of 2-mercaptobenzoxazole, silver salts of U.S. Pat. No. 4,123,274 including silver salts of 1,2,4-mercaptothiazole derivatives such as silver salt of 3-amino-5-benzylthio-1,2,4-thiazole, and thione compound silver salts such as silver salt of 3-(3-carboxyethyl)-4-methyl-4-thiazoline-2-thione described in U.S. Pat. No. 3,301,678. Further, use can be made of compounds containing an imino group. Preferred examples of these compounds include benzotriazole silver salts and derivatives thereof, for example, benzotriazole silver salts such as silver salt of methylbenzotriazole and silver salts of halogenated benzotriazoles such as silver salt of 5-chlorobenzotriazole, silver salts of 1,2,4-triazole or 1-H-tetrazole described in U.S. Pat. No. 4,220,709, and silver salts of imidazole and imidazole derivatives. Still further, use can be made of various silver acetylide compounds as described in, for example, U.S. Pat. Nos. 4,761,361 and 4,775,613. These organosilver salts may be used in combination.

Preferred particular examples of organosilver salts for use in the present invention are set forth in JP-A-1-100177, which are silver salts obtained by reacting at least one member selected from among the compounds of the following general formulae (I), (II) and (III) with a silver ion supplier such as silver nitrate.

(I)

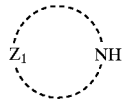

(II)

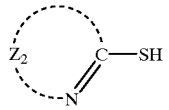

(III)

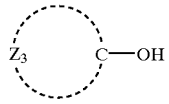

In the formulae, each of $Z_1$, $Z_2$ and $Z_3$ independently represents an atomic group required for forming a 5 to 9-membered heterocycle, which heterocycle includes a monoheterocycle and a condenced polyheterocycle. Herein, the heterocycle comprehends a product of condensation of a heterocycle with a benzene ring or naphthalene ring.

The compound for use in the production of the organosilver salt in the present invention will be described in detail below.

In the general formula (I), $Z_1$ represents an atomic group required for forming a 5 to 9-membered (especially, 5-, 6- or 9-membered) heterocycle. As the heterocycle completed by $Z_1$ of the general formula (I), a 5-, 6- or 9-membered heterocycle containing at least one nitrogen atom is preferred. More preferred is a 5-, 6- or 9-membered heterocycle containing two or more nitrogen atoms, or containing at least one nitrogen atom together with an oxygen atom or sulfur atom. Herein, the heterocycle comprehends a product of condensation with a benzene ring or naphthalene ring. The heterocycle formed with $Z_1$ may have a substituent. As the substitiuents those generally known as a substituent capable of substituting to a heterocycle or a benzene ring may be enumerated. Examples of such compounds include benzotriazoles, benzotriazoles described in, for example, JP-A-58-118638 and JP-A-58-118639, benzimidazoles, pyrazoloazoles described in JP-A-62-96940 {for example, 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles}, triazoles, 1H-tetrazoles, carbazoles, saccharins, imidazoles and 6-aminopurines.

Among the compounds of the general formula (I), the compounds of the following general formula (I-1) are preferred.

(I-1)

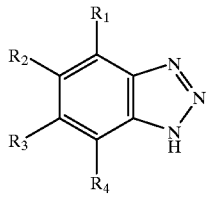

In the formula, each of $R_1$, $R_2$, $R_3$ and $R_4$ independently represents a hydrogen atom, a halogen atom, an alkyl group, an aralkyl group, an alkenyl group, an alkoxy group, an aryl group, a hydroxy group, a sulfo group or a salt thereof (for example, sodium salt, potassium salt or ammonium salt), a carboxy group or a salt thereof (for example, sodium salt, potassium salt or ammonium salt), —CN, —$NO_2$, —NRR', —COOR, —CONRR', —$NHSO_2R$ or —$SO_2NRR'$ (provided that each of R and R' represents a hydrogen atom, an alkyl group, an aryl group or an aralkyl group).

Examples of the compounds of the general formula (I) include benzotriazole, 4-hydroxybenzotriazole, 5-hydroxybenzotriazole, 4-sulfobenzotriazole, 5-sulfobenzotriazole, sodium benzotriazole-4-sulfonate, sodium benzotriazole-5-sulfonate, potassium benzotriazole-4-sulfonate, potassium benzotriazole-5-sulfonate, ammonium benzotriazole-4-sulfonate, ammonium benzotriazole-5-sulfonate, 4-carboxybenzotriazole, 5-carboxybenzotriazole, 4-sulfo-5-benzenesulfonamidobenzotriazole, 4-sulfo-5-hydroxycarbonylmethoxybenzotriazole, 4-sulfo-5-ethoxycarbonylmethoxybenzotriazole, 4-hydroxy-5-carboxybenzotriazole, 4-sulfo-5-carboxymethylbenzotriazole, 4-sulfo-5-ethoxycarbonylmethylbenzotriazole, 4-sulfo-5-phenylbenzotriazole, 4-sulfo-5-(p-nitrophenyl) benzotriazole, 4-sulfo-5-(p-sulfophenyl)benzotriazole, 4-sulfo-5-methoxy-6-chlorobenzotriazole, 4-sulfo-5-chloro-6-carboxybenzotriazole, 4-carboxy-5-chlorobenzotriazole, 4-carboxy-5-methylbenzotriazole, 4-carboxy-5-nitrobenzotriazole, 4-carboxy-5-aminobenzotriazole, 4-carboxy-5-methoxybenzotriazole, 4-hydroxy-5-aminobenzotriazole, 4-hydroxy-5-acetamidobenzotriazole, 4-hydroxy-5-benzenesulfonamidobenzotriazole, 4-hydroxy-5-hydroxycarbonylmethoxybenzotriazole, 4-hydroxy-5-ethoxycarbonylmethoxybenzotriazole, 4-hydroxy-5-carboxymethylbenzotriazole, 4-hydroxy-5-ethoxycarbonylmethylbenzotriazole, 4-hydroxy-5-phenylbenzotriazole, 4-hydroxy-5-(p-nitrophenyl) benzotriazole, 4-hydroxy-5-(p-sulfophenyl)benzotriazole, 4-sulfo-5-chlorobenzotriazole, 4-sulfo-5-methylbenzotriazole, 4-sulfo-5-methoxybenzotriazole, 4-sulfo-5-cyano benzotriazole, 4-sulfo-5-aminobenzotriazole, 4-sulfo-5-acetoamidobenzotriazole, sodium benzotriazole-4-caroboxylate, sodium benzotriazole-5-caroboxylate, potassium benzotriazole-4-caroboxylate, potassium benzotriazole-5-caroboxylate, ammonium benzotriazole-4-caroboxylate, ammonium benzotriazole-5-caroboxylate, 5-carbamoylbenzotriazole, 4-sulfamoylbenzotriazole, 5-carboxy-6-hydroxybenzotriazole, 5-carboxy-7-sulfobenzotriazole, 4-hydroxy-5-sulfobenzotriazole, 4-hydroxy-7-sulfobenzotriazole, 5,6-dicarboxybenzotriazole, 4,6-dihydroxybenzotriazole, 4-hydroxy-5-chlorobenzotriazole, 4-hydroxy-5-methylbenzotriazole, 4-hydroxy-5-methoxybenzotriazole, 4-hydroxy-5-nitrobenzotriazole, 4-hydroxy-5-cyanobenzotriazole, 4-carboxy-5-acetamidobenzotriazole, 4-carboxy-5-ethoxycarbonylmethoxybenzotriazole, 4-carboxy-5-carboxymethylbenzotriazole, 4-carboxy-5-phenylbenzotriazole, 4-carboxy-5-(p-nitrophenyl) benzotriazole, 4-carboxy-5-methyl-7-sulfobenzotriazole, imidazole, benzimidazole, pyrazole, urazole, 6-aminopurine,

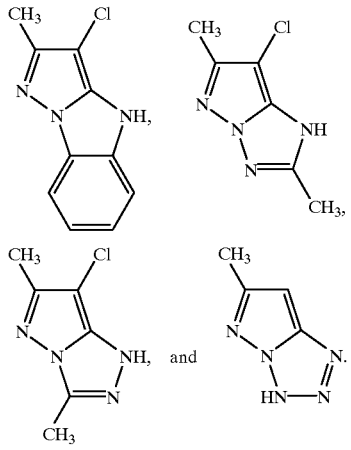

These may be used in combination.

The compounds represented by the general formula (II) will now be described. In the general formula (II), $Z_2$ represents an atomic group required for forming a 5 to 9-membered (especially, 5-, 6- or 9-membered) heterocycle, which heterocycle includes a monoheterocycle and a condenced polyheterocycle. As the heterocycle completed by $Z_2$ of the above general formula (including C and N of the formula), a 5-, 6- or 9-membered heterocycle containing at least one nitrogen atom is preferred. More preferred is a 5-, 6- or 9-membered heterocycle containing two or more nitrogen atoms, or containing at least one nitrogen atom together with an oxygen atom or sulfur atom. Herein, the heterocycle comprehends a product of condensation with a benzene ring or naphthalene ring. The heterocycle formed with $Z_2$ may have a substituent. As the substitiuents those generally known as a substituent capable of substituting to a heterocycle or a benzen ring may be enumerated. Examples of such compounds include 2-mercaptobenzothiazoles, 2-mercaptobenzimidazoles, 2-mercaptothiadiazoles and 5-mercaptotetrazoles.

Particular examples of the compounds represented by the above general formula (II) include the following compounds, to which, however, the present invention is in no way limited.

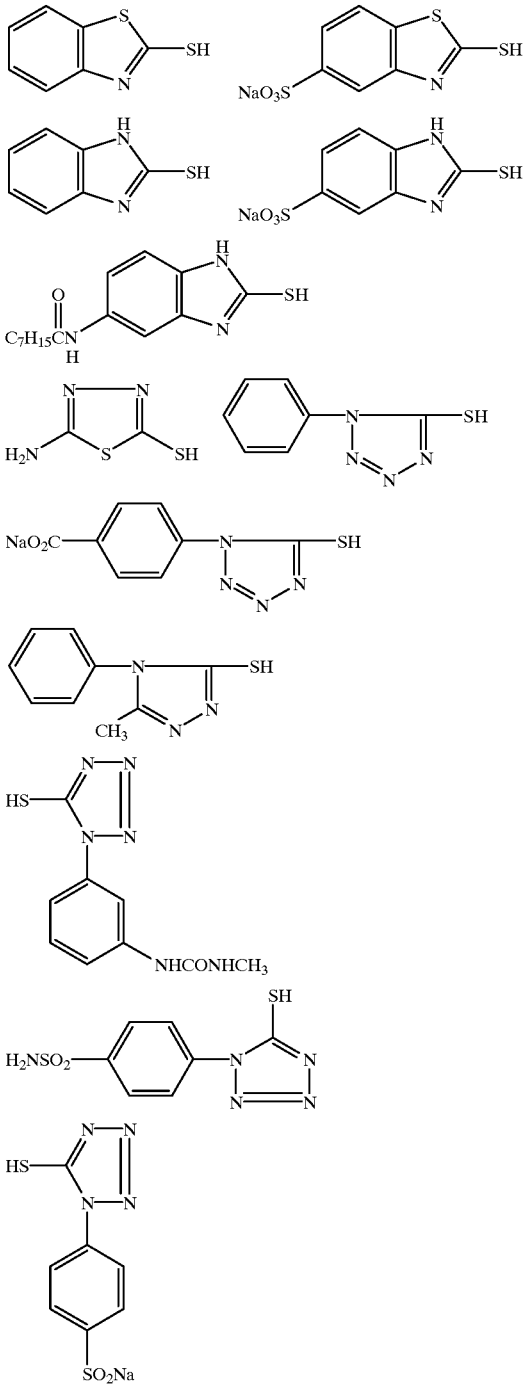

The compounds represented by the general formula (III) will be described below. In the general formula (III), $Z_3$ represents an atomic group required for forming a 5 to 9-membered (especially, 5-, 6- or 9-membered) heterocycle. As the heterocycle completed by $Z_3$ of the above general formula, a 5-, 6- or 9-membered heterocycle containing at least one nitrogen atom is preferred. More preferred is a 5-, 6- or 9-membered heterocycle containing two or more nitrogen atoms, or containing at least one nitrogen atom together with an oxygen atom or sulfur atom. Herein, the heterocycle comprehends a product of condensation with a benzene ring, or naphthalene ring, or nitrogen-containing heterocycle having various substituents. Examples of the compounds include hydroxytetrazaindenes, hydroxypyrimidines, hydroxypyridazines an hydroxypyrazines.

Specific examples of the compounds represented by the above general formula (III) include the following compounds, to which, however, the present invention is in no way limited.

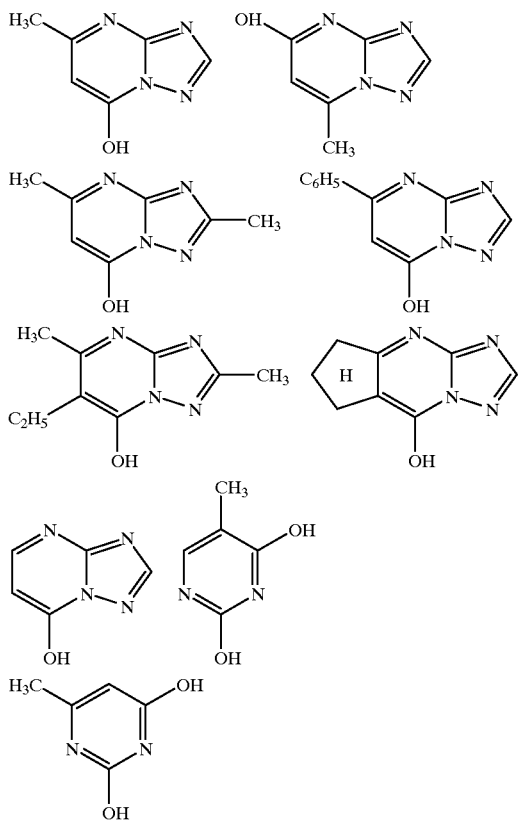

Among the compounds represented by the general formula (I), (II) and (III), the compounds represented by formula (I) is preferable.

In the present invention, any of the compounds of the general formulae (I), (II) and (III) is mixed with silver nitrate in an appropriate reaction medium to thereby form a silver salt of the compound (hereinafter referred to as "organosilver salt"). Part of the silver nitrate can be replaced by another silver ion supplier (for example, silver chloride or silver acetate).

The method of adding such reactants is arbitrary. A compound of the general formula (I) to (III) may first be placed in a reaction vessel and thereafter loaded with silver nitrate. Alternatively, silver nitrate may first be placed in a reaction vessel and thereafter loaded with a compound of the general formula (I) to (III). Still alternatively, part of a compound of the general formula (I) to (III) may first be placed in a reaction vessel, subsequently loaded with part of silver nitrate, and thereafter sequentially loaded with the remainders of compound of the general formula (I) to (III) and silver nitrate. Still alternatively, silver nitrate and a compound of the general formula (I) to (III) may be simultaneously placed in a reaction vessel. During the reaction, it is preferred to effect agitation.

Although the compound of the general formula (I) to (III) is generally mixed with silver nitrate at a proportion of 0.8 to 100 mol per mol of silver, the reactants can be used outside this proportion, depending on the type of the compound. The addition rates of silver nitrate and the compound may be regulated so as to control the silver ion concentration during the reaction.

The layer to be loaded with the organosilver salt is not limited, and the organosilver salt may be incorporated in one layer or a plurality of layers. Incorporating the organosilver salt in a layer containing no lightsensitive silver halide emulsion in the hydrophilic colloid layers provided on the side having silver halide emulsion layers, such as a protective layer, an interlayer or a so-called substratum disposed between a support and an emulsion layer, is preferred from the viewpoint of storage life improvement.

This organosilver salt can be jointly used in an amount of 0.01 to 10 mol, preferably 0.05 to 1 mol, per mol of lightsensitive silver halide that is contained in the layer to which the organosilver salt is added. It is appropriate for the coating amount total of lightsensitive silver halide and organosilver salt to be in the range of 0.01 to 10 $g/m^2$, preferably 0.1 to 6 $g/m^2$, in terms of silver.

The silver halide emulsion and/or organosilver salt of the present invention can be protected against additional fogging and can be stabilized so as to be free from sensitivity change during storage by the use of an antifoggant, a stabilizer and a stabilizer precursor. As a suitable antifoggant, stabilizer and stabilizer precursor which can be used individually or in combination, there can be mentioned thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechols described in U.S. Pat. No. 3,235,652; oximes, nitrons and nitroindazoles described in GB No. 623,448; polyvalent metal salts described in U.S. Pat. No. 2,839,405; thiuronium salts described in U.S. Pat. No. 3,220,839; palladium, platinum and gold salts described in U.S. Pat. Nos. 2,566,263 and 2,597,915; halogenated organic compounds described in U.S. Pat. Nos. 4,108,665 and 4,442,202; triazines described in U.S. Pat. Nos. 4,128,557, 4,137,079, 4,138,365 and 4,459,350; and phosphorus compounds described in U.S. Pat. No. 4,411,985.

As the antifoggant which can preferably be employed in the present invention, there can be mentioned organic halides, examples of which include compounds disclosed in, for example, JP-A's 50-119624, 50-120328, 51-121332, 54-58022, 56-70543, 56-99335, 59-90842, 61-129642, 62-129845, 6-208191, 7-5621, 7-2781 and 8-15809, and U.S. Pat. Nos. 5,340,712, 5,369,000 and 5,464,737.

The antifoggant for use in the present invention may be added to a coating liquid in the form of any of, for example, a solution, powder and a solid particulate dispersion. The solid particulate dispersion is obtained by the use of known atomizing means (for example, ball mill, vibration ball mill, sand mill, colloid mill, jet mill or roller mill). In the preparation of the solid particulate dispersion, use may be made of a dispersion auxiliary.

The lightsensitive material of the present invention may contain benzoic acids for attaining sensitivity enhancement and fogging prevention. Although the benzoic acids for use in the present invention may be any of benzoic acid derivatives, compounds described in, for example, U.S. Pat. Nos. 4,784,939 and 4,152,160 can be mentioned as providing preferable forms of structures thereof.

The benzoic acids used in the present invention, although may be added to any portion of the lightsensitive material, is preferably added to a layer of the lightsensitive layer side, more preferably to a layer containing an organosilver salt. The timing of addition of benzoic acids of the present invention may be any stage of the process for preparing the coating liquid. In the addition to a layer containing an organosilver salt, the addition, although may be effected at any stage between preparation of the organosilver salt to preparation of the coating liquid, is preferably carried out between preparation of the organosilver salt and just before coating operation. With respect to the method of adding the benzoic acids of the present invention, the addition may be effected in the form of, for example, any of powder, a solution and a particulate dispersion. Also, the addition may be effected in the form of a solution wherein the benzoic acid is mixed with other additives such as a sensitizing dye and a reducing agent. The addition amount of benzoic acids of the present invention, although not limited, is preferably in the range of $1\times10^{-6}$ to 2 mol, more preferably $1\times10^{-3}$ to 0.5 mol, per mol of silver.

The lightsensitive material of the present invention can be loaded with a mercapto compound, a disulfide compound and a thione compound in order to control development through development inhibition or acceleration, to enhance spectral sensitization efficiency and to prolong storage life before and after development.

When a mercapto compound is used in the present invention, although the structure thereof is not limited, compounds of the formula Ar—SM or Ar—S—S—Ar can preferably be employed. In the formula, M represents a hydrogen atom or an alkali metal atom. Ar represents an aromatic ring group or condensed aromatic ring group containing at least one nitrogen, sulfur, oxygen, selenium or tellurium atom. Preferably, the heteroaromatic ring includes benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. This heteroaromatic ring may have a substituent, for example, selected from the group consisting of halogens (e.g., Br and Cl), hydroxy, amino, carboxy, alkyls (e.g., alkyls having 1 or more carbon atoms, preferably 1 to 4 carbon atoms) and alkoxies (e.g., alkoxies having 1 or more carbon atoms, preferably 1 to 4 carbon atoms). As mercapto-substituted heteroaromatic compounds, there can be mentioned, for example, 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobisbenzothiazole, 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole and 2-mercapto-4-phenyloxazole. The present invention is however in no way limited to these.

The addition amount of these mercapto compounds is preferably in the range of 0.001 to 1.0 mol, more preferably 0.01 to 0.3 mol, per mol of silver in an emulsion layer.

In the lightsensitive material of the present invention. there can preferably be employed a silver halide solvent. For example, there can preferably be employed thiosulfates, sulfites, thiocyanates, thioether compounds described in JP-B-47-11386, compounds having a 5- or 6-membered imido group, such as uracil or hydantoin, described in JP-A-8-179458, compounds having a carbon to sulfur double bond as described in JP-A-53-144319, and mesoionic thiolate compounds such as trimethyltriazolium thiolate as described in Analytica Chimica Acta, vol. 248, pages 604 to 614 (1991). Also, compounds which can fix and stabilize silver halides as described in JP-A-8-69097 can be used as the silver halide solvent.

The amount of silver halide solvent contained in the lightsensitive material is in the range of 0.01 to 100 mmol/$m^2$, preferably 0.1 to 50 mmol/$m^2$, and more preferably 10 to 50 mmol/$m^2$. The molar ratio of silver halide solvent to coating silver of the lightsensitive material is in the range of 1/20 to 20, preferably 1/10 to 10, and more preferably 1/3 to 3. The silver halide solvent may be added to a solvent such as water, methanol, ethanol, acetone, dimethylformamide or methylpropylglycol, or an alkali or acid aqueous solution, or may be dispersed so as to form a solid particulate dispersion, before the addition to the coating liquid. The silver halide solvents may be used individually. Also, preferably, a plurality thereof can be used in combination.

Hydrophilic binders are preferably employed in the lightsensitive material and constituent layers thereof. Examples of such hydrophilic binders include those described in the aforementioned RDs and JP-A-64-13546, pages 71 to 75. In particular, transparent or translucent hydrophilic binders are preferred, which can be constituted of, for example, natural compounds including a protein, such as gelatin or a gelatin derivative, and a polysaccharide, such as a cellulose derivative, starch, gum arabic, dextran or pulluran, or synthetic polymer compounds, such as polyvinyl alcohol, modified polyvinyl alcohol (e.g., terminal-alkylated Poval MP 103 and MP 203 produced by Kuraray Co., Ltd.), polyvinylpyrrolidone and an acrylamide polymer. Also, use can be made of highly water absorbent polymers described in, for example, U.S. Pat. No. 4,960,681 and JP-A-62-245260, namely, a homopolymer of any of vinyl monomers having —COOM or —$SO_3M$ (M is a hydrogen atom or an alkali metal), a copolymer of such vinyl monomers and a copolymer of any of such vinyl monomers and another vinyl monomer (e.g., sodium methacrylate or ammonium methacrylate, Sumikagel L-5H produced by Sumitomo Chemical Co., Ltd.). These binders can be used individually or in combination. A combination of gelatin and other binder mentioned above is preferred. The gelatin can be selected from among lime-processed gelatin, acid-processed gelatin and delimed gelatin which is one having a content of calcium and the like reduced in conformity with variable purposes. These can be used in combination.

Polymer latex is also preferably employed as the binder in the present invention. The polymer latex is a dispersion of a water-insoluble hydrophobic polymer, as fine particles, in a water-soluble dispersion medium. The state of dispersion is not limited, and the polymer latex may be any of a latex comprising a polymer emulsified in a dispersion medium, a product of emulsion polymerization, a micelle dispersion, and a molecular dispersion of molecular chains per se due to the presence of partial hydrophilic structure in polymer molecule. With respect to the polymer latex for use in the present invention, reference can be made to, for example, Gosei Jushi Emulsion (Synthetic Resin Emulsion) edited by Taira Okuda and Hiroshi Inagaki and published by Polymer Publishing Association (1978), Gosei Latex no Oyo (Application of Synthetic Latex) edited by Takaaki Sugimura, Yasuo Kataoka, Soichi Suzuki and Keiji Kasahara and published by Polymer Publishing Association (1993), and Gosei Latex no Kagaku (Chemistry of Synthetic Latex) edited by Soichi Muroi and published by Polymer Publishing Association (1970).

The average particle diameter of dispersed particles is preferably in the range of about 1 to 50,000 nm, more preferably 5 to 1000 nm. The particle diameter distribution of dispersed particles is not particularly limited. The polymer species for use in the polymer latex are, for example, an acrylic resin, a vinyl acetate resin, a polyester resin, a polyurethane resin, a rubber resin, a vinyl chloride resin, a vinylidene chloride resin and a polyolefin resin.

The polymer may be linear, or branched, or crosslinked. The polymer may be a product of polymerization of a single monomer, known as a homopolymer, or a copolymer obtained by polymerization of a plurality of monomers. The copolymer may be a random copolymer, or a block copolymer.

The molecular weight of the polymer is preferably in the range of about 0.5 to 1000 thousand, more preferably 1 to 500 thousand, in terms of number average molecular weight Mn. When the molecular weight is extremely small, the mechanical strength of the lightsensitive layer is unsatisfactory. On the other hand, when the molecular weight is extremely large, the film forming properties are unfavorably deteriorated.

With respect to the polymer of the polymer latex for use in the present invention, the equilibrium water content at 25° C. 60% RH is preferably 2 wt % or less, more preferably 1 wt % or less. The lower limit of the equilibrium water content, although not particularly limited, is preferably 0.01 wt %, more preferably 0.03 wt %. With respect to the definition and measuring method of the equilibrium water content, reference can be made to, for example, "Kobunshi Kogaku Koza 14, Kobunshi zairyo Shiken Hou (Polymer Engineering Course 14, Polymer Material Testing Method)" edited by the Society of Polymer Science of Japan and published by Chijin Shokan Co., Ltd. Specifically, the equilibrium water content at 25° C. 60% RH can be expressed by the following formula including the mass $W_1$ of polymer humidity-controlled and equilibrated in an atmosphere of 25° C. 60% RH and the mass $W_0$ of polymer absolutely dried at 25° C.:

$$\text{"Equilibrium water content at 25° C. 60\% } RH\text{"} = \{(W_1 - W_0)/W_0\} \times 100 \ (wt\ \%).$$

These polymers are commercially available, and the following polymers can be used in the form of polymer latexes. Examples of acrylic resins include Cevian A-4635, 46583 and 4601 (produced by Daicel Chemical Industries, Ltd.) and Nipol Lx811, 814, 821, 820 and 857 (produced by Nippon Zeon Co., Ltd.). Examples of polyester resins include Finetex ES650, 611, 675 and 850 (produced by Dainippon Ink & Chemicals, Inc.) and WD-size, WMS (produced by Eastman Chemical). Examples of polyurethane resins include Hydran AP10, 20, 30 and 40 (produced by Dainippon Ink & Chemicals, Inc.). Examples of rubber resins include Lacstar 7310K, 3307B, 4700H, 7132C and DS206 (produced by Dainippon Ink & Chemicals, Inc.) and Nipol Lx416, 433, 410, 438C and 2507 (produced by Nippon Zeon Co., Ltd.). Examples of vinyl chloride resins include G351 and G576 (produced by Nippon Zeon Co., Ltd.). Examples of vinylidene chloride resins include L502 and L513 (produced by Asahi Chemical Industry Co., Ltd.). Examples of olefin resins include Chemipearl S120 and SA100 (produced by Mitsui Chemicals, Inc.). These polymers may be used individually in the form of polymer latexes, or a plurality thereof may be blended together before use according to necessity.

It is especially preferred that the polymer latex for use in the present invention consist of a latex of styrene/butadiene copolymer. In the styrene/butadiene copolymer, the weight ratio of styrene monomer units to butadiene monomer units is preferably in the range of 50:50 to 95:5. The ratio of styrene monomer units and butadiene monomer units to the whole copolymer is preferably in the range of 50 to 99% by weight. The preferred range of molecular weight thereof is as aforementioned.

As the latex of styrene/butadiene copolymer preferably employed in the present invention, there can be mentioned, for example, commercially available Lacstar 3307B, 7132C and DS206 and Nipol Lx416 and Lx433.

In the present invention, it is appropriate for the coating amount of binder to be in the range of 1 to 20 g/m$^2$, preferably 2 to 15 g/m$^2$, and more preferably 3 to 12 g/m. In the binder, the gelatin content is in the range of 50 to 100%, preferably 70 to 100%.

To supply a base necessary in the development step as described in JP-A-10-301247, a processing member having a processing layer which contains a base or a base precursor can be used. This processing member can also be given functions of excluding air during heat development, preventing volatilization of components from a light-sensitive material, supplying processing components other than a base to a light-sensitive material, and removing components (e.g., a yellow filter dye and an antihalation dye) in a light-sensitive material which are unnecessary after development or removing unnecessary components produced during development.

As a support and binder of the processing member, materials similar to those of a light-sensitive material can be used. A mordant can be added to the processing member for the purpose of removing the above-mentioned dyes and for other purposes. Any mordants known in the field of photography can be used, and examples are mordants described in, e.g., U.S. Pat. No. 450,626, columns 58 and 59, JP-A-61-88256, pp. 32 to 41, JP-A-62-244043, and JP-A-62-244036. A dye-receiving polymer compound described in U.S. Pat. No. 4,463,079 can also be used. Additionally, a heat solvent can be contained.

A base or a base precursor can be contained in the processing layer of the processing member. The base can be either an organic base or an inorganic base, and any of materials can be used as the base precursor.

In heat development using the processing member, it is preferable to use a slight amount of water to promote development, promote transfer of processing components, and promote diffusion of unnecessary components. Practical examples are described in U.S. Pat. Nos. 4,704,245 and 4,470,445 and JP-A-61-238056. This water can also contain an inorganic alkaline metal salt, an organic base, a low-boiling-point solvent, a surfactant, an antifoggant, a compound which forms a complex together with a sparingly soluble metal salt, a mildewproofing agent, and an antifungus agent. As the water, any commonly used water can be used. Practical examples are distilled water, tap water, well water, and mineral water. In a heat development apparatus using the light-sensitive material and processing member of the present invention, water can be used only once and then thrown away or circulated and repetitively used. In the latter case, water containing components flowing out from the material is used. It is also possible to use apparatuses and water described in, e.g., JP-A's-63-144354, 63-144355, 62-38460, and 3-210555. Water can be given to one or both of the light-sensitive material and processing member. The use amount is preferably equivalent to 1/10 to the same as an amount required to maximally swell all coating films (except back layers) of the light-sensitive material and processing member. As a method of giving water, a method described in, e.g., JP-A-62-253159, page (5) or JP-A-63-85544 can be preferably used. It is also possible to confine a solvent in microcapsules or previously incorporate a solvent in the form of a hydrate into one or both of the light-sensitive material and processing member. The temperature of water to be given can be 30° C. to 60° C. as described in, e.g., JP-A-63-85544.

When heat development is to be performed in the presence of a small amount of water, it is possible to use a method of generating a base by the combination of a basic metal compound sparing soluble in water and a compound (complex forming compound) which can cause a complex formation reaction by using metal ions constructing the basic metal compound and water as media, as described in EP210,660 and U.S. Pat. No. 4,740,445. When this method is used, it is desirable to add the basic metal compound sparingly soluble in water to the light-sensitive material and the complex forming compound to the processing member, in respect of raw stock storability.

EXAMPLE

Examples of the present invention will be described below, which, however, in no way limit the scope of the present invention.

Example 1

Silver halide emulsions Em-A to Em-O were prepared by the following processes.

(Preparation of Em-A)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 6 g of KBr was added and heated to 75° C., and the mixture was ripened. After the completion of ripening, 35 g of succinated gelatin was added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 $\mu$m (grain size) AgI fine grain emulsion was simultaneously added while conducting a flow rate increase so that the silver iodide content was 3.8 mol %, and the silver potential was maintained at −25 mV.

Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. The temperature was regulated to 40° C., and 5.6 g, in terms of KI, of the following compound 1 was added. Further, 64 mL of a 0.8 M aqueous sodium sulfite solution was added. Still further, an aqueous solution of NaOH was added to thereby increase the pH to 9.0, and held undisturbed for 4 min so that iodide ions were rapidly formed. The pH was returned to 5.5 and the temperature to 55° C., and 1 mg of sodium benzenethiosulfonate was added. Further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

Compound 1

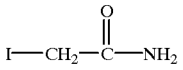

The calcium, magnesium and strontium contents of the thus obtained emulsion were measured by ICP emission spectrochemical analysis. The contents thereof were 15, 2 and 1 ppm, respectively.

The emulsion was heated to 56° C. First, 1 g, in terms of Ag, of an emulsion of 0.05 $\mu$m (grain size) pure AgBr fine grains was added to thereby effect shell covering. Subsequently, the following sensitizing dyes 1, 2 and 3 in the form of solid fine dispersion were added in respective amounts of $5.85\times10^{-4}$ mol, $3.06\times10^{-4}$ mol and $9.00\times10^{-6}$ mol per mol of silver. Under the preparative conditions specified in Table 1, inorganic salts were dissolved in ion-exchanged water, and each of the sensitizing dyes was added. Each sensitizing dye was dispersed at 60° C. for 20 min under agitation at 2000 rpm by means of a dissolver blade. Thus, the solid fine dispersions of sensitizing dyes 1, 2 and 3 were obtained. When, after the addition of the sensitizing dyes, the sensitizing dye adsorption reached 90% of the saturated adsorption amount, calcium nitrate was added so that the calcium concentration became 250 ppm. The adsorption amount of the sensitizing dyes was determined by separating the mixture into a solid layer and a liquid layer (supernatant) by centrifugal precipitation and measuring the difference between the amount of initially added sensitizing dyes and the amount of sensitizing dyes present in the supernatant to thereby calculate the amount of adsorbed sensitizing dyes. After the addition of calcium nitrate, potassium thiocyanate, chloroauric acid, sodium thiosulfate, N,N-dimethylselenourea and compound 4 were added to thereby effect the optimum chemical sensitization. N,N-dimethylselenourea was added in an amount of $3.40\times10^{-6}$ mol per mol of silver. Upon the completion of the chemical sensitization, the following compounds 2 and 3 were added to thereby obtain emulsion Em-A.

TABLE 1

| Sensitizing dye | Amount of sensitizing dye | $NaNO_3$/ $Na_2SO_4$ | Water | Dispersing time | Dispersing temperature |
|---|---|---|---|---|---|
| 1 | 3 parts by weight | 0.8 parts by weight/ 3.2 parts by weight | 43 parts by weight | 20 min | 60° C. |
| 2/3 | 4 parts by weight/ 0.12 parts by weight | 0.6 parts by weight/ 2.4 parts by weight | 42.8 parts by weight | 20 min | 60° C. |

Sensitizing dye 1

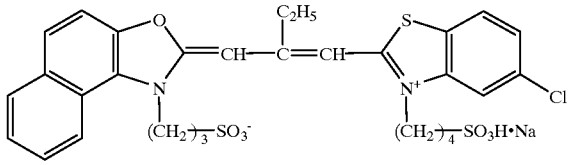

Sensitizing dye 2

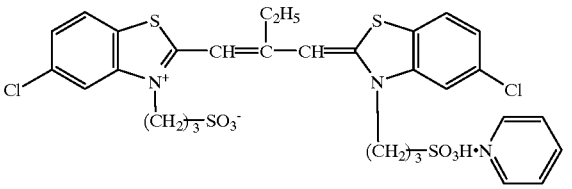

Sensitizing dye 3

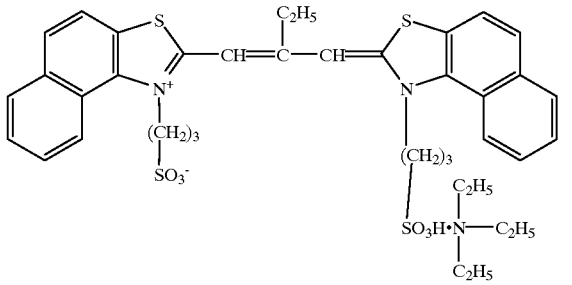

Compound 2

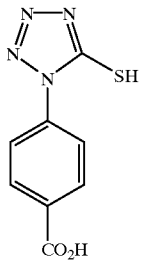

Compound 3

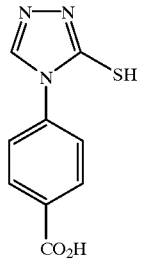

Compound 4

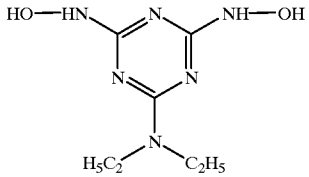

(Preparation of Em-B)

Emulsion Em-B was prepared in the same manner as the emulsion Em-A, except that the amount of KBr added after nucleation was changed to 5 g, that the succinated gelatin was changed to a trimellitated gelatin whose trimellitation ratio was 98%, the gelatin containing methionine in an amount of 35 μmol per g and having a molecular weight of 100,000, that the compound 1 was changed to the following compound 5 whose addition amount in terms of KI was 8.0 g, that the amounts of sensitizing dyes 1, 2 and 3 added prior to the chemical sensitization were changed to $6.50\times10^{-4}$ mol, $3.40\times10^{-4}$ mol and $1.00\times10^{-5}$ mol, respectively, and that the amount of N,N-dimethylselenourea added at the time of chemical sensitization was changed to $4.00\times10^{-6}$ mol.

Compound 5

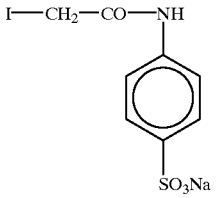

(Preparation of Em-C)

Emulsion Em-C was prepared in the same manner as the emulsion Em-A, except that the amount of KBr added after nucleation was changed to 1.5 g, that the succinated gelatin was changed to a phthalated gelatin whose phthalation ratio was 97%, the gelatin containing methionine in an amount of 35 μmol per g and having a molecular weight of 100,000, that the compound 1 was changed to the following compound 6 whose addition amount in terms of KI was 7.1 g, that the amounts of sensitizing dyes 1, 2 and 3 added prior to the chemical sensitization were changed to $7.80\times10^{-4}$ mol, $4.08\times10^{-4}$ mol and $1.20\times10^{-5}$ mol, respectively, and that the amount of N,N-dimethylselenourea added at the time of chemical sensitization was changed to $5.00\times10^{-6}$ mol.

Compound 6

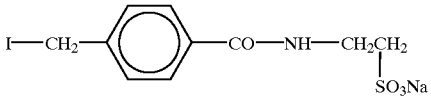

(Preparation of Em-E)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 6 g of KBr was added and heated to 75° C., and the mixture was ripened. After the completion of ripening, 15 g of succinated gelatin and 20 g of the above trimellitated gelatin were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8 mol %, and the silver potential was maintained at −25 mV.

Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. KBr was added so that the potential became −60 mV. Thereafter, 1 mg of sodium benzenethiosulfonate was added, and, further, 13 g of lime-processed gelatin having a calcium concentration of 1 ppm was added. After the completion of the addition, while continuously adding 8.0 g, in terms of KI, of AgI fine grain emulsion of 0.008 μm grain size (equivalent sphere diameter) (prepared by, just prior to addition, mixing together an aqueous solution of a low-molecular-weight gelatin whose molecular weight was 15,000, an aqueous solution of $AgNO_3$ and an aqueous solution of KI in a separate chamber furnished with a magnetic coupling induction type agitator as described in JP-A-10-43570), an aqueous solution of KBr and 250 mL of an aqueous solution containing 70 g of $AgNO_3$ were added over a period of 20 min with the potential maintained at −60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-A, except that the sensitizing dyes 1, 2 and 3 were changed to the following sensitizing dyes 4, 5 and 6, respectively, whose addition amounts $7.73\times10^{-4}$ mol, $1.65\times10^{-4}$ mol and $6.20\times10^{-5}$ mol, respectively. Thus, Emulsion Em-E was obtained.

Sensitizing dye 4

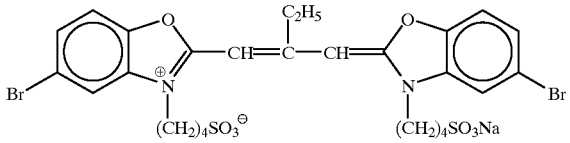

Sensitizing dye 5

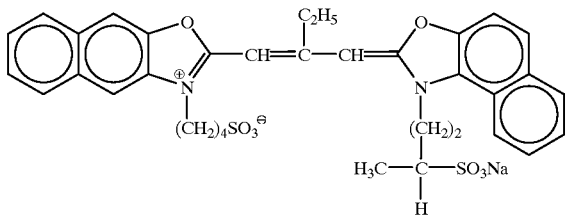

-continued

Sensitizing dye 6

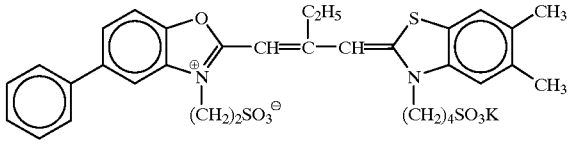

(Preparation of Em-F)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 5 g of KBr was added and heated to 75° C., and the mixture was ripened. After the completion of ripening, 20 g of succinated gelatin and 15 g of phthalated gelatin were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 $\mu$m (grain size) AgI fine grain emulsion was simultaneously added while conducting a flow rate increase so that the silver iodide content was 3.8 mol %, and the silver potential was maintained at −25 mV.

Still further, an aqueous solution of KBr and 132 mL of an aqueous solution containing 35 g of $AgNO_3$ were added by the double jet method over a period of 7 min. An aqueous solution of KBr was added so as to regulate the potential to −60 mV. Thereafter, 9.2 g, in terms of KI, of a 0.03 $\mu$m (grain size) AgI fine grain emulsion was added. 1 mg of sodium benzenethiosulfonate was added, and, further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-B, except that the sensitizing dyes 1, 2 and 3 were changed to the sensitizing dyes 4, 5 and 6, respectively, whose addition amounts were $8.50\times10^{-4}$ mol, $1.82\times10^{-4}$ mol and $6.82\times10^{-5}$ mol, respectively. Thus, Emulsion Em-F was obtained.

(Preparation of Em-G)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 1.5 g of KBr was added and heated to 75° C., and the mixture was ripened. After the completion of ripening, 15 g of the above trimellitated gelatin and 20 g of the above phthalated gelatin were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 $\mu$m (grain size) AgI fine grain emulsion was simultaneously added while conducting a flow rate increase so that the silver iodide content was 3.8 mol %, and the silver potential was maintained at −25 mV.

Still further, an aqueous solution of KBr and 132 mL of an aqueous solution containing 35 g of $AgNO_3$ were added by the double jet method over a period of 7 min. The addition of the aqueous solution of KBr was regulated so that the potential became −60 mV. Thereafter, 7.1 g, in terms of KI, of a 0.03 $\mu$m (grain size) AgI fine grain emulsion was added. 1 mg of sodium benzenethiosulfonate was added, and, further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-C, except that the sensitizing dyes 1, 2 and 3 were changed to the sensitizing dyes 4, 5 and 6, respectively, whose addition amounts were $1.00\times10^{-3}$ mol, $2.15\times10^{-4}$ mol and $8.06\times10^{-5}$ mol, respectively. Thus, Emulsion Em-G was obtained.

(Preparation of Em-J)

Emulsion Em-J was prepared in the same manner as the emulsion Em-B, except that the sensitizing dyes added prior to the chemical sensitization were changed to the following sensitizing dyes 7 and 8 whose addition amounts were $7.65\times10^{-4}$ mol and $2.74\times10^{-4}$ mol, respectively.

Senstizing dye 7

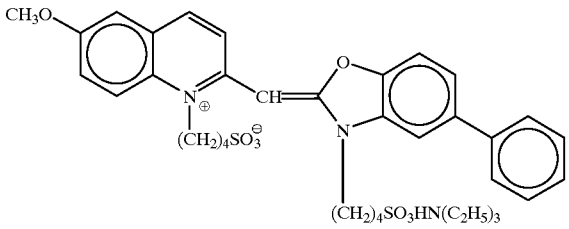

Sensitizing dye 8

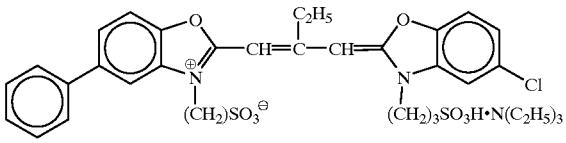

(Preparation of Em-L)

(Preparation of Silver Bromide Seed Crystal Emulsion)

A silver bromide tabular emulsion having an average equivalent sphere diameter of 0.6 μm and an aspect ratio of 9.0 and containing 1.16 mol of silver and 66 g of gelatin per kg of emulsion was prepared.

(Growth Step 1)

0.3 g of a modified silicone oil was added to 1250 g of an aqueous solution containing 1.2 g of potassium bromide and a succinated gelatin whose succination ratio was 98%. The above silver bromide tabular emulsion was added in an amount containing 0.086 mol of silver and, while maintaining the temperature at 78° C., agitated. Further, an aqueous solution containing 18.1 g of silver nitrate and 5.4 mol, per added silver, of the above 0.037 μm silver iodide fine grains were added. During this period, also, an aqueous solution of potassium bromide was added by double jet while regulating the addition so that the pAg was 8.1.

(Growth Step 2)

2 mg of sodium benzenethiosulfonate was added, and thereafter 0.45 g of disodium salt of 3,5-disulfocatechol and 2.5 mg of thiourea dioxide were added.

Further, an aqueous solution containing 95.7 g of silver nitrate and an aqueous solution of potassium bromide were added by double jet while increasing the flow rate over a period of 66 min. During this period, the above 0.037 μm silver iodide fine grains were added in an amount of 7.0 mol % per silver that is added during the double jet addition mentioned above. The amount of potassium bromide added by double jet was regulated so that the pAg was 8.1. After the completion of the addition, 2 mg of sodium benzenethiosulfonate was added.

(Growth step 3)

An aqueous solution containing 19.5 g of silver nitrate and an aqueous solution of potassium bromide were added by double jet over a period of 16 min. During this period, the amount of the aqueous solution of potassium bromide was regulated so that the pAg was 7.9.

(Addition of Sparingly Soluble Silver Halide Emulsion 4)

The above host grains were adjusted to 9.3 in pAg with the use of an aqueous solution of potassium bromide. Thereafter, 25 g of the above 0.037 μm silver iodide fine grain emulsion was rapidly added within a period of 20 sec.

(Formation of Outermost Shell Layer 5)

Further, an aqueous solution containing 34.9 g of silver nitrate was added over a period of 22 min.

The obtained emulsion consisted of tabular grains having an average aspect ratio of 9.8 and an average equivalent sphere diameter of 1.4 μm, wherein the average silver iodide content was 5.5 mol %.

(Chemical Sensitization)

The emulsion was washed, and a succinated gelatin whose succination ratio was 98% and calcium nitrate were added. At 40° C., the pH and pAg were adjusted to 5.8 and 8.7, respectively. The temperature was raised to 60° C., and $5\times10^{-3}$ mol of 0.07 μm silver bromide fine grain emulsion was added. 20 min later, the following sensitizing dyes 9, 10 and 11 were added. Thereafter, potassium thiocyanate, chloroauric acid, sodium thiosulfate, N,N-dimethylselenourea and compound 4 were added to thereby effect the optimum chemical sensitization. Compound 3 was added 20 min before the completion of the chemical sensitization, and compound 7 was added at the completion of the chemical sensitization. The terminology "optimum chemical sensitization" used herein means that the sensitizing dyes and compounds are added in an amount selected from among the range of $10^{-1}$ to $10^{-8}$ mol per mol of silver halide so that the speed exhibited when exposure is conducted at 1/100 becomes the maximum.

Sensitizing dye 9

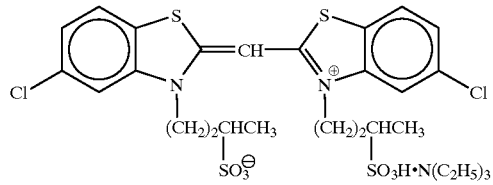

Sensitizing dye 10

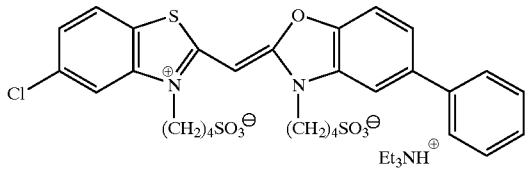

Sensitizing dye 11

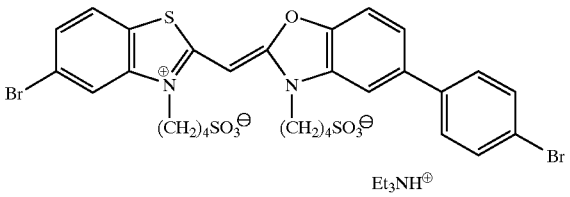

Compound 7

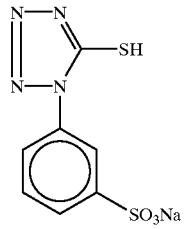

(Preparation of Em-O)

An aqueous solution of gelatin (1250 mL of distilled water, 48 g of deionized gelatin and 0.75 g of KBr) was placed in a reaction vessel equipped with an agitator. The temperature of the aqueous solution was maintained at 70° C. 276 mL of an aqueous solution of $AgNO_3$ (containing 12.0 g of $AgNO_3$) and an equimolar-concentration aqueous solution of KBr were added thereto by the controlled double jet addition method over a period of 7 min while maintaining the pAg at 7.26. The mixture was cooled to 68° C., and 7.6 mL of thiourea dioxide (0.05% by weight) was added.

Subsequently, 592.9 mL of an aqueous solution of $AgNO_3$ (containing 108.0 g of $AgNO_3$) and an equimolar-concentration aqueous solution of a mixture of KBr and KI (2.0 mol % KI) were added by the controlled double jet addition method over a period of 18 min 30 sec while maintaining the pAg at 7.30. Further, 18.0 mL of thiosulfonic acid (0.1% by weight) was added 5 min before the completion of the addition.

The obtained grains consisted of cubic grains having an equivalent sphere diameter of 0.19 $\mu$m and an average silver iodide content of 1.8 mol %.

The obtained emulsion Em-O was desalted and washed by the conventional flocculation method, and re-dispersed. At 40° C., the pH and pAg were adjusted to 6.2 and 7.6, respectively.

The resultant emulsion Em-O was subjected to the following spectral and chemical sensitization.

Based on silver, $3.37\times10^{-4}$ mol/mol of each of sensitizing dye 10, sensitizing dye 11 and sensitizing dye 12, $8.82\times10^{-4}$ mol/mol of KBr, $8.83\times10^{-5}$ mol/mol of sodium thiosulfate, $5.95\times10^{-4}$ mol/mol of potassium thiocyanate and $3.07\times10^{-5}$ mol/mol of potassium chloroaurate were added. Ripening thereof was performed at 68° C. for a period, which period was regulated so that the speed exhibited when exposure was conducted at 1/100 became the maximum.

Sensitizing dye 12

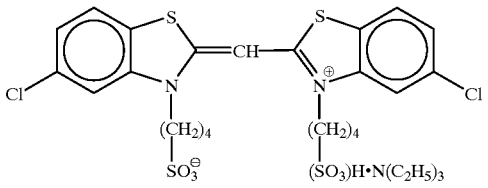

(Preparation of Em-A')

Em-A' was prepared in the same manner as Em-A, except for the following changes.

Nonmodified gelatin (conventional alkali-terated ossein gelatin) was used in place of sucinated gelatin. The potential at the second-stage and third-stage $AgNO_3$ additions was maintained at 0 mV in place of −25 mV.

Not only were the amounts of sensitizing dyes changed in conformity with the surface area of grains to thereby attain the optimum spectral sensitization but also the amounts of chemical sensitizers were optimally regulated.

(Preparation of Em-A")

Em-A" was prepared in the same manner as Em-A, except for the following changes.

Acid-treated gelatin (treated with $H_2O_2$) was used in place of sucinated gelatin. The potential at the second-stage and third-stage $AgNO_3$ additions was maintained at −50 mV in place of −25 mV.

Not only were the amounts of sensitizing dyes changed in conformity with the surface area of grains to thereby attain the optimum spectral sensitization but also the amounts of chemical sensitizers were optimally regulated.

(Preparation of Em-B')

Em-B' was prepared in the same manner as Em-A, except for the following changes.

The amount of KBr added after nucleation was changed to 5 g.

Nonmodified gelatin was used in place of succinated gelatin. The potential at the second-stage and third-stage $AgNO_3$ additions was maintained at 0 mV in place of −25 mV.

Not only were the amounts of sensitizing dyes changed in conformity with the surface area of grains to thereby attain the optimum spectral sensitization but also the amounts of chemical sensitizers were optimally regulated.

(Preparation of Em-C')

Em-C' was prepared in the same manner as Em-C, except for the following changes.

Nonmodified gelatin was used in place of the replacement of succinated gelatin by phthalated gelatin.

Not only were the amounts of sensitizing dyes changed in conformity with the surface area of grains to thereby attain the optimum spectral sensitization but also the amounts of chemical sensitizers were optimally regulated.

(Preparation of Em-E')

Em-E' was prepared in the same manner as Em-E, except for the following changes.

35 g of nonmodified gelatin was used in place of the succinated gelatin and trimellitated gelatin. The potential at the second-stage and third-stage $AgNO_3$ additions was maintained at 0 mV in place of −25 mV.

Not only were the amounts of sensitizing dyes changed in conformity with the surface area of grains to thereby attain the optimum spectral sensitization but also the amounts of chemical sensitizers were optimally regulated.

(Preparation of Em-F')

Em-F' was prepared in the same manner as Em-F, except for the following changes.

35 g of nonmodified gelatin was used in place of the succinated gelatin and trimellitated gelatin. The potential at the second-stage and third-stage $AgNO_3$ additions was maintained at 0 mV in place of −25 mV.

Not only were the amounts of sensitizing dyes changed in conformity with the surface area of grains to thereby attain the optimum spectral sensitization but also the amounts of chemical sensitizers were optimally regulated.

(Preparation of Em-G')

Em-G' was prepared in the same manner as Em-G, except for the following changes.

35 g of nonmodified gelatin was used in place of the succinated gelatin and trimellitated gelatin.

Not only were the amounts of sensitizing dyes changed in conformity with the surface area of grains to thereby attain the optimum spectral sensitization but also the amounts of chemical sensitizers were optimally regulated.

(Preparation of Em-J')

Em-J' was prepared in the same manner as Em-J, except for the following changes.

Sensitizing dyes 7, 8 were added before the chemical sensitization in place of the sensitizing dyes 1, 2, and 3.

Not only were the amounts of sensitizing dyes changed in conformity with the surface area of grains to thereby attain the optimum spectral sensitization but also the amounts of chemical sensitizers were optimally regulated.

(Preparation of Em-L')

Em-L' was prepared in the same manner as Em-L, except for the following changes.

In the preparation of the silver bromide seed crystal emulsion mentioned above, a silver bromide tabular emulsion of 6.0 aspect ratio was prepared in place of the silver bromide tabular emulsion of 9.0 aspect ratio.

Further, in the growth step 1, in place of the succinated gelatin, an equal amount of nonmodified gelatin was used.

Not only were the amounts of sensitizing dyes changed in conformity with the surface area of grains to thereby attain the optimum spectral sensitization but also the amounts of chemical sensitizers were optimally regulated.

(Em-D, H, I, K, M, and N)

In the preparation of tabular grains, a low-molecular-weight gelatin was used in conformity with Examples of JP-A-1-158426. Gold sensitization, sulfur sensitization and selenium sensitization were carried out in the presence of spectral sensitizing dye listed in Table 2 and sodium thiocyanate in conformity with Examples of JP-A-3-237450. Emulsions D, H, I and K contained the optimum amount of Ir and Fe. For the emulsions M and N, reduction sensitization was carried out with the use of thiourea dioxide and thiosulfonic acid at the time of grain preparation in conformity with Examples of JP-A-2-191938.

TABLE 2

| Emulsion | Sensitizing dye | Addition amount (mol/mol Ag) |
|---|---|---|
| Em-D | Sensitizing dye 1 | $7.07 \times 10^{-4}$ |
| | Sensitizing dye 2 | $3.06 \times 10^{-4}$ |
| | Sensitizing dye 3 | $9.44 \times 10^{-6}$ |
| Em-H | Sensitizing dye 8 | $7.82 \times 10^{-4}$ |
| | Sensitizing dye 13 | $1.62 \times 10^{-4}$ |
| | Sensitizing dye 6 | $2.98 \times 10^{-5}$ |
| Em-I | Sensitizing dye 8 | $6.09 \times 10^{-4}$ |
| | Sensitizing dye 13 | $1.26 \times 10^{-4}$ |
| | Sensitizing dye 6 | $2.32 \times 10^{-5}$ |
| Em-K | Sensitizing dye 7 | $6.27 \times 10^{-4}$ |
| | Sensitizing dye 8 | $2.24 \times 10^{-4}$ |
| Em-M | Sensitizing dye 9 | $2.43 \times 10^{-4}$ |
| | Sensitizing dye 10 | $2.43 \times 10^{-4}$ |
| | Sensitizing dye 11 | $2.43 \times 10^{-4}$ |
| Em-N | Sensitizing dye 9 | $3.77 \times 10^{-4}$ |
| | Sensitizing dye 10 | $3.77 \times 10^{-4}$ |
| | Sensitizing dye 11 | $3.77 \times 10^{-4}$ |
| Em-N' | Sensitizing dye 9 | $3.00 \times 10^{-4}$ |
| | Sensitizing dye 10 | $3.00 \times 10^{-4}$ |
| | Sensitizing dye 11 | $3.00 \times 10^{-4}$ |

Sensitizing dye 13

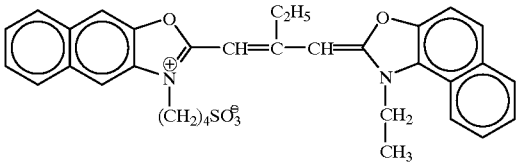

TABLE 3

| Emulsion | Average iodide content (mol %) | Equivalent sphere diameter (μm) | Aspect ratio | Equivalent circle diameter (μm) | Grain thickness (μm) | Shape |
|---|---|---|---|---|---|---|
| Em-A | 4 | 0.92 | 14 | 2 | 0.14 | Tabular |
| Em-B | 5 | 0.8 | 12 | 1.6 | 0.13 | Tabular |
| Em-C | 4.7 | 0.51 | 7 | 0.85 | 0.12 | Tabular |
| Em-D | 3.9 | 0.37 | 4.7 | 0.4 | 0.15 | Tabular |
| Em-E | 5 | 0.92 | 14 | 2 | 0.14 | Tabular |
| Em-F | 5.5 | 0.8 | 12 | 1.6 | 0.13 | Tabular |
| Em-G | 4.7 | 0.51 | 7 | 0.85 | 0.12 | Tabular |
| Em-H | 3.7 | 0.49 | 6.2 | 0.58 | 0.18 | Tabular |

TABLE 3-continued

| Emulsion | Average iodide content (mol %) | Equivalent sphere diameter (μm) | Aspect ratio | Equivalent circle diameter (μm) | Grain thickness (μm) | Shape |
|---|---|---|---|---|---|---|
| Em-I | 2.8 | 0.29 | 1.2 | 0.27 | 0.23 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.4 | 9.8 | 2.6 | 0.27 | Tabular |
| Em-M | 8.8 | 0.64 | 5.2 | 0.85 | 0.16 | Tabular |
| Em-N | 3.7 | 0.37 | 7.2 | 0.55 | 0.12 | Tabular |
| Em-O | 1.8 | 0.19 | — | — | — | Cubic |
| Em-A' | 4 | 0.92 | 6 | 1.51 | 0.25 | Tabular |
| Em-B' | 5 | 0.8 | 5 | 1.20 | 0.24 | Tabular |
| Em-C' | 4.7 | 0.51 | 4 | 0.71 | 0.18 | Tabular |
| Em-E' | 5 | 0.92 | 6 | 1.50 | 0.25 | Tabular |
| Em-F' | 5.5 | 0.8 | 6 | 1.29 | 0.21 | Tabular |
| Em-G' | 4.7 | 0.51 | 4 | 0.71 | 0.18 | Tabular |
| Em-J' | 5 | 0.8 | 6 | 1.29 | 0.21 | Tabular |
| Em-L' | 5.5 | 1.4 | 6 | 2.22 | 0.37 | Tabular |

Referring to Table 3, it was observed, through high-voltage electron microscope, that in the tabular emulsions grains having 10 or more dislocation lines per grain at fringe portio thereof accounted for 50% or more (grain numerical ratio).

1) Support

The support employed in this Example was prepared by the following procedure.

1) First Layer and Substratum:

Both major surfaces of a 90 μm thick polyethylene naphthalate support were treated with glow discharge under such conditions that the treating ambient pressure was 2.66×10 Pa, the $H_2O$ partial pressure of ambient gas 75%, the discharge frequency 30 kHz, the output 2500 W, and the treating strength 0.5 kV·A·min/m$^2$. This support was coated, in a coating amount of 5 mL/m$^2$, with a coating liquid of the following composition to provide the 1st layer in accordance with the bar coating method described in JP-B-58-4589.

| | |
|---|---|
| Conductive fine grain dispersion ($SnO_2/Sb_2O_5$ grain conc. 10% water dispersion, secondary agglomerate of 0.005 μm diam. primary grains which has an av. grain size of 0.05 μm) | 50 pts.wt. |
| Gelatin | 0.5 pt.wt. |
| Water | 49 pts.wt. |
| Polyglycerol polyglycidyl ether | 0.16 pt.wt. |
| Polyoxyethylene sorbitan monolaurate (polymn. degree 20) | 0.1 pt.wt. |

The support furnished with the first coating layer was wound round a stainless steel core of 20 cm diameter and heated at 110° C. (Tg of PEN support: 119° C.) for 48 hr to thereby effect heat history annealing. The other side of the support opposite to the first layer was coated, in a coating amount of 10 mL/m$^2$, with a coating liquid of the following composition to provide a substratum for emulsion in accordance with the bar coating method.

| | |
|---|---|
| Gelatin | 1.01 pts.wt. |
| Salicylic acid | 0.30 pt.wt. |
| Resorcin | 0.40 pt.wt. |
| Polyoxyethylene nonylphenyl ether (polymn. degree 10) | 0.11 pt.wt. |
| Water | 3.53 pts.wt. |

-continued

| | |
|---|---|
| Methanol | 84.57 pts.wt. |
| n-Propanol | 10.08 pts.wt. |

Furthermore, the following second layer and third layer were superimposed in this sequence on the first layer by coating. Finally, multilayer coating of a color negative lightsensitive material of the composition indicated below was performed on the opposite side. Thus, a transparent magnetic recording medium with silver halide emulsion layers was obtained.

2) Second Layer (Transparent Magnetic Recording Layer):

(1) Dispersion of Magnetic Substance:

1100 parts by weight of Co-coated $\gamma$-$Fe_2O_3$ magnetic substance (average major axis length: 0.25 $\mu$m, SBET: 39 $m^2/g$, Hc: 831, Oe, $\sigma s$: 77.1 emu/g, and $\sigma r$: 37.4 emu/g), 220 parts by weight of water and 165 parts by weight of silane coupling agent (3-(poly(polymerization degree: 10)oxyethyl)oxypropyltrimethoxysilane) were fed into an open kneader, and blended well for 3 hr. The resultant coarsely dispersed viscous liquid was dried at 70° C. round the clock to thereby remove water, and heated at 110° C. for 1 hr. Thus, surface treated magnetic grains were obtained.

Further, in accordance with the following recipe, a composition was prepared by blending by means of the open kneader once more for 4 hr:

| | |
|---|---|
| Thus obtained surface treated magnetic grains | 855 g |
| Diacetylcellulose | 25.3 g |
| Methyl ethyl ketone | 136.3 g |
| Cyclohexanone | 136.3 g |

Still further, in accordance with the following recipe, a composition was prepared by carrying out fine dispersion by means of a sand mill (¼G sand mill) at 2000 rpm for 4 hr. Glass beads of 1 mm diameter were used as medium.

| | |
|---|---|
| Thus obtained blend liquid | 45 g |
| Diacetylcellulose | 23.7 g |
| Methyl ethyl ketone | 127.7 g |
| Cyclohexanone | 127.7 g |

Moreover, in accordance with the following recipe, a magnetic substance containing intermediate liquid was prepared.

(2) Preparation of Magnetic Substance Containing Intermediate Liquid:

| | |
|---|---|
| Thus obtained fine dispersion of magnetic substance | 674 g |
| Diacetylcellulose soln. (solid content 4.34%, solvent: methyl ethyl ketone/cyclohexanone = ⅓) | 24,280 g |
| Cyclohexanone | 46 g |

These were mixed together and agitated by means of a disperser to thereby obtain a "magnetic substance containing intermediate liquid".

An $\alpha$-alumina abrasive dispersion of the present invention was produced in accordance with the following recipe.

(a) Preparation of Sumicorundum AA-1.5 (Average Primary Grain Diameter: 1.5 $\mu$m, Specific Surface Area: 1.3 $m^2/g$) Grain Dispersion

| | |
|---|---|
| Sumicorundum AA-1.5 | 152 g |
| Silane coupling agent KBM903 (produced by Shin-Etsu Silicone) | 0.48 g |
| Diacetylcellulose soln. (solid content 4.5%, solvent: methyl ethyl ketone/cyclohexanone = ⅓) | 227.52 g |

In accordance with the above recipe, fine dispersion was carried out by means of a ceramic-coated sand mill (¼G sand mill) at 800 rpm for 4 hr. Zirconia beads of 1 mm diameter were used as medium.

(b) Colloidal Silic a Grain Dispersion (Fine Grains)

Use was made of "MEK-ST" produced by Nissan Chemical Industries, Ltd.

This is a dispersion of colloidal silica of 0.015 $\mu$m average primary grain diameter in methyl ethyl ketone as a dispersion medium, wherein the solid content is 30%.

(3) Preparation of a Coating Liquid for Second Layer:

| | |
|---|---|
| Thus obtained magnetic substance containing intermediate liquid | 19,053 g |
| Diacetylcellulose soln. (solid content 4.5%, solvent: methyl ethyl ketone/cyclohexanone = ⅓) | 264 g |
| Colloidal silica dispersion "MEK-ST" (dispersion b, solid content: 30%) | 128 g |
| AA-1.5 dispersion (dispersion a) | 12 g |
| Millionate MR-400 (produced by Nippon Polyurethane) diluent (solid content 20%, dilution solvent: methyl ethyl ketone/cyclohexanone = ⅓) | 203 g |
| Methyl ethyl ketone | 170 g |
| Cyclohexanone | 170 g |

A coating liquid obtained by mixing and agitating these was applied in a coating amount of 29.3 mL/$m^2$ with the use of a wire bar. Drying was performed at 110° C. The thickness of magnetic layer after drying was 1.0 $\mu$m.

3) Third Layer (Higher Fatty Acid Ester Sliding Agent Containing Layer)

(1) Preparation of Raw Dispersion of Sliding Agent

The following liquid A was heated at 100° C. to thereby effect dissolution, added to liquid B and dispersed by means of a high-pressure homogenizer, thereby obtaining a raw dispersion of sliding agent.

| | |
|---|---|
| Liquid A: | |
| Compd. of the formula: $C_6H_{13}CH(OH)(CH_2)_{10}COOC_{50}H_{101}$ | 399 pts. wt. |
| Compd. of the formula: $n\text{-}C_{50}H_{101}O(CH_2CH_2O)_{16}H$ | 171 pts. wt. |
| Cyclohexanone | 830 pts. wt. |
| Liquid B: | |
| Cyclohexanone | 8600 pts. wt. |

(2) Preparation of Spherical Inorganic Grain Dispersion

Spherical inorganic grain dispersion (cl) was prepared in accordance with the following recipe.

| | |
|---|---|
| Isopropyl alcohol | 93.54 pts. wt. |
| Silane coupling agent KBM903 (produced by Shin-Etsu Silicone) Compd. 1-1: $(CH_3O)_3Si—(CH_2)_3—NH_2$) | 5.53 pts. wt. |
| Compound 8 set forth below: | 2.93 pts. wt. |

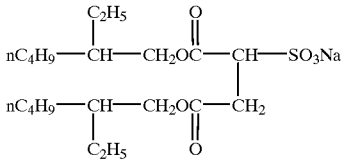

| | |
|---|---|
| Seahostar KEP50 (amorphous spherical silica, av. grain size 0.5 μm, produced by Nippon Shokubai Kagaku Kogyo | 88.00 pts. wt. |
| This composition was agigated for 10 min, and further the following was added. | |
| Diacetone alcohol | 252.93 pts. wt. |

The resultant liquid was dispersed by means of ultrasonic homogenizer "Sonifier 450 (manufactured by Branson)" for 3 hr while cooling with ice and stirring, thereby finishing spherical inorganic grain dispersion c1.

(3) Preparation of Spherical Organic Polymer Grain Dispersion

Spherical organic polymer grain dispersion (c2) was prepared in accordance with the following recipe.

| | |
|---|---|
| XC99-A8808 (produced by Toshiba Silicone Co., Ltd., spherical crosslinked polysiloxane gain, av. grain size 0.9 μm) | 60 pts. wt. |
| Methyl ethyl ketone | 120 pts. wt. |
| Cyclohexanone | 120 pts. wt. |
| (solid content 20%, solvent: methyl ethyl ketone/cyclohexanone = 1/1) | |

This mixture was dispersed by means of ultrasonic homogenizer "Sonifier 450 (manufactured by Branson)" for 2 hr while cooling with ice and stirring, thereby finishing spherical organic polymer grain dispersion c2.

(4) Preparation of Coating Liquid for 3rd Layer

A coating liquid for 3rd layer was prepared by adding the following components to 542 g of the aforementioned raw dispersion of sliding agent:

| | |
|---|---|
| Diacetone alcohol | 5950 g |
| Cyclohexanone | 176 g |
| Ethyl acetate | 1700 g |
| Above Seahostar KEP50 dispersion (c1) | 53.1 g |
| Above spherical organic polymer grain dispersion (c2) | 300 g |
| FC431 (produced by 3M, solid content 50%, solvent: ethyl acetate) | 2.65 g |
| BYK310 (produced by BYK ChemiJapan, solid content 25%) | 5.3 g. |

The above 3rd-layer coating liquid was applied to the 2nd layer in a coating amount of 10.35 mL/m$^2$, dried at 110° C. and further postdried at 97° C. for 3 min.

4) Application of Lightsensitive Layer by Coating:

The thus obtained back layers on its side opposite to the support were coated with a plurality of layers of the following respective compositions, thereby obtaining a color negative film.

(Composition of Lightsensitive Layer)

Main materials used in each of the layers are classified as follows:

| | |
|---|---|
| ExC: cyan coupler, | UV: ultraviolet absorber, |
| ExM: magenta coupler, | HBS: high b.p. org. solvent, |
| ExY: yellow coupler, | H: gelatin hardener. |

(For each specific compound, in the following description, numeral is assigned after the character, and the formula is shown later).

The numeric value given beside the description of each component is for the coating amount expressed in the unit of g/m$^2$. With respect to the silver halide and colloidal silver, the coating amount is in terms of silver quantity.

| | | |
|---|---|---|
| 1st layer (First antihalation layer) | | |
| Black colloidal silver | silver | 0.002 |
| 0.07 μm silver iodobromide emulsion | silver | 0.01 |
| Gelatin | | 0.919 |
| ExM-1 | | 0.066 |
| ExC-1 | | 0.002 |
| ExC-3 | | 0.001 |
| Cpd-2 | | 0.001 |
| F-8 | | 0.010 |
| Solid disperse dye ExF-7 | | 0.10 |
| HBS-1 | | 0.005 |
| HBS-2 | | 0.002 |
| 2nd layer (Second antihalation layer) | | |
| Black colloidal silver | silver | 0.001 |
| Gelatin | | 0.425 |
| ExF-1 | | 0.002 |
| F-8 | | 0.012 |
| Solid disperse dye ExF-7 | | 0.240 |
| HBS-1 | | 0.074 |
| 3rd layer (Inter layer) | | |
| ExC-2 | | 0.001 |
| Cpd-1 | | 0.090 |
| Polyethylacrylate latex | | 0.200 |
| HBS-1 | | 0.100 |
| Gelatin | | 0.700 |
| 4th layer (Low-speed red-sensitive emulsion layer) | | |
| Em-D | silver | 0.560 |
| Em-C' | silver | 0.355 |
| ExC-1 | | 0.180 |
| ExC-2 | | 0.004 |
| ExC-3 | | 0.070 |
| ExC-4 | | 0.115 |
| ExC-5 | | 0.005 |
| ExC-6 | | 0.007 |
| ExC-8 | | 0.045 |
| ExC-9 | | 0.025 |
| Cpd-2 | | 0.020 |
| Cpd-4 | | 0.029 |
| HBS-1 | | 0.110 |
| HBS-5 | | 0.033 |
| Gelatin | | 1.466 |
| 5th layer (Medium-speed red-sensitive emulsion layer) | | |
| Em-B' | silver | 0.422 |
| Em-C' | silver | 0.442 |
| ExC-1 | | 0.150 |
| ExC-2 | | 0.002 |
| ExC-3 | | 0.011 |
| ExC-4 | | 0.107 |
| ExC-5 | | 0.001 |
| ExC-6 | | 0.013 |
| ExC-8 | | 0.012 |
| ExC-9 | | 0.005 |
| Cpd-2 | | 0.038 |
| Cpd-4 | | 0.029 |

-continued

| | | |
|---|---|---|
| HBS-1 | | 0.120 |
| Gelatin | | 1.081 |
| 6th layer (High-speed red-sensitive emulsion layer) | | |
| Em-A' | silver | 1.117 |
| ExC-1 | | 0.176 |
| ExC-3 | | 0.033 |
| ExC-6 | | 0.033 |
| ExC-8 | | 0.113 |
| ExC-9 | | 0.017 |
| Cpd-2 | | 0.060 |
| Cpd-4 | | 0.070 |
| HBS-1 | | 0.324 |
| HBS-2 | | 0.122 |
| Gelatin | | 1.240 |
| 7th layer (Interlayer) | | |
| Cpd-1 | | 0.090 |
| Cpd-6 | | 0.377 |
| Solid disperse dye ExF-4 | | 0.030 |
| HBS-1 | | 0.049 |
| Polyethyl acrylate latex | | 0.088 |
| Gelatin | | 0.897 |
| 8th layer (Layer capable of exerting interlayer effect on red-sensitive layer) | | |
| Em-J' | silver | 0.293 |
| Em-K | silver | 0.302 |
| Cpd-4 | | 0.034 |
| ExM-2 | | 0.121 |
| ExM-3 | | 0.007 |
| ExM-4 | | 0.023 |
| ExY-1 | | 0.013 |
| ExY-4 | | 0.039 |
| ExC-7 | | 0.023 |
| HBS-1 | | 0.085 |
| HBS-3 | | 0.003 |
| HBS-5 | | 0.030 |
| Gelatin | | 0.617 |
| 9th layer (Low-speed green-sensitive emulsion layer) | | |
| Em-H | silver | 0.323 |
| Em-G' | silver | 0.339 |
| Em-I | silver | 0.084 |
| ExM-2 | | 0.399 |
| ExM-3 | | 0.029 |
| ExY-1 | | 0.022 |
| ExC-7 | | 0.009 |
| HBS-1 | | 0.100 |
| HBS-3 | | 0.013 |
| HBS-4 | | 0.086 |
| HBS-5 | | 0.547 |
| Cpd-5 | | 0.014 |
| Gelatin | | 1.488 |
| 10th layer (Medium-speed green-sensitive emulsion layer) | | |
| Em-F' | silver | 0.435 |
| ExM-2 | | 0.029 |
| ExM-3 | | 0.004 |
| ExM-4 | | 0.025 |
| ExY-3 | | 0.006 |
| ExC-6 | | 0.015 |
| ExC-7 | | 0.015 |
| ExC-8 | | 0.013 |
| HBS-1 | | 0.060 |
| HBS-3 | | 0.002 |
| HBS-5 | | 0.023 |
| Cpd-5 | | 0.002 |
| Gelatin | | 0.430 |
| 11th layer (High-speed green-sensitive emulsion layer) | | |
| Em-E' | silver | 0.802 |
| ExC-6 | | 0.003 |
| ExC-8 | | 0.015 |
| ExM-1 | | 0.012 |
| ExM-2 | | 0.0131 |
| ExM-3 | | 0.023 |

-continued

| | | |
|---|---|---|
| ExM-4 | | 0.019 |
| ExY-3 | | 0.003 |
| Cpd-3 | | 0.004 |
| Cpd-4 | | 0.006 |
| Cpd-5 | | 0.010 |
| HBS-1 | | 0.140 |
| HBS-5 | | 0.037 |
| Polyethyl acrylate latex | | 0.099 |
| Gelatin | | 0.944 |
| 12th layer (Yellow filter layer) | | |
| Cpd-1 | | 0.098 |
| Solid disperse dye ExF-2 | | 0.155 |
| Solid disperse dye ExF-5 | | 0.010 |
| Oil soluble dye ExF-6 | | 0.013 |
| HBS-1 | | 0.049 |
| Gelatin | | 0.634 |
| 13th layer (Low-speed blue-sensitive emulsion layer) | | |
| Em-O | silver | 0.110 |
| Em-M | silver | 0.312 |
| Em-N | silver | 0.245 |
| ExC-1 | | 0.022 |
| ExC-7 | | 0.013 |
| ExY-1 | | 0.002 |
| ExY-2 | | 0.899 |
| ExY-4 | | 0.055 |
| Cpd-2 | | 0.104 |
| Cpd-3 | | 0.004 |
| HBS-1 | | 0.220 |
| HBS-5 | | 0.076 |
| Gelatin | | 2.066 |
| 14th layer (High-speed blue-sensitive emulsion layer) | | |
| Em-L' | silver | 0.722 |
| ExY-2 | | 0.215 |
| ExY-4 | | 0.060 |
| Cpd-2 | | 0.073 |
| Cpd-3 | | 0.001 |
| HBS-1 | | 0.075 |
| Gelatin | | 0.684 |
| 15th layer (1st protective layer) | | |
| 0.07 μm silver iodobromide emulsion | silver | 0.306 |
| UV-1 | | 0.217 |
| UV-2 | | 0.137 |
| UV-3 | | 0.198 |
| UV-4 | | 0.025 |
| F-11 | | 0.009 |
| S-1 | | 0.089 |
| HBS-1 | | 0.180 |
| HBS-4 | | 0.055 |
| Gelatin | | 1.993 |
| 16th layer (2nd protective layer) | | |
| H-1 | | 0.410 |
| B-1 (diameter 1.7 μm) | | 0.053 |
| B-2 (diameter 1.7 μm) | | 0.154 |
| B-3 | | 0.052 |
| S-1 | | 0.205 |
| Gelatin | | 0.765 |

In addition to the above components, W-1 to W-6, B-4 to B-6, F-1 to F-17, a lead salt, a platinum salt, an iridium salt and a rhodium salt were appropriately added to the individual layers in order to improve the storage life, processability, resistance to pressure, antiseptic and mildew-proofing properties, antistatic properties and coating property thereof.

Preparation of Dispersion of Organic Solid Disperse Dye:

The ExF-2 of the 12th layer was dispersed by the following method. Specifically,

| | |
|---|---|
| Wet cake of ExF-2 (contg. 17.6 wt. % water) | 2.800 kg |
| Sodium octylphenyldiethoxymethanesulfonate (31 wt. % aq. soln.) | 0.376 kg |
| F-15 (7% aq. soln.) | 0.011 kg |
| Water | 4.020 kg |
| Total (adjusted to pH = 7.2 with NaOH). | 7.210 kg |

Slurry of the above composition was agitated by means of a dissolver to thereby effect a preliminary dispersion, and further dispersed by means of agitator mill LMK-4 under such conditions that the peripheral speed, delivery rate and packing ratio of 0.3 mm-diameter zirconia beads were 10 m/s, 0.6 kg/min and 80%, respectively, until the absorbance ratio of the dispersion became 0.29. Thus, a solid particulate dispersion was obtained, wherein the average particle diameter of dye particulate was 0.29 μm.

Solid dispersions of ExF-4 and ExF-7 were obtained in the same manner. The average particle diameters of these dye particulates were 0.28 μm and 0.49 μm, respectively. EXF-5 was dispersed by the microprecipitation dispersion method described in Example 1 of EP. No. 549,489A. The average particle diameter thereof was 0.06 μm.

The compounds used in the preparation of each of the layers will be listed below.

ExC-1

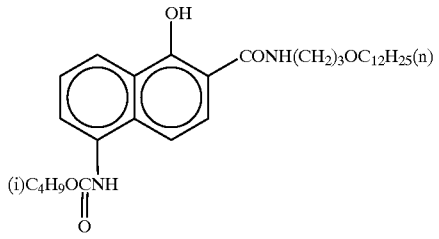

ExC-2

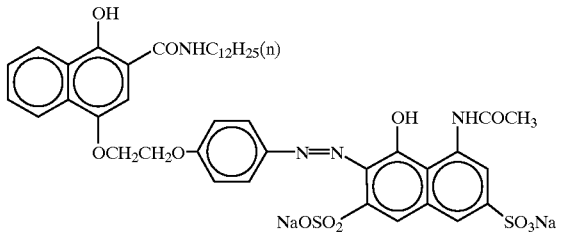

ExC-3

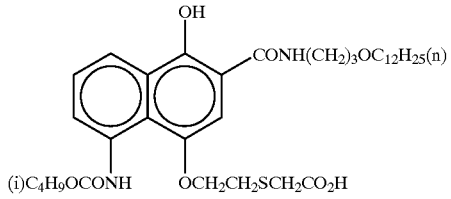

ExC-4

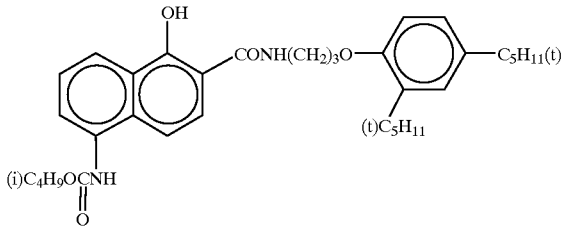

ExC-5

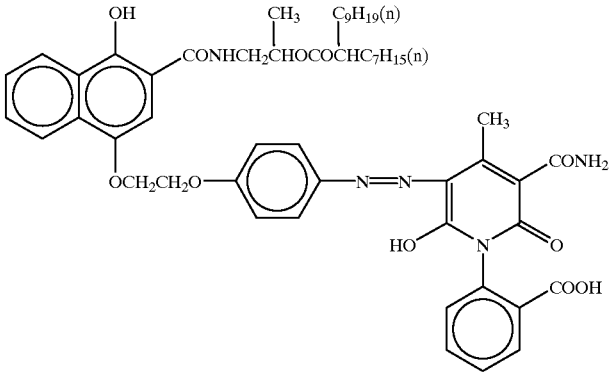

ExC-6

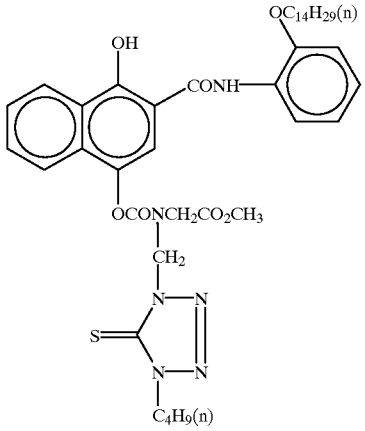

-continued
ExC-7
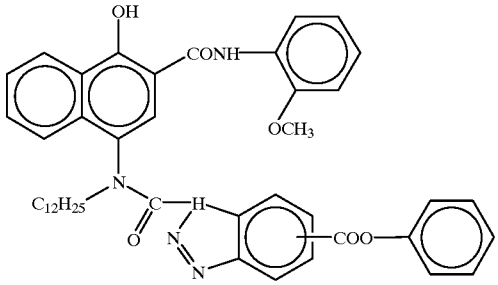
ExC-8
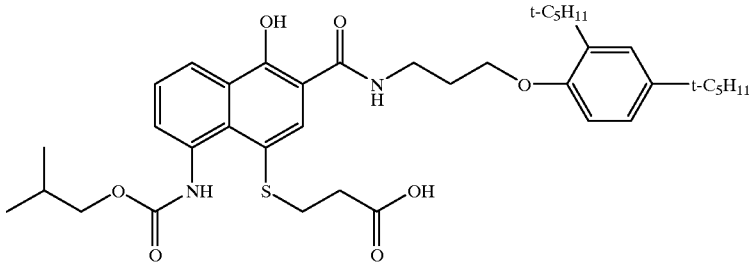
ExC-9
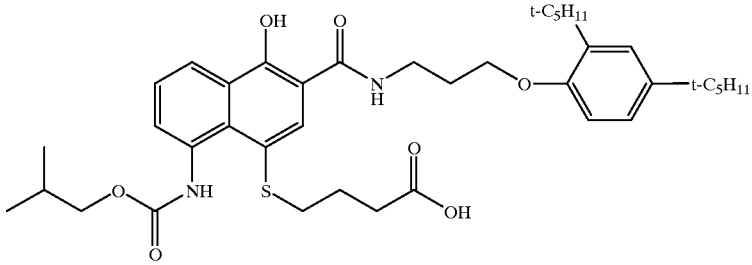
ExM-1
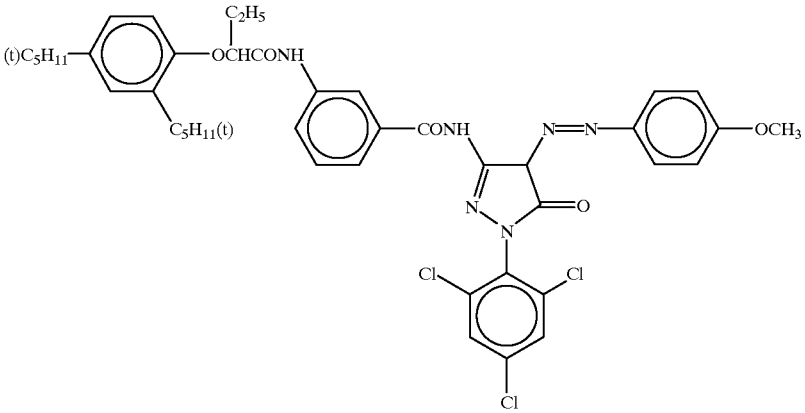

-continued
ExM-2
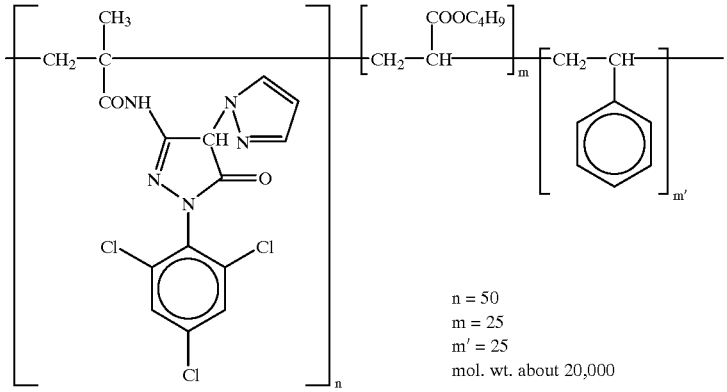
n = 50
m = 25
m′ = 25
mol. wt. about 20,000
ExM-3
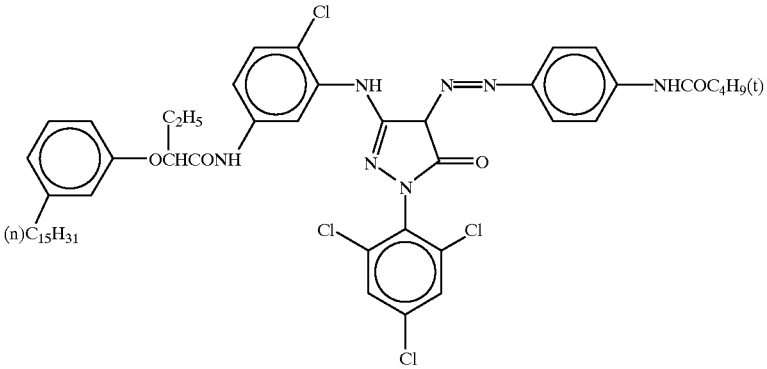
ExM-4
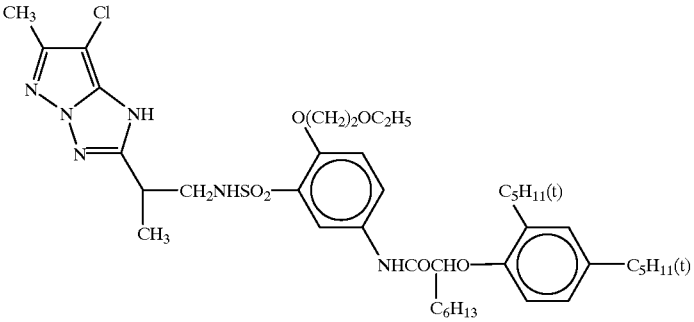
ExY-1
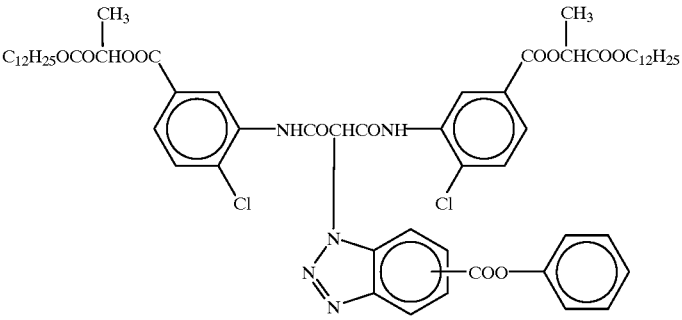

-continued
ExY-2
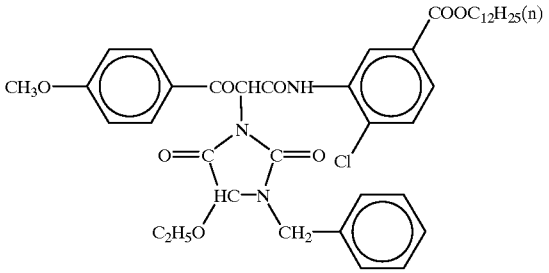
ExY-3
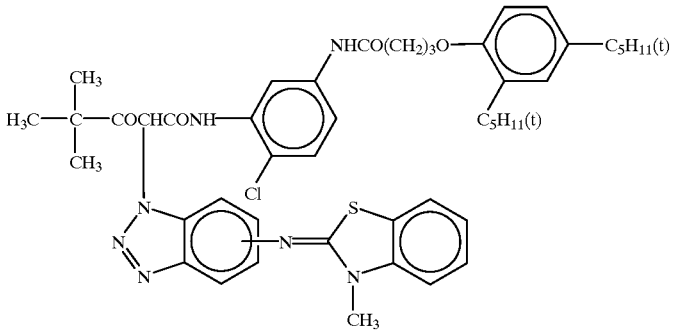
ExY-4
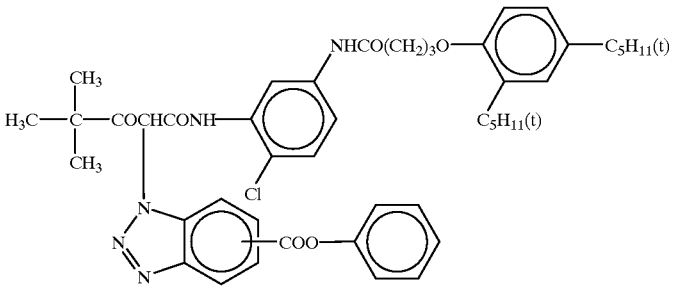
Cpd-1
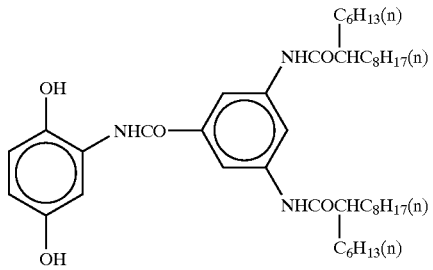
Cpd-2
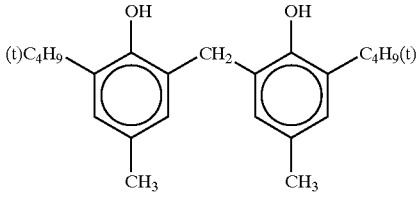
Cpd-3
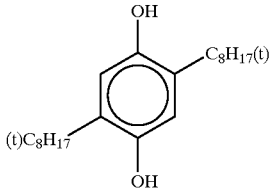
Cpd-4
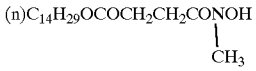

-continued
Cpd-5
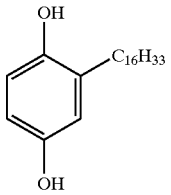
Cpd-6
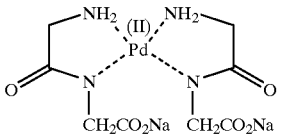
UV-1
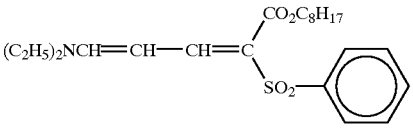
UV-2
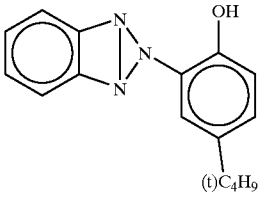
UV-3
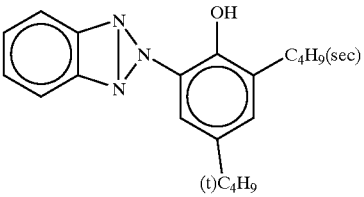
UV-4
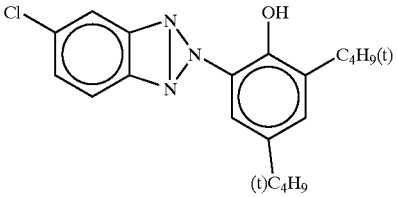
B-1
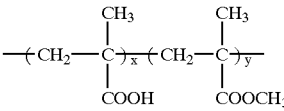
x/y = 10/90 (Weight ratio)
Average mol. wt.:
about 35,000
B-2
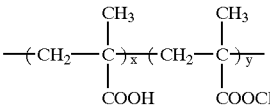
x/y = 40/60 (Weight ratio)
Average mol. wt.:
about 20,000
B-3
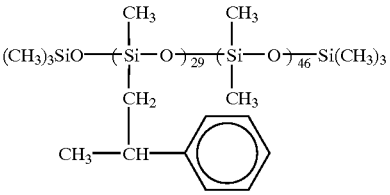
(molar ratio)
Average mol. wt.:
about 8,000
HBS-1
Tricresyl phosphate
HBS-2
Di-n-butyl phthalate
HBS-3
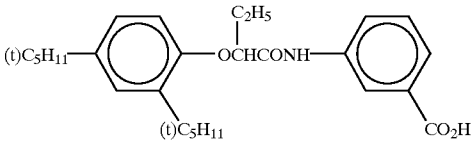
HBS-4
Tri(2-ethylhexyl)phosphate
HBS-5
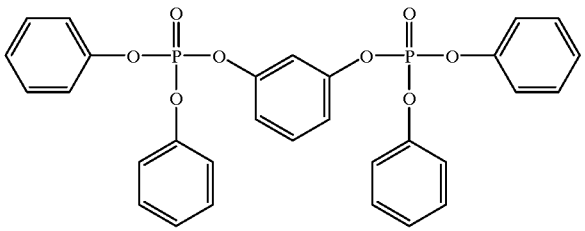

-continued
S-1
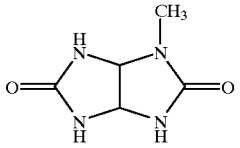
H-1
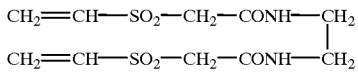
F-1
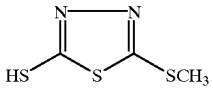
F-2
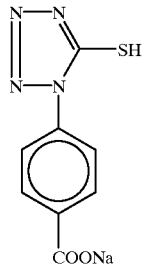
F-3
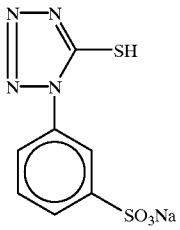
F-4
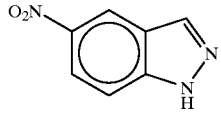
F-5
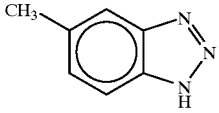
F-6
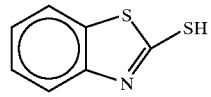
F-7
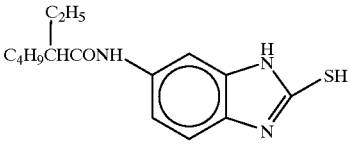
F-8
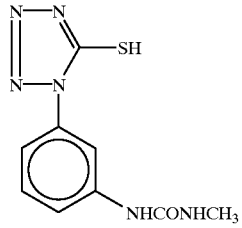
F-9
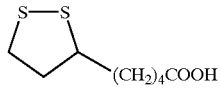
F-10
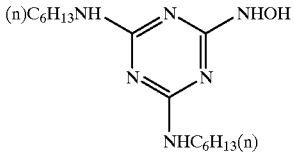
F-11
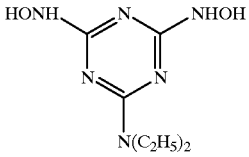
F-12
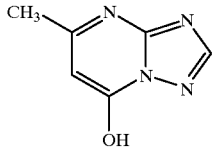
F-13
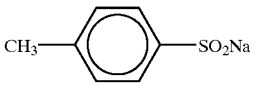
F-14
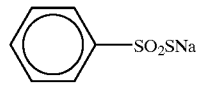

-continued
F-15
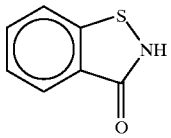
F-16
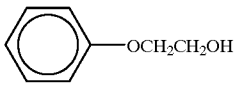
F-17
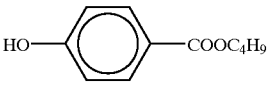
W-1
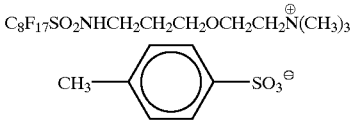
W-2
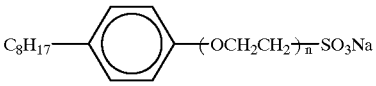
n = 2~4
W-3
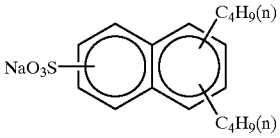
W-4
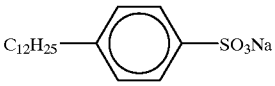
W-5
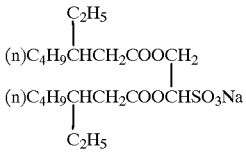
W-6
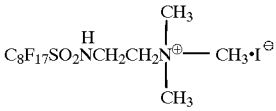
B-4
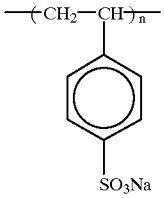
Average mol. wt.:
about 750,000
B-5
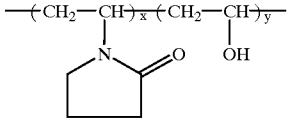
x/y = 70/30 (Weight ratio)
Average mol. wt.:
about 17,000
B-6
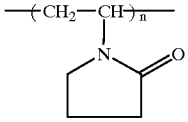
Average mol. wt.:
about 10,000
ExF-1
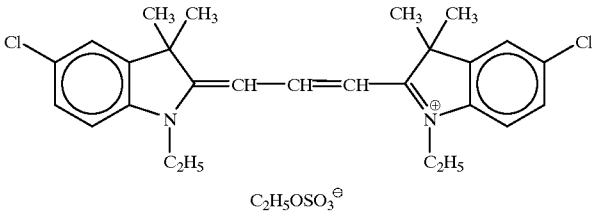

-continued

ExF-2

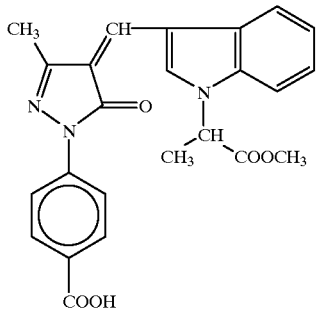

ExF-4

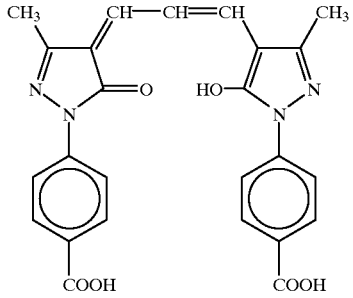

ExF-5

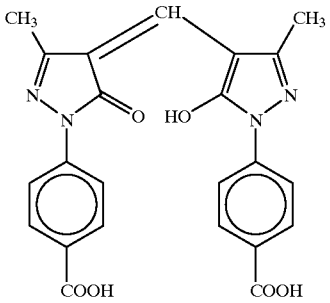

ExF-6

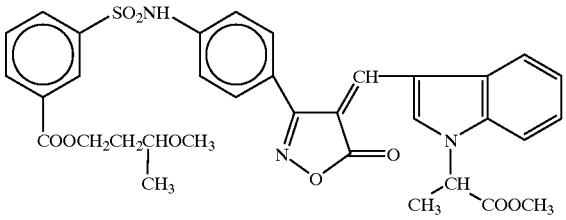

ExF-7

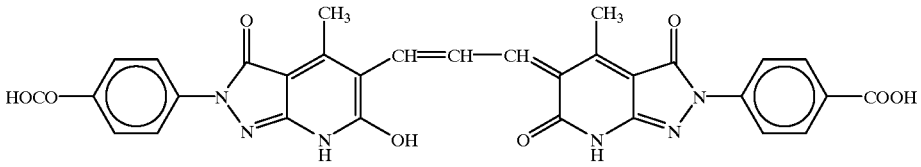

The silver halide color photographic light-sensitive material thus prepared is designated as Sample 101.

Sample 101 was exposed for 1/100 sec through the SC-39 gelatin filter manufactured by Fuji Photo Film Co., Ltd. and a continuous wedge.

(Preparation of Sample 102)

Sample 102 was prepared following the same procedures as for sample 101 except that the gelatin coating amount in the 6th layer was 0.75 times that of sample 101.

(Preparation of Sample 103)

Sample 103 was prepared following the same procedures as for sample 101 except that the gelatin coating amount in the 6th layer was 0.50 times that of sample 101.

(Preparation of Sample 104)

Sample 104 was prepred following the same procedures as for sample 103 except that emulsions Em-A', Em-B', Em-C', Em-E', Em-F', Em-G', Em-J', and Em-L' in the 4th, 5th, 6th, 8th, 9th, 10th, 11th, and 14th layers were replaced with Em-A, Em-B, Em-C, Em-E, Em-F, Em-G, Em-J, and Em-L, respectively.

(Preparation of Sample 105)

Sample 105 was prepared following the same procedures as for sample 104 except that the emulsion Em-A in the 6th layer was replaced with Em-A".

(Preparation of Samples 106 to 112)

Samples 106 to 112 were prepared following the same procedures as for sample 105 except that a developing agent or its precursor shown in Table 4 was added in an amount 1.4 times the number of mols of the coupler in the 6th layer.

(Preparation of Sample 113)

Sample 113 was prepared following the same procedures as for sample 106 except that the emulsion Em-A" in the 6th layer was subjected to tellurium sensitization. This tellurium sensitization was done by optimally, chemically sensitizing the emulsion Em-A" by replacing sodium thiosulfate used in chemical sensitization of the emulsion Em-A" with a tellurium sensitizer. As this tellurium sensitizer, a sensitizer I-12 described in sample 103 of Table 11 in Example 1 of JP-A-5-241267 was used.

(Preparation of Sample 114)

Sample 114 was prepred following the same procedures as for sample 113 except that titanium oxide grains were added to emulsion layers of sample 113.

As the fine titanium oxide grains, the TTO-51A fine titanium oxide grains on the market were used and added in amounts by which the refractive indices of dispersing medium phases with respect to 500-nm light were blue-sensitive layer (1.78), green-sensitive layer (1.74), and red-sensitive layer (1.70). The fine grains were also mixed in a yellow filter layer and in (an interlayer between the red- and green-sensitive layers), thereby controlling the refractive index of the former to 1.76 and that of the latter to 1.72.

The samples manufactured as above were wedge-exposed to white light at 1,000 lux for 1/100 sec, and developed by the following development steps.

(Processing Steps)

| Step | Processing time | Processing temperature |
|---|---|---|
| Color development | 60 sec | 45.0° C. |
| Bleaching | 20 sec | 45.0° C. |
| Fixing | 40 sec | 45.0° C. |
| Washing (1) | 15 sec | 45.0° C. |
| Washing (2) | 15 sec | 45.0° C. |
| Washing (3) | 15 sec | 45.0° C. |
| Drying | 45 sec | 80° C. |

(Washing was Done by Counterflow from (3) to (1)).

The compositions of the processing solutions are presented below.

| (Color developer) | (g) |
|---|---|
| Diethylenetriamine pentaacetic acid | 2.0 |
| 1-hydroxyethylidene-1,1-diphosphonic acid | 3.3 |
| Sodium sulfite | 5.5 |
| Potassium carbonate | 39.0 |
| Potassium bromide | 2.0 |
| Potassium iodide | 1.3 mg |
| Disodium N,N-bis(sulfonatoethyl) hydroxylamine | 10.0 |
| 2-methyl-4-{N-ethyl-N-(β-hydroxyethyl) amino}aniline sulfate | 9.0 |
| Silver solvent | 0.27 |
| Water to make | 1.0 L |
| pH (adjusted by potassium hydroxide or sulfuric acid) | 10.25 |
| (Bleaching solution) | (g) |
| Ferric ammonium 1,3-diaminopropane tetraacetate monohydrate | 0.33 |
| Ferric nitrate enneahydrate | 0.30 |
| Ammonium bromide | 0.80 |
| Ammonium nitrate | 0.20 |
| Acetic acid | 0.67 |
| Water to make | 1.0 L |
| pH (adjusted by ammonia water) | 4.5 |
| (Fixing solution) | (g) |
| Ammonium sulfite | 28 |
| Aqueous ammonium thiosulfate solution (700 g/L) | 280 mL |
| Imidazole | 15 |
| Ethylenediamine tetraacetic acid | 15 |
| Water to make | 1.0 L |
| pH (adjusted by ammonia water or acetic acid) | 5.8 |
| (Washing water) | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium ions to 3 mg/liter (to be also referred to as "L" hereinafter) or less. Subsequently, 20 mg/L of sodium isocyanurate dichloride and 150 mg/L of sodium sulfate were added. The pH of the solution ranged from 6.5 to 7.5.

The sensitivity of each developed sample was obtained by measuring its density.

This sensitivity is indicated by the logarithm of the reciprocal of an exposure amount by which a cyan image density was a minimum density+0.2.

The value of sensitivity is a relative value with respect to sample 101.

The graininess was evaluated by obtaining the RMS granularity of a cyan image at a density of fog+0.2. The value of graininess is a relative value with respect to 100 of sample 101.

Table 4 shows the results.

TABLE 4

| Sample No. | Developing agent or is precursor added in 6th layer | Silver density at development in 6th ($g/m^3$) | Sensitivity | Graininess |
|---|---|---|---|---|
| 101(Comp.) | — | $3.4 \times 10^5$ | 0.00 | 100 |
| 102(Inv.) | — | $4.7 \times 10^5$ | +0.13 | 103 |
| 103(Inv.) | — | $6.2 \times 10^5$ | +0.20 | 102 |
| 104(Inv.) | — | $6.2 \times 10^5$ | +0.24 | 105 |
| 105(Inv.) | — | $6.2 \times 10^5$ | +0.29 | 102 |
| 106(Inv.) | DEVP-21 | $6.2 \times 10^5$ | +0.34 | 102 |
| 107(Inv.) | DEVP-1 | $6.2 \times 10^5$ | +0.36 | 104 |
| 108(Inv.) | D-3 | $6.2 \times 10^5$ | +0.35 | 104 |
| 109(Inv.) | D-23 | $6.2 \times 10^5$ | +0.34 | 103 |
| 110(Inv.) | D-27 | $6.2 \times 10^5$ | +0.34 | 104 |
| 111(Inv.) | D-33 | $6.2 \times 10^5$ | +0.34 | 103 |
| 112(Inv.) | D-49 | $6.2 \times 10^5$ | +0.35 | 103 |
| 113(Inv.) | DEVP-1 | $6.2 \times 10^5$ | +0.42 | 101 |
| 114(Inv.) | DEVP-1 | $6.2 \times 10^5$ | +0.48 | 102 |

Table 4 shows that each sample of the present invention was favorable because it had high sensitivity in rapid processing and also had graininess almost equal to that of the comparative example.

Example 2

<<Preparation of Silver Halide Emulsions>>

930 mL of distilled water containing 0.37 g of gelatin having an average molecular weight of 15,000, 0.37 g of oxidation-processed gelatin, and 0.7 g of potassium bromide were placed in a reaction vessel and heated to 38° C. While this solution was strongly stirred, 30 mL of an aqueous solution containing 0.34 g of silver nitrate and 30 mL of an aqueous solution containing 0.24 g of potassium bromide were added over 20 sec. The temperature of the reaction solution was held at 40° C. for 1 min after the addition and then increased to 75° C. 27.0 g of gelatin obtained by modifying an amino group with trimellitic acid were added together with 200 mL of distilled water. After that, 100 mL of an aqueous solution containing 23.36 g of silver nitrate and 80 mL of an aqueous solution containing 16.37 g of potassium bromide were added over 36 min while the addition flow rates were accelerated. Subsequently, 250 mL of an aqueous solution containing 83.2 g of silver nitrate and an aqueous solution containing potassium iodide and potassium bromide at a molar ratio of 3:97 (the concentration of potassium bromide was 26%) were added over 60 min while the addition flow rates were accelerated, such that the silver potential of the reaction solution was −50 mV with respect to a saturated calomel electrode. In addition, 75 mL of an aqueous solution containing 18.7 g of silver nitrate and an aqueous 21.9% solution of potassium bromide were added over 10 min, such that the silver potential of the reaction solution was 0 mV with respect to the saturated calomel electrode. The temperature of the reaction solution was held at 75° C. for 1 min after the addition and then decreased to 40° C.

Subsequently, 100 mL of an aqueous solution containing 10.5 g of p-acetamide iodide sodium benzenesulfonate monohydrate were added, and the pH of the reaction solution was adjusted to 9.0. Then, 50 mL of an aqueous solution containing 4.3 g of sodium sulfite was added. The temperature of the reaction solution was held at 40° C. for 3 min and then raised to 55° C. After the pH of the reaction solution was adjusted to 5.8, 0.8 mg of sodium benzenethiosulfonate, 0.04 mg of potassium hexachloroiridate(IV), and 5.5 g of potassium bromide were added. The temperature was held at 55° C. for 1 min, and 180 mL of an aqueous solution containing 44.3 g of silver nitrate and 160 mL of an aqueous solution containing 34.0 g of potassium bromide and 8.9 mg of potassium hexacyanoferrate(II) were added over 30 min. The temperature was lowered, and desalting was performed following the conventional procedure. After the desalting, gelatin was added so that the concentration thereof became 7 wt. %, and the pH was adjusted to 6.2.

The obtained emulsion containing hexagonal tabular grains having an average grain size, represented by an equivalent-sphere diameter, of 1.15 $\mu$m, an average grain thickness of 0.12 $\mu$m, and an average aspect ratio of 24.0. This emulsion was named an emulsion A-1.

In the preparation of the emulsion A-1, the amounts of silver nitrate and potassium bromide initially added in the grain formation were changed to change the number of nuclei formed, thereby preparing an emulsion A-2 containing of hexagonal tabular grains having an average grain size, represented by an equivalent-sphere diameter, of 0.75 $\mu$m, an average grain thickness of 0.11 $\mu$m, and an average aspect ratio of 14.0, and an emulsion A-3 consisting of hexagonal tabular grains having an average grain size, represented by an equivalent-sphere diameter, of 0.52 $\mu$m, an average grain thickness of 0.09 $\mu$m, and an average aspect ratio of 11.3. Note that the addition amounts of potassium hexachloroiridate(IV) and potassium hexacyanoferrate(II) were changed in inverse proportion to the grain volume, and the addition amount of p-acetamide iodide sodium benzenesulfonate monohydrate was changed in proportion to the circumferential length of the grain.

5.6 mL of an aqueous 1% potassium iodide solution were added to the emulsion A-1 at 40° C. After that, spectral sensitization and chemical sensitization were performed by adding $8.2\times10^{-4}$ mol of a spectral sensitizing dye presented below, a compound 1, potassium thiocyanate, chloroauric acid, sodium thiosulfate, and mono(pentafluorophenyl) diphenylphosphineselenide. After chemical sensitization, $1.2\times10^{-4}$ mol of a stabilizer S was added. During the addition, the amount of chemical sensitizer was so adjusted that the degree of the chemical sensitization was optimum.

Blue-sensitive sensitizing dye

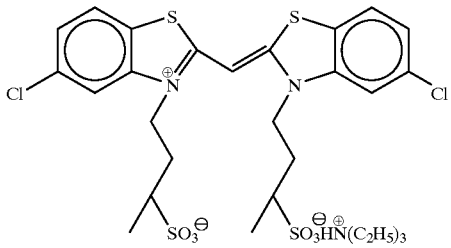

-continued

Compound 1

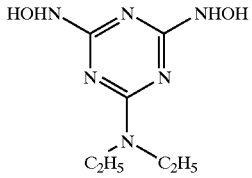

Stabilizer S (A mixture of following compounds:

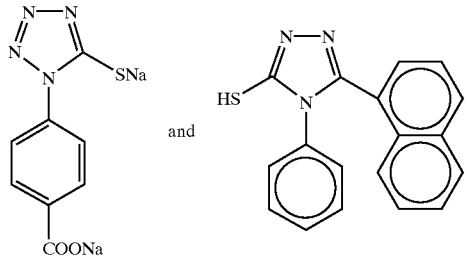

in amounts of $2 \times 10^{-4}$ mol/mol Ag and $8 \times 10^{-5}$ mol/mol Ag, respectively, each with respect to Emulsion A-1)

The blue-sensitive emulsion thus prepared was named A-1b. Emulsions A-2b and A-3b were prepared by similarly performing spectral sensitization and chemical sensitization for the emulsions. However, the addition amount of spectral sensitizing dye was changed in accordance with the surface area of silver halide grains in each emulsion. Also, the amount of each chemical used in chemical sensitization was so controlled that the degree of chemical sensitization of each emulsion was optimum.

Analogously, green-sensitive emulsions A-1g A-2g, and A-3g and red-sensitive emulsions A-1r, A-2r, and A-3r were prepared by changing the spectral sensitizing dye.

Sensitizing dye A-1g for green-sensitive emulsion

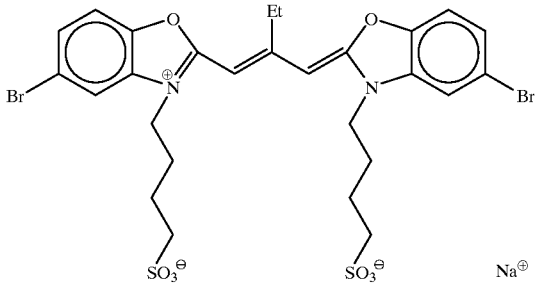

$5.5 \times 10^{-4}$ mol/mol Ag with respect to Emulsion A-1

Sensitizing dye A-2g for green-sensitive emulsion

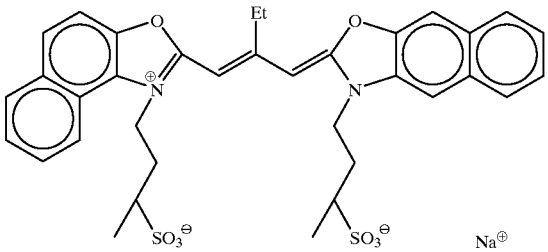

$1.3 \times 10^{-4}$ mol/mol Ag with respect to Emulsion A-1

-continued

Sensitizing dye A-3g for green-sensitive emulsion

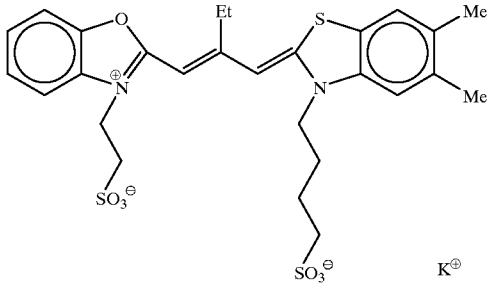

4.8 x $10^{-5}$ mol/mol Ag with respect to Emulsion A-1

Sensitizing dye A-1r for red-sensitive emulsion

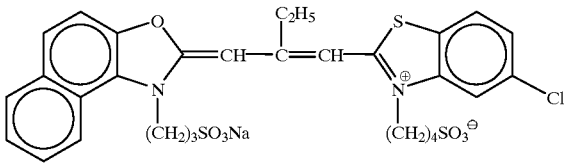

2.5 x $10^{-4}$ mol/mol Ag with respect to Emulsion A-1

Sensitizing dye A-2r for red-sensitive emulsion

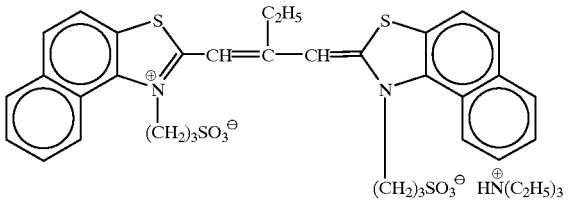

6.3 x $10^{-5}$ mol/mol Ag with respect to Emulsion A-1

Sensitizing dye A-3r for red-sensitive emulsion

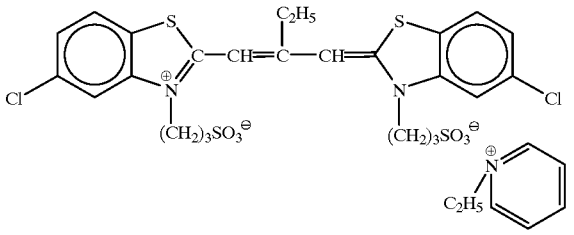

3.1 x $10^{-4}$ mol/mol Ag with respect to Emulsion A-1

<Method of Preparing Silver Salt of 5-amino-3-benzylthiotriazole>

11.3 g of 5-amino-3-benzylthiotriazole, 1.1 g of sodium hydroxide and 10 g of gelatin were dissolved in 1000 L of water, and the solution was maintained at 50° C. under agitation. Subsequently, a solution obtained by dissolving 8.5 g of silver nitrate in 100 mL of water was added to the above solution over a period of 2 min. The pH of the mixture was regulated so as to precipitate an emulsion, and excess salts were removed. Thereafter, the pH was adjusted to 6.0. Thus, a 5-amino-3-benzylthiotriazole silver salt emulsion was obtained with a yield of 400 g.

<Preparation of Lightsensitive Material>

For obtaining a lightsensitive material, the preparation of a support and the coating formation of substratum, antistatic layer (back 1st layer), magnetic recording layer (back 2nd layer) and back 3rd layer were carried out in the following manner.

(1) Preparation of Support

The support employed in this Example was produced according to the following procedure. 100 parts by weight of polyethylene 2,6-naphthalenedicarboxylate (PEN) and 2 parts by weight of ultraviolet absorbent Tinuvin P.326 (produced by Ciba-Geigy) were homogeneously mixed together. The mixture was melted at 300° C., extruded through T-die, longitudinally drawn at a ratio of 3.3 at 140° C., transversely drawn at a ratio of 4.0 and thermoset at 250° C. for 6 sec. Thus, a 90 μm thick PEN film was obtained. This PEN film was loaded with appropriate amounts of blue, magenta and yellow dyes (I-1, I-4, I-6, I-24, I-26, I-27 and II-5 described in JIII Journal of Technical Disclosure No. 94-6023). Further, the film was wound round a stainless steel core of 30 cm diameter and heated at 110° C. for 48 hr so as to give a heat history. Thus, the support resistant to curling was obtained.

(2) Formation of Substratum by Coating

Glow treatment of the PEN support on its both surfaces was performed in the following manner. Four rod electrodes of 2 cm diameter and 40 cm length were fixed at intervals of 10 cm on an insulating board in a vacuum tank. The electrodes were arranged so as to allow the support film to travel at a distance of 15 cm therefrom. A heating roll of 50 cm diameter fitted with a temperature controller was disposed just ahead of the electrodes. The support film was set so as to contact a ¾ round of the heating roll. The support film, 90 μm thick and 30 cm wide biaxially oriented film, was traveled and heated by the heating roll so that the temperature of the film surfaces between the heating roll and the electrode zone was 115° C. The support film was carried at a speed of 15 cm/sec and underwent glow treatment.

Glow treatment was performed under such conditions that the pressure within the vacuum tank was 26.5 Pa, and the $H_2O$ partial pressure of ambient gas 75%. Further, the conditions were such that the discharge frequency was 30 KHz, the output 2500 W, and the treating strength 0.5 KV·A·min/$m^2$. With respect to the vacuum glow discharge electrodes, the method described in JP-A-7-003056 was followed.

One side (emulsion side) of the glow-treated PEN support was furnished with a substratum of the following recipe. The dry film thickness was designed so as to be 0.02 μm. The drying was performed at 115° C. for 3 min.

| | |
|---|---|
| Gelatin | 83 pts. wt. |
| Water | 291 pts. wt. |
| Salicylic acid | 18 pts. wt. |
| Aerosil R972 (colloidal silica, produced by Nippon Aerosil Co., Ltd.) | 1 pt. wt. |
| Methanol | 6900 pts. wt. |
| n-Propanol | 830 pts. wt. |
| Polyamide-epichlorohydrin resin described in JP-A-51-3619. | 25 pts. wt. |

(3) Formation of Antistatic Layer (Back 1st Layer) by Coating

Liquid mixture of 40 parts by weight of SN-100 (conductive fine particles produced by Ishihara Sangyo Kaisha, Ltd.) and 60 parts by weight of water, while adding a IN aqueous solution of sodium hydroxide thereto, was agitated by an agitator to thereby form a coarse dispersion and subjected to dispersion by means of a horizontal sand mill. Thus, a dispersion of conductive fine particles of 0.06 μm secondary particle average diameter (pH=7.0) was obtained.

The coating liquid of the following composition was applied onto the surface-treated PEN support (back side) so that the coating amount of conductive fine particles was 270 mg/m$^2$. The drying was performed at 115° C. for 3 min.

| | |
|---|---|
| SN-100 (conductive fine particles produced by Ishihara Sangyo Kaisha, Ltd.) | 270 pts. wt. |
| Gelatin | 23 pts. wt. |
| Rheodol TW-L120 (surfactant produced by Kao Corp.) | 6 pts. wt. |
| Denacol EX-521 (film hardener produced by Nagase Chemtex Corporation) | 9 pts. wt. |
| Water | 5000 pts. wt. |

(4) Formation of Magnetic Recording Layer (Back 2nd Layer) by Coating

Magnetic particles CSF-4085V2 ($\gamma$-$Fe_2O_3$ coated with Co, produced by Toda Kogyo Co., Ltd.) were surface treated with 16% by weight, based on the magnetic particles, of X-12-641 (silane coupling agent produced by Shin-Etsu Chemical Co., Ltd.).

The back 1st layer on its upper side was coated with the coating liquid of the following composition so that the coating amount of CSF-4085V2 treated with the silane coupling agent was 62 mg/m$^2$. The magnetic particles and abrasive were dispersed by the method of JP-A-6-035092. The drying was performed at 115° C. for 1 min.

| | |
|---|---|
| Diacetylcellulose (binder) | 1140 pts. wt. |
| CSF-4085V2 treated with X-12-641 (magnetic particles) | 62 pts. wt. |
| AKP-50 (alumina abrasive produced by Sumitomo Chemical Co., Ltd.) | 40 pts. wt. |
| Millionate MR-400 (film hardener produced by Nippon Polyurethane Co., Ltd.) | 71 pts. wt. |
| Cyclohexanone | 12000 pts. wt. |
| Methyl ethyl ketone | 12000 pts. wt. |

The $D^B$ color density increment of the magnetic recording layer through X-light (blue filter) was about 0.1. Further, with respect to the magnetic recording layer, the saturation magnetization moment, coercive force and rectangular ratio were 4.2 Am$^2$/kg, 7.3×10$^4$ A/m and 65%, respectively.

(5) Formation of Back 3rd Layer by Coating

The lightsensitive material on its magnetic recording layer side was coated with the back 3rd layer.

Wax (1-2) of the following formula was emulsified in water by means of a high-voltage homogenizer, thereby obtaining a wax water dispersion of 10% by weight concentration and 0.25 $\mu$m weight average diameter.

Wax (1-2): n-$C_{17}H_{35}COOC_{40}H_{81}$-n.

The magnetic recording layer (back 2nd layer) on its upper side was coated with the coating liquid of the following composition so that the coating amount of wax was 27 mg/m$^2$. The drying was performed at 115° C. for 1 min.

| | |
|---|---|
| Wax water dispersion mentioned above (10% by weight) | 270 pts. wt. |
| Pure water | 176 pts. wt. |
| Ethanol | 7123 pts. wt. |
| Cyclohexanone | 841 pts. wt. |

Furthermore, an emulsion dispersion containing a coupler and an internal developing agent was prepared.

Yellow coupler CP-107, compound DEVP-26, antifoggant (d), (e), high-boiling organic solvent (f) and ethyl acetate were mixed together at 60° C. into a solution. This solution was mixed into an aqueous solution wherein lime-processed gelatin and sodium dodecylbenzenesulfonate were dissolved, and emulsified by means of a dissolver agitator at 10,000 revolutions over a period of 20 min.

Antifoggant (d)

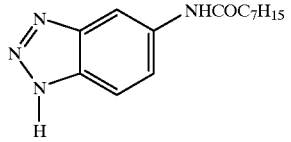

Antifoggant (e)

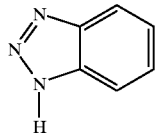

High-boiling organic solvent (f)

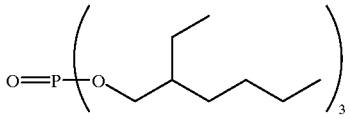

High-boiling organic solvent (j)

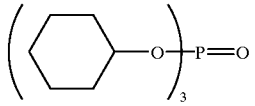

Subsequently, magenta coupler and cyan coupler dispersions were prepared in the same manner.

Magenta coupler CP-205, CP-210, compound DEVP-26, antifoggant (d), high-boiling organic solvent (j) and ethyl acetate were mixed together at 60° C. into a solution. This solution was mixed into an aqueous solution wherein lime-processed gelatin and sodium dodecylbenzenesulfonate were dissolved, and emulsified by means of a dissolver agitator at 10,000 revolutions over a period of 20 min.

Cyan coupler CP-324, cyan coupler CP-320, developing agent DEVP-26, antifoggant (d), high-boiling organic solvent (j) and ethyl acetate were mixed together at 60° C. into a solution. This solution was mixed into an aqueous solution wherein lime-processed gelatin and sodium dodecylbenzenesulfonate were dissolved, and emulsified by means of a dissolver agitator at 10,000 revolutions over a period of 20 min.

In the same manner, high-boiling organic solvent (g) and ethyl acetate were mixed together at 60° C. into a solution. This solution was mixed into an aqueous solution wherein lime-processed gelatin and sodium dodecylbenzenesulfonate were dissolved, and emulsified by means of a dissolver agitator at 10,000 revolutions over a period of 20 min. Thus, a dispersion of high-boiling organic solvent (g) was obtained.

High-boiling organic solvent (g)

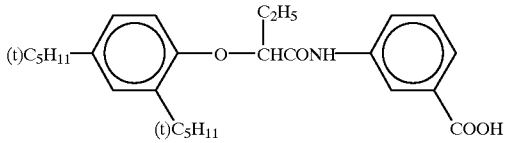

Further, dye dispersions for coloring interlayers for use as a filter layer and an antihalation layer were prepared in the same manner.

Various dyes, high-boiling organic solvents employed to disperse them and other additives are listed below.

Yellow dye (1)

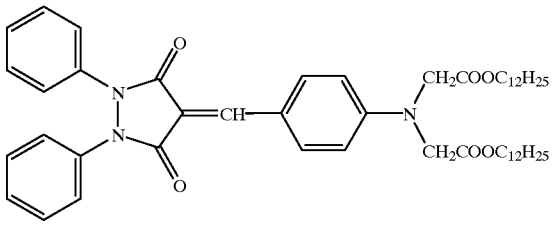

High-boiling organic solvent (m)

A 1:1 mixture of

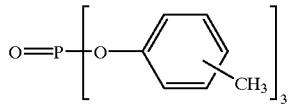

and Ajinomoto Empara K65 manufactured by AJINOMOTO K.K.

Magenta dye (n)

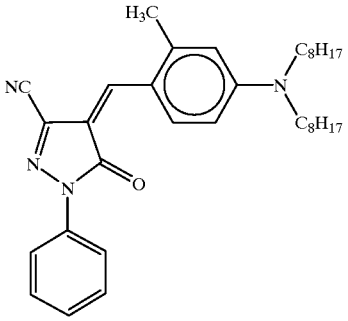

High-boiling organic solvent (o)

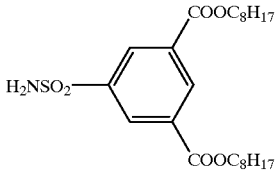

Cyan dye (p)

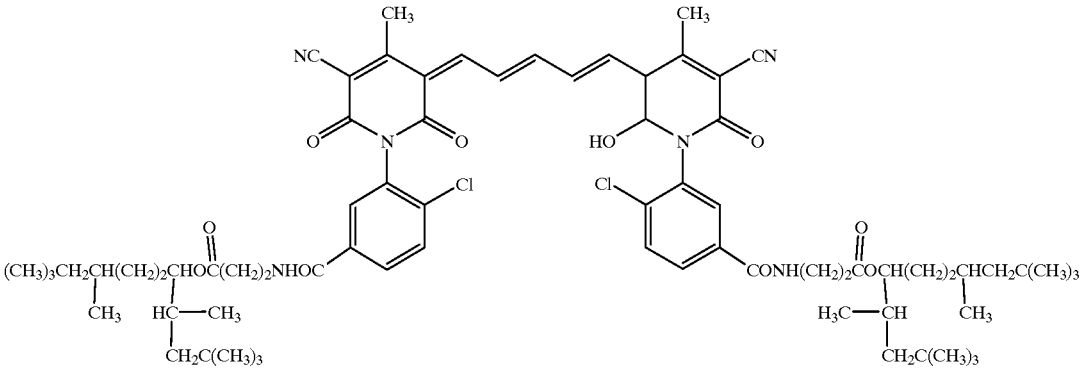

High-boiling organic solvent (Q)

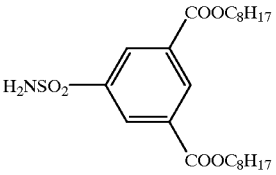

Sample 201 of a multi-layered color light-sensitive material for heat development of set forth in Table 5 below was prepared by using these emulsions.

TABLE 5

| | (Unit mg/m$^2$) Sample 201 | |
|---|---|---|
| Protective layer | Alkali-treated gelatin | 950 |
| | Matting agent (silica) | 55 |
| | Surfactant (q) | 32 |
| | Surfactant (r) | 43 |
| | Water-soluble polymer (s) | 17 |
| | Hardening agent (t) | 105 |

TABLE 5-continued

| | (Unit mg/m$^2$) Sample 201 | |
|---|---|---|
| Interlayer | Alkali-treated gelatin | 455 |
| | Surfactant (r) | 8 |
| | Base-precursor compound BP-41 | 425 |
| | Formalin scavenger (u) | 312 |
| | D-Solbitol | 60 |
| | Water-soluble polymer (s) | 20 |
| Yellow color layer | Alkali-treated gelatin | 1850 |
| | Emulsion (in terms of coated silver) | A-1b 560 |

TABLE 5-continued

| | (Unit mg/m$^2$) Sample 201 | |
|---|---|---|
| (high-speed layer) | 5-Amino-3-benzylthiotriazole silver | 160 |
| | Yellow coupler (CP-107) | 170 |
| | DEVP-26 | 225 |
| | Antifoggant (d) | 3.8 |
| | Antifoggant (e) | 5.0 |
| | High-boiling organic solvent (f) | 177 |
| | Surfactant (y) | 30 |
| | D-Solbitol | 210 |
| | Water-soluble polymer (s) | 1 |
| Yellow color layer (medium-speed layer) | Alkali-treated gelatin | 1400 |
| | Emulsion (in terms of coated silver) | A-2b 267 |
| | 5-Amino-3-benzylthiotriazole silver | 190 |
| | Yellow coupler (CP-107) | 175 |
| | DEVP-26 | 310 |
| | Antifoggant (d) | 5.5 |
| | Antifoggant (e) | 10.0 |
| | High-boiling organic solvent (f) | 270 |
| | Surfactant (y) | 30 |
| | D-Solbitol | 140 |
| | Water-soluble polymer (s) | 2 |
| Yellow color layer (low-speed layer) | Alkali-treated gelatin | 1610 |
| | Emulsion (in terms of coated silver) | A-3b 225 |
| | 5-Amino-3-benzylthiotriazole silver | 220 |
| | Yellow coupler (CP-107) | 456 |
| | DEVP-26 | 553 |
| | Antifoggant (d) | 9.0 |
| | Antifoggant (e) | 16.0 |
| | High-boiling organic solvent (f) | 440 |
| | Surfactant (y) | 25 |
| | D-Solbitol | 140 |
| | Water-soluble polymer (s) | 2 |
| Interlayer (Yellow filter layer) | Alkali-treated gelatin | 580 |
| | Surfactant (y) | 20 |
| | Surfactant (r) | 20 |
| | Base-precursor compound BP-41 | 510 |
| | Yellow dye (1) | 80 |
| | High-boiling organic solvent (m) | 80 |
| | Water-soluble polymer (s) | 20 |
| Magenta color layer (high-speed layer) | Alkali-treated gelatin | 1100 |
| | Emulsion (in terms of coated silver) | A-1g 450 |
| | 5-Amino-3-benzylthiotriazole silver | 65 |
| | Magenta coupler (CP-205) | 55 |
| | Magenta coupler (CP-210) | 26 |
| | DEVP-26 | 85 |
| | Antifoggant (d) | 1.3 |
| | High-boiling organic solvent (j) | 78 |
| | Surfactant (y) | 10 |
| | D-Solbitol | 105 |
| | Water-soluble polymer (s) | 9 |
| Magenta color layer (medium-speed layer) | Alkali-treated gelatin | 910 |
| | Emulsion (in terms of coated silver) | A-2g 402 |
| | 5-Amino-3-benzylthiotriazole silver | 60 |
| | Magenta coupler (CP-205) | 98 |
| | Magenta coupler (CP-210) | 54 |
| | DEVP-26 | 170 |
| | Antifoggant (d) | 2.4 |
| | High-boiling organic solvent (j) | 155 |
| | Surfactant (y) | 13 |
| | D-Solbitol | 86 |
| | Water-soluble polymer (s) | 16 |

TABLE 5-continued

| | (Unit mg/m$^2$) Sample 201 | |
|---|---|---|
| Magenta color layer (low-speed layer) | Alkali-treated gelatin | 722 |
| | Emulsion (in terms of coated silver) | A-3g 242 |
| | 5-Amino-3-benzylthiotriazole silver | 156 |
| | Magenta coupler (CP-205) | 228 |
| | Magenta coupler (CP-210) | 123 |
| | DEVP-26 | 421 |
| | Antifoggant (d) | 5.7 |
| | High-boiling organic solvent (j) | 386 |
| | Surfactant (y) | 34 |
| | D-Solbitol | 84 |
| | Water-soluble polymer (s) | 18 |
| Inter layer (Magenta filter layer) | Alkali-treated gelatin | 855 |
| | Surfactant (y) | 14 |
| | Surfactant (r) | 25 |
| | Base-precursor compound BP-41 | 476 |
| | Magenta dye (n) | 52 |
| | High-boiling organic solvent (o) | 50 |
| | Formalin scavenger (u) | 300 |
| | D-SOLBITOR | 80 |
| | Water-soluble polymer (s) | 14 |
| Cyan color layer (high-speed layer) | Alkali-treated gelatin | 1120 |
| | Emulsion (in terms of coated silver) | A-1r 418 |
| | 5-Amino-3-benzylthiotriazole silver | 63 |
| | Cyan coupler (CP-320) | 22 |
| | Cyan coupler (CP-324) | 40 |
| | DEVP-26 | 75 |
| | Antifoggant (d) | 1.0 |
| | High-boiling organic solvent (j) | 76 |
| | Surfactant (y) | 6 |
| | D-Solbitol | 88 |
| | Water-soluble polymer (s) | 20 |
| Cyan color layer (medium-speed layer) | Alkali-treated gelatin | 750 |
| | Emulsion (in terms of coated silver) | A-2r 410 |
| | 5-Amino-3-benzylthiotriazole silver | 105 |
| | Cyan coupler (CP-320) | 50 |
| | Cyan coupler (CP-324) | 130 |
| | DEVP-26 | 224 |
| | Antifoggant (d) | 2.5 |
| | High-boiling organic solvent (j) | 200 |
| | Surfactant (y) | 10 |
| | D-Solbitol | 45 |
| | Water-soluble polymer (s) | 10 |
| Cyan color layer (low-speed layer) | Alkali-treated gelatin | 810 |
| | Emulsion (in terms of coated silver) | A-3r 290 |
| | 5-Amino-3-benzylthiotriazole silver | 150 |
| | Cyan coupler (CP-320) | 90 |
| | Cyan coupler (CP-324) | 230 |
| | DEVP-26 | 405 |
| | Antifoggant (d) | 4.0 |
| | High-boiling organic solvent (j) | 360 |
| | Surfactant (y) | 15 |
| | D-Solbitol | 90 |
| | Water-soluble polymer (s) | 7 |
| Antihalation layer | Alkali-treated gelatin | 420 |
| | Surfactant (y) | 12 |
| | Base-precursor compound BP-41 | 620 |
| | Cyan dye (p) | 260 |
| | High-boiling organic solvent (o) | 245 |
| | Water-soluble polymer (s) | 15 |

Surfactant (g)
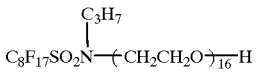
Surfactant (y)
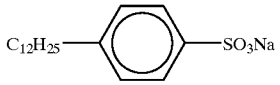
Surfactant (r)
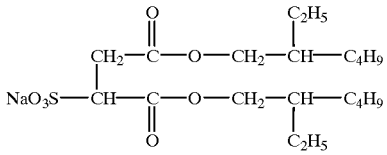
Water-soluble polymer (s)
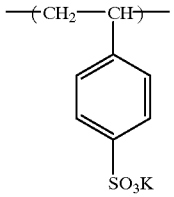
Hardening agent (t)
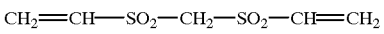
Formalin scavenger (u)
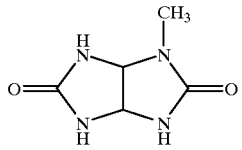
CP-107
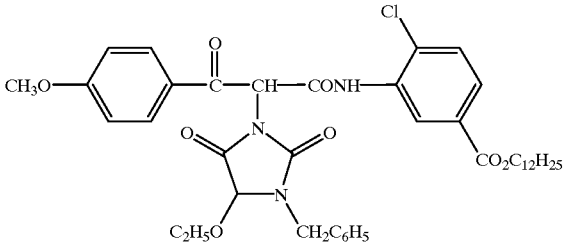
CP-205
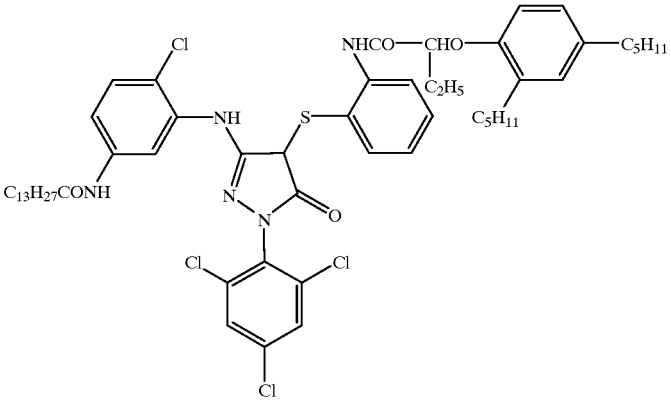
CP-210
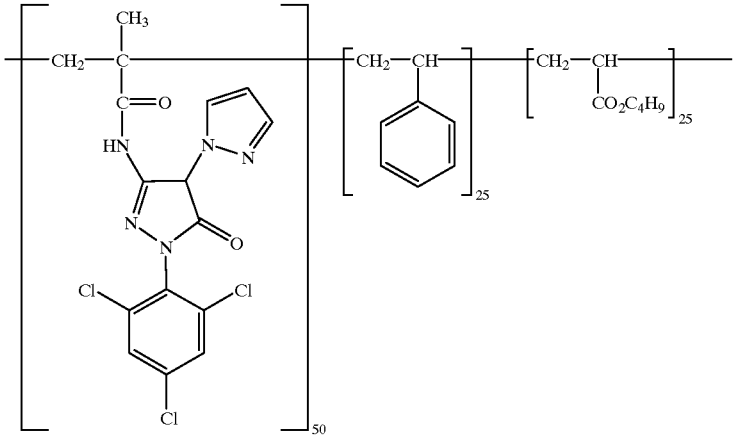

-continued

CP-320

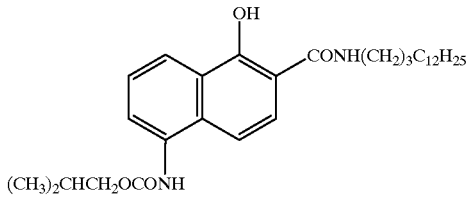

CP-324

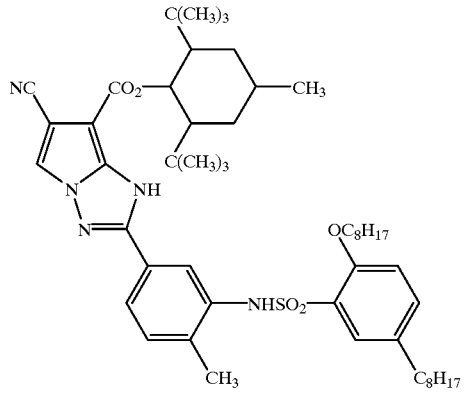

BP-41

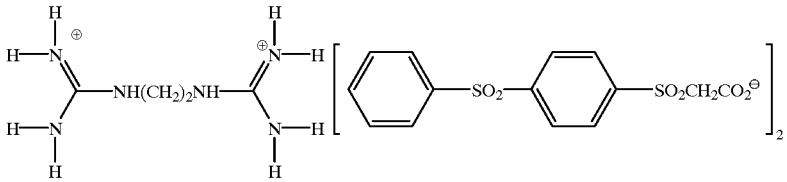

Samples 202 to 205 in which the silver density during development was changed were made following the same procedures as for sample 201 except that the gelatin coating amount in the high-speed magenta generating layer of sample 201 was changed.

Sample pieces were cut out from these light-sensitive materials and exposed at 200 lux for 1/100 sec via an optical wedge.

After the exposure, heat development was performed at 120° C. for 15 sec and at 150° C. for 20 sec using a heat drum.

The sensitivity of each heat-developed color sample was obtained by measuring its transmission density. This sensitivity was obtained in the same manner as in Example 1, and is indicated by a relative value with respect to sample 201 in Table 6.

TABLE 6

| Sample No. | Silver density at development of high-speed magenta color layer ($g/m^3$) | Sensitivity |
|---|---|---|
| 201 (Comp.) | $3.5 \times 10^5$ | 0.00 |
| 202 (Inv.) | $4.3 \times 10^5$ | +0.11 |
| 203 (Inv.) | $5.2 \times 10^5$ | +0.16 |
| 204 (Inv.) | $6.5 \times 10^5$ | +0.24 |
| 205 (Inv.) | $8.1 \times 10^5$ | +0.28 |

Table 6 shows that even in a heat development type light-sensitive material system, each light-sensitive material processed in accordance with the invention of the present invention having high silver density during development had high sensitivity and exhibited a favored performance.

Example 3

Sample 301 was manufactured by making the following changes for sample 114 in Example 1.

That is, sample 301 was prepred following the same procedures as for example 114 except that the green-sensitive emulsions were replaced with emulsions prepared by adsorbing sensitizing dyes A, B, and C set forth below to two layers instead of using the sensitizing dyes 4, 5, and 6 or the sensitizing dyes 8, 6, and 13. Note that the sensitizing dyes A and B were added before chemical sensitization, and the sensitizing dye C was added after compounds 2 and 3 were added after chemical sensitization.

Sensitizing dye A

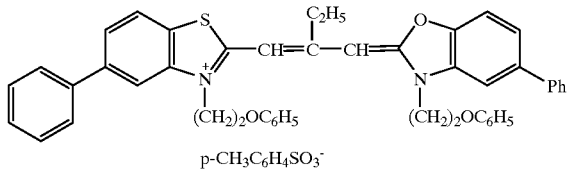

Sensitizing dye B

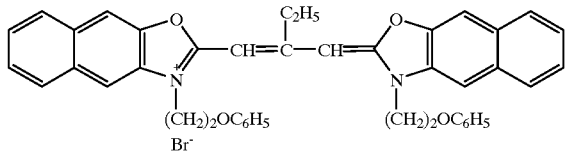

Sensitizing dye C

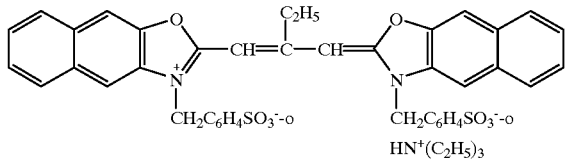

A mixture of Sensitizing dyes A:B:C=7:27:66 (molar ratio)

This sample 301 was image-wise exposed, developed, and evaluated in the same manner as in Example 1. As a consequence, the sensitivity for a magenta image was further improved.

The processing method of the present invention has high rapid processing suitability and high heat development suitability. In particular, color images having sensitivity and graininess higher than expected can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for processing a silver halide color photographic light-sensitive material, having, on a support, at least one light-sensitive silver halide emulsion layer containing a light-sensitive silver halide emulsion, a compound capable of forming a dye by a coupling reaction with a developing agent in an oxidized form, and a binder, wherein the method comprises:

heat development processing the light-sensitive material without using a processing member such that a silver density of the at least one light-sensitive silver halide emulsion layer during development is $4\times10^5$ g/m$^3$ or more, and wherein at least one light-sensitive silver halide emulsion layer of the light-sensitive material contains a tabular silver halide emulsion having an average grain thickness of 0.01 to 0.07 $\mu$m.

2. The method for processing a silver halide color photographic light-sensitive material according to claim 1, wherein the silver density is $6\times10^5$ g/m$^3$ or more.

3. The method for processing a silver halide color photographic light-sensitive material according to claim 1, wherein the light-sensitive material has a blue-sensitive silver halide emulsion layer containing a yellow coupler, a green-sensitive silver halide emulsion layer containing a magenta coupler, and a red-sensitive silver halide emulsion layer containing a cyan coupler, and each of the blue-sensitive layer, green-sensitive layer, and red-sensitive layer comprises two or more photosensitive layers different in speed.

4. The method for processing a silver halide color photographic light-sensitive material according to claim 1, wherein at least one light-sensitive silver halide emulsion layer of the light-sensitive material contains a light-sensitive silver halide emulsion having an average aspect ratio of 2 or more.

5. The method for processing a silver halide color photographic light-sensitive material according to claim 4, wherein the average aspect ratio is 8 or more.

6. The method for processing a silver halide color photographic light-sensitive material according to claim 1, wherein at least one light-sensitive layer of the light-sensitive material contains a developing agent or its precursor.

7. The method for processing a silver halide color photographic light-sensitive material according to claim 6, wherein the developing agent is selected from compounds represented by formulas (1) to (5) below:

(1)

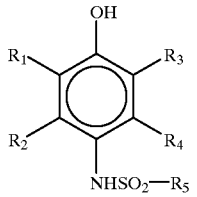

-continued (2)

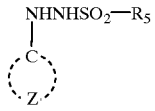

(3)

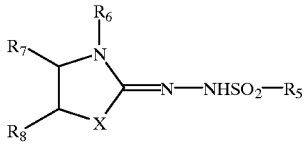

(4)

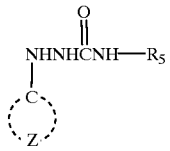

(5)

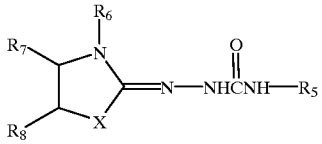

wherein each of $R_1$ to $R_4$ independently represents a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents a substituted or unsubstituted alkyl group, aryl group or heterocyclic group; Z represents an atom group capable of forming an aromatic ring (including a heteroaromatic ring) together with the carbon atom, which aromatic ring may have a substituent other than —NHNHSO$_2$—R$_5$, provided that when the aromatic ring formed with Z is a benzene ring, the total of Hammett's constants ($\sigma$) of the substituents is 1 or more; $R_6$ represents a substituted or unsubstituted alkyl group; X represents an oxygen atom, a sulfur atom, a selenium atom or a tertiary nitrogen atom substituted with an alkyl group or aryl group; and $R_7$ and $R_8$ each represent a hydrogen atom or a substituent, provided that $R_7$ and $R_8$ may be bonded to each other to thereby form a double bond or a ring.

8. The method for processing a silver halide color photographic light-sensitive material according to claim 6, wherein the developing agent is a para-phenylenediamine-based color developing agent.

9. The method for processing a silver halide color photographic light-sensitive material according to claim 6, wherein the precursor of the developing agent is represented by formula (6) below:

(6)

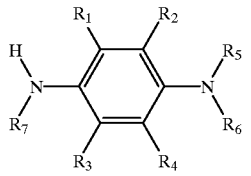

wherein each of $R_1$, $R_2$, $R_3$ and $R_4$ independently represents a hydrogen atom or a substituent; each of $R_5$ and $R_6$ independently represents an alkyl group, an aryl group, a heterocyclic group, an acyl group or a sulfonyl group; $R_1$ and $R_2$, $R_3$ and $R_4$, $R_5$ and $R_6$, $R_2$ and $R_5$, and/or $R_4$ and $R_6$ may be bonded to each other to thereby form a 5-membered, 6-membered or 7-membered ring; and $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)— or $(M)_{1/n}OSO_2$—, wherein each of $R_{11}$, $R_{12}$, $R_{13}$ and $R_{14}$ independently represents an alkyl group, an aryl group or a heterocyclic group, $R_{15}$ represents a hydrogen atom or a block group, W represents an oxygen atom, a sulfur atom or >N—$R_{18}$, each of $R_{16}$, $R_{17}$ and $R_{18}$ independently represents a hydrogen atom or an alkyl group, M represents a n-valence cation, and n is an integer of 1 to 5.

10. The method for processing a silver halide color photographic light-sensitive material according to claim 1, wherein at least one light-sensitive silver halide emulsion contained in the light-sensitive material is a tellurium-sensitized emulsion.

11. The method for processing a silver halide color photographic light-sensitive material according to claim 1, wherein at least one light-sensitive silver halide emulsion layer of the light-sensitive material contains one or more types of fine inorganic grains having a refractive index of 1.62 to 3.30 with respect to light having a wavelength of 500 nm in a dispersing medium phase of the emulsion layer, the total weight % of the fine grains contained in a unit volume of the dispersing medium phase is 1.0 to 95, and the dispersing medium phase containing the fine grains is substantially transparent to light having a wavelength at which the light-sensitivity of the emulsion layer is maximum.

12. The method for processing a silver halide color photographic light-sensitive material according to claim 1, wherein the light-sensitive silver halide emulsion layer contains a light-sensitive silver halide emulsion containing tabular silver halide grains to which sensitizing dyes are adsorbed such that the maximum spectral absorption wavelength is less than 500 nm and the light absorption intensity is 60 or more, or the maximum spectral absorption wavelength is 500 nm or more and the light absorption intensity is 100 or more.

13. The method for processing a silver halide color photographic light-sensitive material according to claim 4, wherein the light-sensitive silver halide emulsion contains hexagonal tabular grains each of which has a ratio of the length of an edge having a maximum length to the length of an edge having a minimum length of 1 to 2, and the hexagonal tabular grains account for 100 to 50% of the total projected area of all the grains contained in the light-sensitive silver halide emulsion.

14. The method for processing a silver halide color photographic light-sensitive material according to claim 4, wherein a coefficient variation of distribution of diameters of the projected areas of all the silver halide grains contained in the light-sensitive silver halide emulsion layer is 20 to 3%.

15. The method for processing a silver halide color photographic light-sensitive material according to claim 11, wherein the total weight % of the fine grains contained in a unit volume of the dispersing medium phase is 2 to 60.

* * * * *